US008894058B2

(12) United States Patent
Seki

(10) Patent No.: US 8,894,058 B2
(45) Date of Patent: Nov. 25, 2014

(54) SHEET FEEDER AND IMAGE FORMING APPARATUS USING THE SAME

(71) Applicant: Hiroyuki Seki, Kanagawa (JP)

(72) Inventor: Hiroyuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/057,665

(22) Filed: Oct. 18, 2013

(65) Prior Publication Data

US 2014/0042690 A1 Feb. 13, 2014

Related U.S. Application Data

(62) Division of application No. 13/405,952, filed on Feb. 27, 2012, now Pat. No. 8,590,885.

(30) Foreign Application Priority Data

Mar. 8, 2011 (JP) ..... 2011-050355
Dec. 21, 2011 (JP) ..... 2011-280422

(51) Int. Cl.

| | |
|---|---|
| ***B65H 5/00*** | (2006.01) |
| ***B65H 5/22*** | (2006.01) |
| ***B65H 7/02*** | (2006.01) |
| ***B65H 5/02*** | (2006.01) |
| ***B65H 3/06*** | (2006.01) |
| ***B65H 5/36*** | (2006.01) |
| ***B65H 3/52*** | (2006.01) |
| ***B65H 3/44*** | (2006.01) |
| ***B65H 5/26*** | (2006.01) |

(52) U.S. Cl.

CPC .. *B65H 7/02* (2013.01); *B65H 3/06* (2013.01); *B65H 2557/23* (2013.01); *B65H 2511/214* (2013.01); *B65H 2515/34* (2013.01); *B65H 5/36* (2013.01); *B65H 3/5223* (2013.01); *B65H 2511/22* (2013.01); *B65H 2511/13* (2013.01); *B65H 3/44* (2013.01); *B65H 2511/416* (2013.01); *B65H 5/26* (2013.01)

USPC ..... 271/4.02; 271/4.1; 271/10.02; 271/10.11; 271/272; 271/265.01

(58) Field of Classification Search

USPC ..... 271/4.1, 4.2, 10.11, 10.02, 265.01, 271/265.04, 272, 4.02

See application file for complete search history.

(56) References Cited

U.S. PATENT DOCUMENTS

| | | | | |
|---|---|---|---|---|
| 4,256,299 | A * | 3/1981 | Hogenson | 271/262 |
| 7,347,420 | B2 * | 3/2008 | Kobayashi et al. | 271/272 |
| 2005/0017433 | A1 | 1/2005 | Otsuki et al. | |
| 2005/0082742 | A1 | 4/2005 | Kang et al. | |
| 2007/0222139 | A1 | 9/2007 | Hotani | |

FOREIGN PATENT DOCUMENTS

| | | |
|---|---|---|
| JP | 2-282131 | 11/1990 |
| JP | 5-278885 | 10/1993 |
| JP | 6-92507 | 4/1994 |
| JP | 8-324816 | 12/1996 |

(Continued)

*Primary Examiner* — David H Bollinger

(74) *Attorney, Agent, or Firm* — Oblon, Spivak, McClelland, Maier & Neustadt, L.L.P.

(57) ABSTRACT

A sheet feeder including a sheet container on which sheets are placed, a transfer roller to transfer the sheets to an image forming unit via a transfer path; a friction pad to transfer the sheets together with the transfer roller; and a movable portion provided on the transfer path to alter a direction of the transfer path based on the sheets.

6 Claims, 45 Drawing Sheets

(56) References Cited

FOREIGN PATENT DOCUMENTS

| | | |
|---|---|---|
| JP | 10-16334 | 1/1998 |
| JP | 10-25039 | 1/1998 |
| JP | 2000-72266 | 3/2000 |
| JP | 2000-118764 | 4/2000 |
| JP | 2009-203071 | 4/2000 |
| JP | 2003-176062 | 6/2003 |
| JP | 2004-35228 | 2/2004 |
| JP | 2008-120543 | 5/2008 |
| JP | 2010-132374 | 6/2010 |

* cited by examiner

SHEET FEEDER AND IMAGE FORMING APPARATUS USING THE SAME

CROSS-REFERENCE TO RELATED APPLICATIONS

This patent application is a divisional application of U.S. application Ser. No. 13/405,952, filed Feb. 27, 2012 and is based on and claims priority pursuant to 35 U.S.C. §119 to Japanese Patent Application No. 2011-050355 and 2011-280422, filed on Mar. 8, 2011 and Dec. 21, 2011, respectively, in the Japanese Patent Office, the entire disclosure of each of which are hereby incorporated by reference herein.

BACKGROUND OF THE INVENTION

1. Field of the Invention

The present invention relates to a sheet feeder and an image forming apparatus including the sheet feeder.

2. Description of the Background Art

Image forming apparatuses such as photocopiers and printers include sheet feeders (sheet transfer device).

FIG. 49 is a longitudinal cross-sectional view illustrating a sheet feeder contained in a typical image forming apparatus. The image forming apparatuses used in business environments, such as printers and photocopiers, typically have multiple sheet feeding cassettes 21 and 22 stacked vertically to provide selectability with regard to sheet size, thickness, etc.

As can be seen in FIG. 49, the sheet feeding cassettes 21 and 22 are disposed substantially vertically and have a structure in which a sheet 91 or 92 fed from a selected sheet feeding cassette by feeding rollers 31 and 32 along guides 71 or 72 is guided diagonally upward toward a sheet feeding guide 75. The sheet feeding guide 75 is fixed almost vertically to feed sheets from each of the sheet feeder cassette 22 situated at bottom and the sheet feeder cassette 21 situated thereabove.

At the same time, in recent years, image forming apparatus such as printers and photocopiers used in business environments are required to be increasingly compact in size. This is particularly significant in the case of desktop printers. As a result, sheet feeders are formed and arranged in a complex manner in such printers.

FIG. 50 is a longitudinal cross-sectional view illustrating a typical sheet feeder. The feeding roller 31 is driven and is rotatably supported by the image forming apparatus, and an opposing roller 41 is rotatably supported by a roller base 43. The roller base 43 in turn is supported by a roller base support 51 that is fixed to the image forming apparatus. To press the opposing roller 41 against the feeding roller 31, a roller biasing member 45 such as a coil spring is inserted between the roller base 43 and the roller base support 51 to provide this biasing force, i.e., a contact pressure force, with the elastic force of the roller biasing member 45. A sheet feeding guide 75 is provided downstream of the feeding roller 31 and the opposing roller 41.

The sheet 91 fed from upstream relative to the sheet transfer direction advances into a nipping portion between the feeding roller 31 and the opposing roller 41 that nip the sheet 91 and conveys the sheet 91 downstream with a driving force provided by the rotation of the feeding roller 31. However, the sheet feeding guide 75 is bent as illustrated in FIG. 50. Consequently, depending on the arrangement of the rollers, a thick and therefore relatively stiff sheet of recording media such as a thick sheet of paper passing through the sheet feeding guide 75 may get jammed in the sheet feeding guide 75. Therefore, an upper limit is set for the thickness of the sheet in some types of image forming apparatuses. However, this is an extreme method and not a practical solution because the utility of the apparatus is compromised.

A more detailed description is now given of the mechanism of such jamming, using FIG. 49. In FIG. 49, it can be seen that the sheet 91 fed from the sheet feeding cassette 21 passes through the guide 71 and thereafter contacts the sheet feeding guide 75 with its leading end. As the thickness of the sheet 91 increases, the sheet 91 becomes stiffer. Consequently, when the leading end of the sheet 91 contacts the sheet feeding guide 75 at an angle equal to or greater than a certain angle, the contact resistance between the sheet 91 and the sheet feeding guide 75 surpasses the feeding force of the feeding roller 31, resulting in jamming or halting of the sheet 91.

To avoid this problem, Japanese patent application publication nos. H02-282131, H08-324816, 2000-072266, and 2000-118764 describe methods of decreasing the resistance of feeding sheets by changing the arrangement of the sheet feeding guide from the significantly upright position to a more horizontal position, to form a smaller, more acute contact angle between the leading end of a sheet and a sheet feeding guide. However, desktop printers for use in small offices are required to be compact in size in terms of space-saving. Against this demand, the size of the apparatus increases by the methods described above. That is, there is a trade-off between the improvement of feeding performance and size reduction of the apparatus, as illustrated in FIG. 50.

SUMMARY OF THE INVENTION

In view of the foregoing, the present invention provides a sheet feeder including a sheet container on which sheets are placed, a transfer roller to transfer the sheets to an image forming unit via a transfer path, a friction pad to transfer the sheets together with the transfer roller, and a movable portion provided on the transfer path to alter a direction of the transfer path based on the sheets.

As another aspect of the present invention, a sheet feeder including a sheet container on which sheets are placed, a transfer roller, and an opposing roller facing the transfer roller to transfer a sheet that has advanced between the transfer roller and the opposing roller, wherein the opposing roller tilts at an angle to a surface of the transfer roller determined by thickness of the sheet that has advanced between the transfer roller and the opposing roller.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Next, embodiments of the sheet feeder and the image forming apparatus the present disclosure are described with reference to accompanying drawings. The same numbers are assigned to the same or corresponding part in respective drawings and repeated descriptions thereof are suitably shortened or omitted.

From the sheet feeder, the sheet contained therein is transferred to an image forming portion (apparatus). The sheet feeder includes a movable portion. The movable portion is a movable guide, a friction pad, etc. in the following embodiments.

Figure 1:
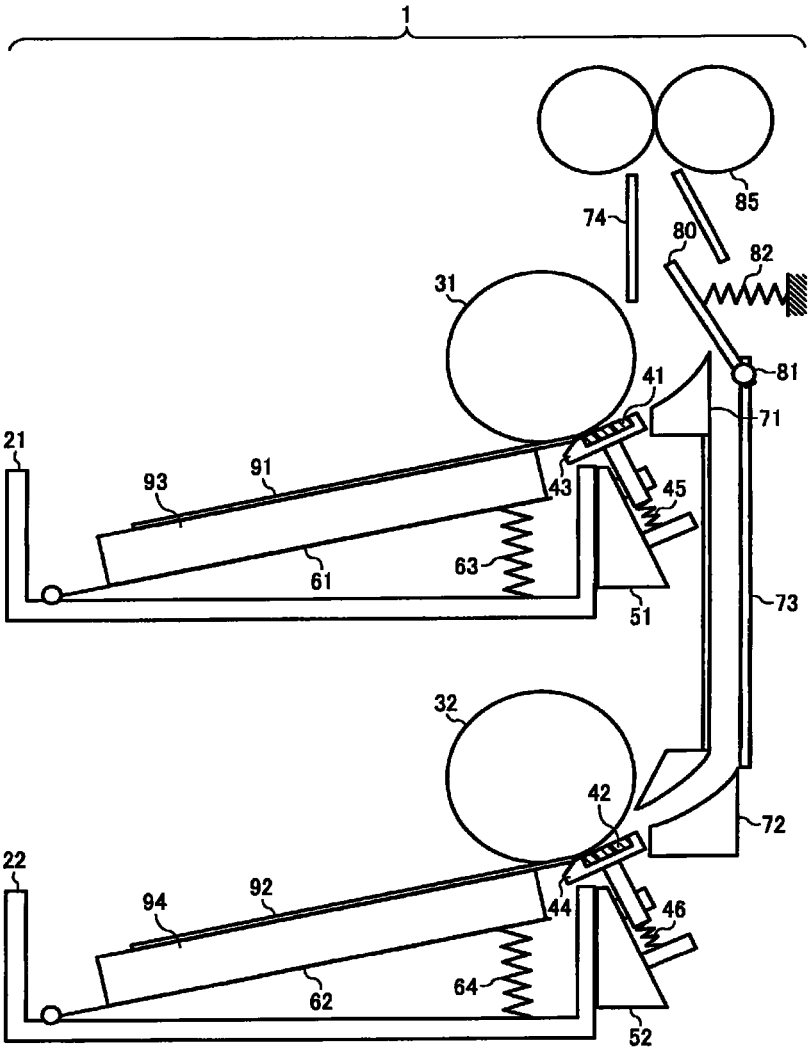
FIG. 1 is a longitudinal cross-sectional view illustrating an example of the sheet feeder of the image forming apparatus of the embodiment 1 described later.
Figure 2:
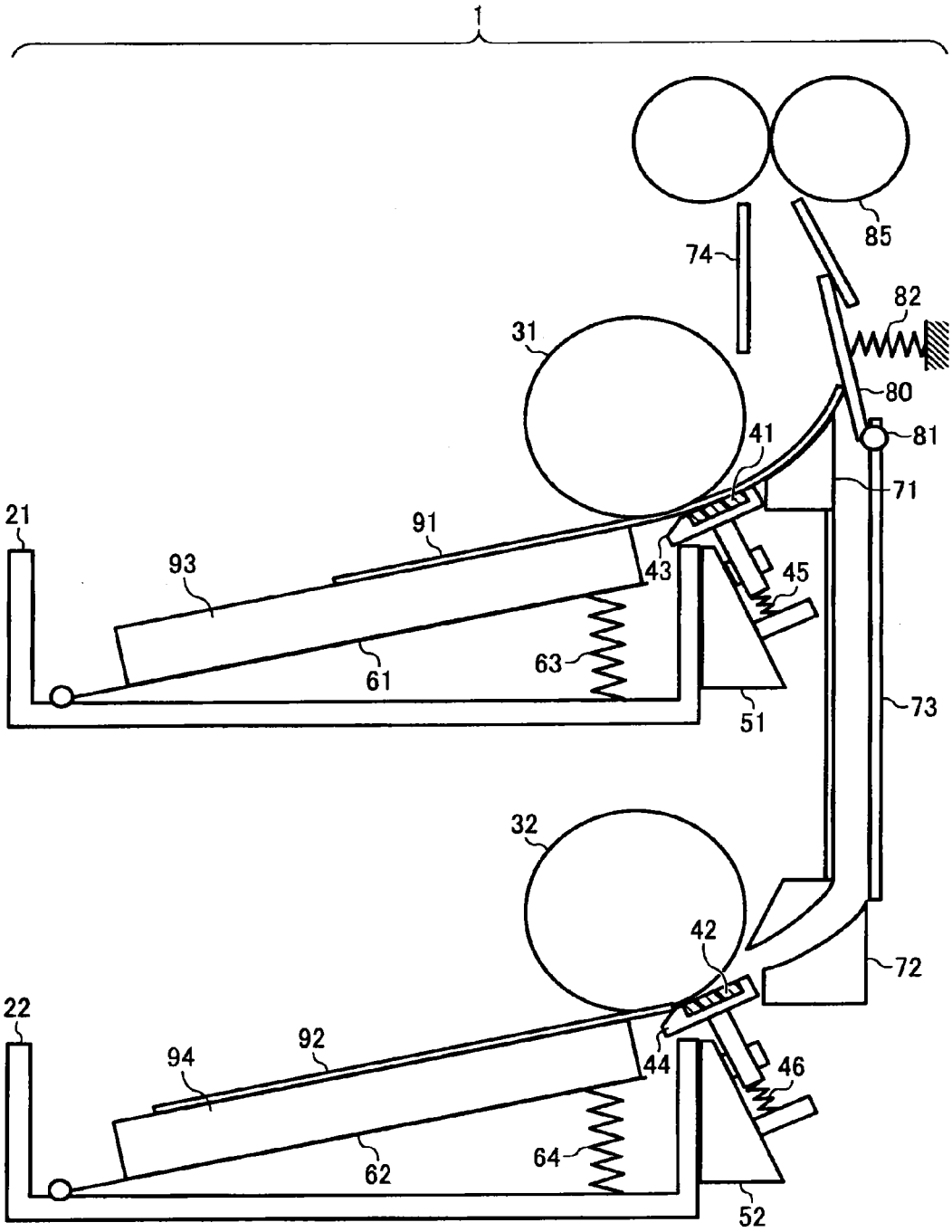
FIG. 2 is a diagram illustrating a longitudinal cross-sectional view illustrating an example of the sheet feeder of the image forming apparatus of the embodiment 1 described later in which the contact angle of the sheet and the movable guide becomes narrower.

The first embodiment (embodiment 1) of the sheet feeder is described in detail with reference to FIGS. 1 and 2. FIG. 1 is a longitudinal cross-sectional view of an example of the sheet feeder of the image forming apparatus of the embodiment 1 and FIG. 2 is a longitudinal cross-sectional view illustrating an example of the sheet feeder of the image forming apparatus of the embodiment 1 in which the contact angle of a sheet and a movable guide is narrowed.

In the sheet feeder 1, feeding rollers 31 and 32 are rotatably supported to an image forming apparatus such as a photocopier and friction pads 41 and 42 that are pressed against the feeding rollers 31 and 32, respectively, are supported at the upper parts of pad devices 43 and 44. The friction pads 41 and 42 are frictional members made of resins and corks. The pad devices 43 and 44 are linked with the sheet feeding cassettes 21 and 22 by linking devices 51 and 52, respectively. To press the pads 43 and 44 against the feeding rollers 31 and 32, pad biasing members 45 and 46 such as coil springs are inserted between the pads 43 and 44 and the linking devices 51 and 52 to provide the biasing force of the pad by the elastic forces of the pad biasing members 45 and 46.

In the sheet feeding cassettes 21 and 22, the base plates 61 and 62 movable up and down by a base plate biasing members 63 and 64 such as coil springs are provided and bundles of sheets 93 and 94 are provided on the base plates 61 and 62, respectively. Sheets 91 and 92 placed at the uppermost of the bundles of sheets 93 and 94 are pressed against the feeding rollers 31 and 32 by the elastic force of the base plate biasing members 63 and 64. When the feeding rollers 31 and 32 rotate counterclockwise in FIG. 1, the sheets 91 and 92 receive the friction force from the feeding rollers 31 and 32 and advances between the feeding rollers 31 and 32 and the friction pads 41 and 42. When multiple sheets 91 advances between the feeding rollers 31 and 32 and the friction pads 41 and 42 at the same time, the sheets 91 are separated by difference in the friction force caused by each friction index and only a single sheet 91 is fed into the image forming apparatus.

The sheet 91 is conveyed diagonally upward toward a movable guide 80 along the guide 71 after the friction pad 41 and the feeding roller 31. The movable guide 80 is rotatably supported by a rotation shaft 81 to the image forming apparatus and biased by a guide biasing member 82 such as a coil spring toward a sheet feeding guide 74 on the side of the feeding roller 31. The bottom part of the movable guide 80, situated upstream from the top part thereof relative to the sheet transfer direction, is liked continuously with a sheet feeding guide 73 from the sheet feeding cassette 22 situated below. It is preferable that the rotation center of the rotation shaft 81 is placed below the downstream edge of the guide 71 relative to the sheet transfer direction in FIG. 1 and when the leading end of the sheet 91 contacts the movable guide 80, the leading end contacts the movable guide 80 at the portion above the rotation center of the rotation shaft 81, i.e., downstream from the rotation center of the rotation shaft 81 relative to the sheet transfer direction.

There is a gap between the sheet feeding guide 74 on the side of the feeding roller 31 and the upper part of the movable guide 80, which is situated downstream of the lower part relative to the sheet transfer direction. Therefore, a sheet having a low elasticity such as a thin sheet advances along the guide 71, contacts and follows, and is transferred through the gap between the movable guide 80 and the sheet feeding guide 74.

In addition, the sheet 92 transferred from the sheet feeding cassette 22 situated below advances along the sheet feeding guide 73, passes between the movable guide 80 and the guide 71 along the movable guide 80, and thereafter is transferred through the gap between the movable guide 80 and the sheet feeding guide 74.

In the case of a sheet having a high elasticity such as a thick sheet, the leading end thereof passes through the friction pad 41, advances diagonally upward right in FIG. 1 along the guide 71, and contacts the upper part (above the rotation shaft 81) of the movable guide 80. The movable guide 80 is pressed by the leading end of the sheet 91 at the portion above the rotation shaft 81 and rotates clockwise in FIG. 1. As a result, the contact angle of the leading end of the sheet 91 and the movable guide 80 becomes an acuter angle. FIG. 2 illustrates this state. Consequently, the transfer resistance of the movable guide 80 against the leading end of the sheet 91 decreases so that the sheet 91 is transferred to the movable guide 80 without jamming or halting.

After the sheet 91 has passed through, the movable guide 80 is returned to the original position by the guide biasing member 82. According to the first embodiment, a sheet feeder that stably feeds sheets without jamming or halting can be provided. It is preferable to form a small contact angle between the movable guide and the leading end of the sheet. In general, to transfer an A4 sheet smoothly, it is preferable to set the rotation range of the movable guide 80 in such a manner that the contact angle formed between the leading end of the sheet and the guide varies in the range of from 50° to 70°. In addition, in the first embodiment, the form of the movable guide 80 is flat, but not limited thereto. For example, it is suitable to use the movable guide 80 having a curved (e.g., arc) surface for the contact surface with a sheet. In this case, the center of the arc is preferably on the side where the sheet passes through.

Figure 3:
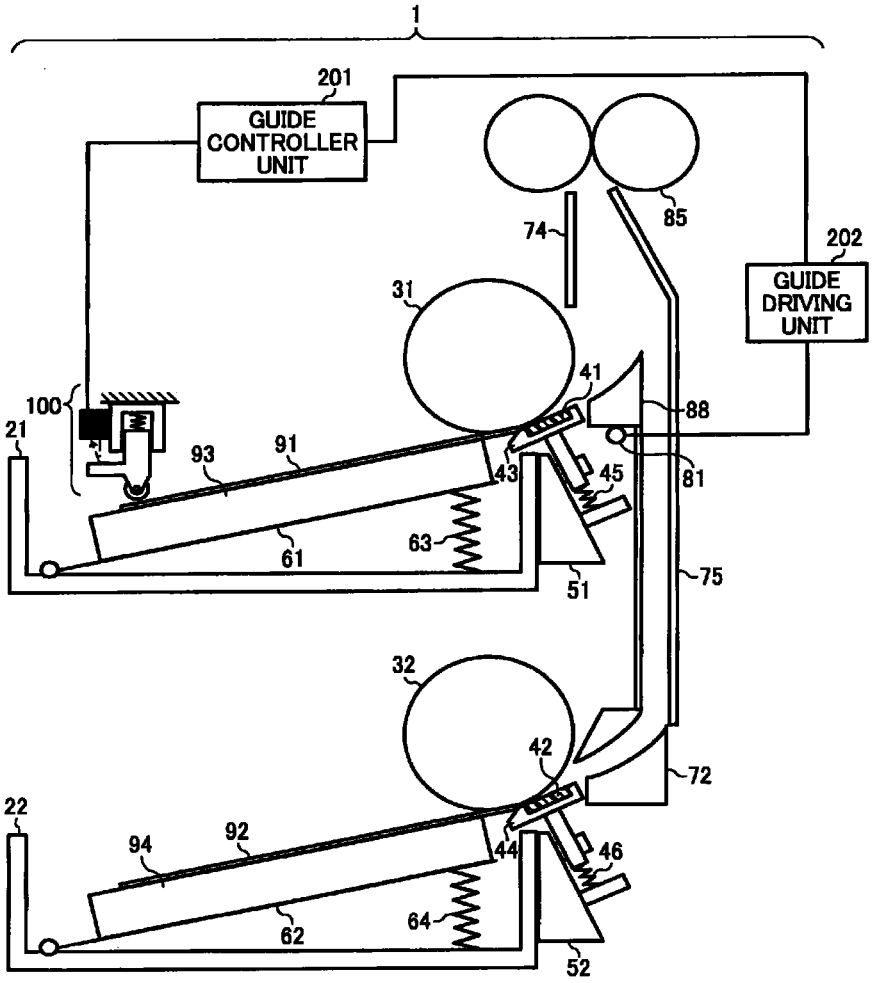
FIG. 3 is a longitudinal cross-sectional view illustrating an example of the sheet feeder of the image forming apparatus of embodiment 2 described later.

The second embodiment (embodiment 2) of the sheet feeder is described in detail with reference to FIGS. 3, 4, and 5. FIG. 3 is a longitudinal cross-sectional view illustrating an example of the sheet feeder of the image forming apparatus in the embodiment 2, FIG. 4 is a diagram illustrating a longitudinal cross-sectional view illustrating an example of the sheet feeder of the image forming apparatus of the embodiment 2 in which the contact angle between the sheet and the movable guide becomes narrower, and FIG. 5 is a lateral view illustrating the structure of an example of the sheet thickness detector in the sheet feeder of the image forming apparatus of the embodiments 2 to 24.

Figure 4:
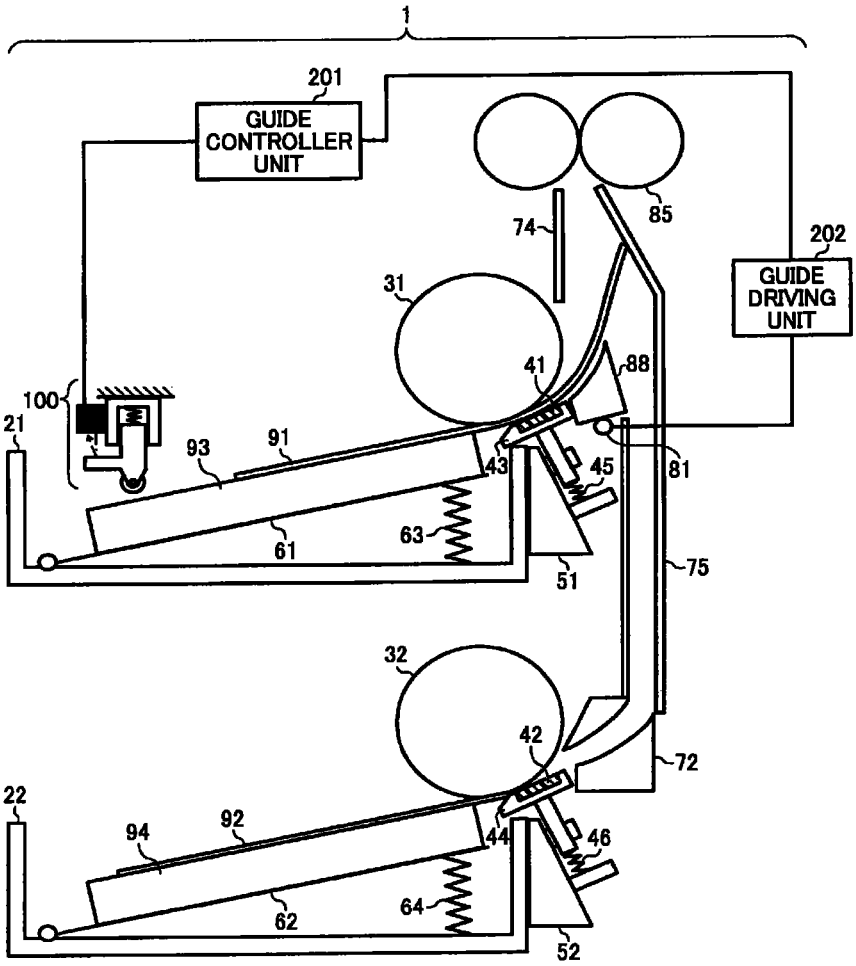
FIG. 4 is a diagram illustrating a longitudinal cross-sectional view illustrating an example of the sheet feeder of the image forming apparatus of the embodiment 2 described later in which the contact angle of the sheet and the movable guide becomes narrower.

FIGS. 3 and 4 are the same as FIGS. 1 and 2 in the first embodiment except that the movable guide 88 is different and a sheet thickness detector 100 is added.

The sheet feeding cassette 21 has the sheet thickness detector 100 to detect the thickness of the sheet 91 placed on top of the bundle of sheets 93. The sheet feeder 1 has a guide controller unit 201 that receives information about the thickness of the sheet from the sheet thickness detector 100 and generates signals to drive the movable guide 88 and a guide driving unit 202 that drives the movable guide 88 based on the signals from the guide controller unit 201. The guide driving unit 202 is, for example, a stepping motor.

Figure 5:
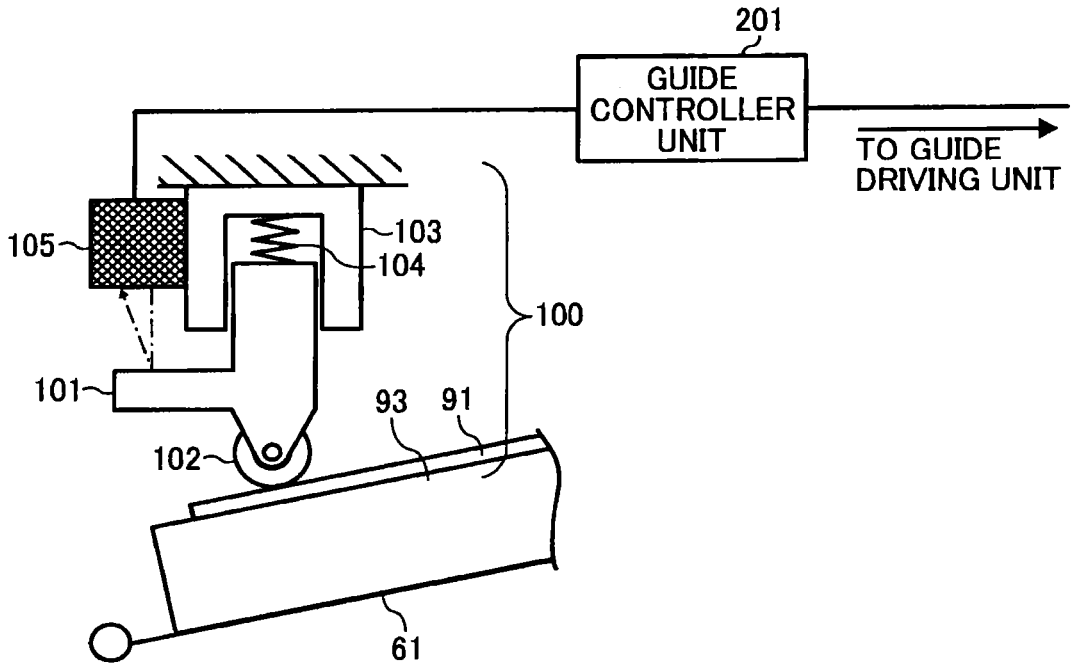
FIG. 5 is a lateral view illustrating the structure of an example of the sheet thickness detector in the sheet feeder of the image forming apparatus in the embodiments 2 to 24.

FIG. 5 illustrates the structure of the sheet thickness detector 100. The sheet thickness detector 100 has a sheet feeding roller 102 that contacts the sheet 91, a main portion 101 that supports the sheet feeding roller 102, a guiding portion 103 that supports moving of the main portion 101, a biasing portion 104 that biases the main portion 101 and the sheet feeding roller 102 to the sheet 91, and a displacement measuring portion 105 that measures the displacement of the main portion 101 to measure the thickness of the sheet 91. The biasing portion 104 is, for example, a spring and the displacement measuring portion 105 is, for example, a laser displacement meter.

To be specific, the laser displacement meter is, for example, a laser focus displacement meter. The laser focus displacement meter irradiates the reflection portion provided on the main portion 101 with a laser beam. Reflection light from a particular position reaches a light receiving element through a pinhole. On the other hand, reflection light does not pass through the pinhole if the main portion 101 moves. Therefore, in the case of the reflection light that does not pass through the pinhole, objective lenses are moved up and down to let the reflection light pass through the pinhole. The movement distance of the main portion 101 is measured by the position of this objective lens.

As illustrated in FIG. 5, the sheet thickness detector 100 is provided on the upstream side of the sheet 91 placed at the top of the feeder relative to the transfer direction of the sheet 91. The guiding portion 103 is fixed onto the apparatus. The sheet feeding roller 102 freely rotates along the feeding direction not to become a resistance to the sheet 91 when it is fed by the roller 31 (FIG. 3).

When the feeding roller 31 starts rotating to feed the sheet 91, the sheet 91 passes through the feeding roller 31 and the friction pad 41 and is conveyed to diagonally upward toward the movable guide 88. The sheet 91 passes through the sheet feeding roller 102 while contacting the sheet feeding roller 102 of the sheet thickness detector 100. In addition, the main portion 101 of the sheet thickness detector 100 is displaced by an amount equal to the thickness of the sheet 91 in the middle of passing through the main portion 101. The displacement amount is measured by the displacement measuring portion 105 and the thickness information of the sheet 91 is sent to the guide controller unit 201. The guide controller unit 201 determines the tilting angle of the movable guide 88 based on the thickness information sent from the displacement measuring portion 105 and transmits a signal, for example, a pulse signal to the guide driving unit 202 to move the guide driving unit 202.

The movable guide 88 is rotatably supported to the image forming apparatus by the rotation shaft 81, which is connected to the guide driving unit 202. When the sheet 91 is thick, i.e., highly elastic, the guide controller unit 201 determines the movement of the movable guide 88 based on the thickness information of the sheet 91 read by the sheet thickness detector 100 and the guide driving unit 202 moves the movable guide 88.

As a result, the movable guide 88 rotates counterclockwise as illustrated in FIG. 4, narrowing the contact angle between the leading end of the sheet 91 and sheet feeding guide 75. Consequently, the contact resistance between the leading end of the sheet 91 and sheet feeding guide 75 decreases so that the sheet 91 is transferred to the sheet feeding guide 75 without jamming or halting. After the sheet 91 has passed through the movable guide 88, the movable guide 88 is returned to the original position by the guide driving unit 202. According to the second embodiment, a sheet feeder that stably feeds sheets without jamming or halting can be provided.

The movement of the movable guide 88 is constant with regard to the thickness of the sheet or changeable to the elapse time of the sheet transfer or the position of the sheet 91 to gradually rotate the movable guide 88 counterclockwise in FIG. 4 to the sheet transfer process. When making the tilt of the movable guide 88 changeable to the elapse time of sheet transfer and the position of the sheet 91, the shock to the sheet 91 caused by contact between the sheet 91 and the sheet feeding guide 75 can be reduced by moving the movable guide 88.

For example, a device having a sheet transfer detector that measures the elapse time of the sheet transfer or detects the position of the sheet 91 when the feeder (transfer) roller starts transferring the sheet 91 can be provided in the middle of the sheet transfer path to obtain the elapse time of the sheet transfer and the position of the sheet 91. In the fourth embodiment described later, a structure that measures the elapse time is described in detail.

In addition, although the structure that drives the movable guides 80 and 88 situated at the top is described in the first and the second embodiments, a (pulling-in) guide 72 situated at the bottom can be used as the movable guide as well. In this case, the sheet feeder 1 has a sheet thickness detector to detect the thickness the sheet 92 in the bottom feeder, a guide driving unit to drive the pulling-in guide 72 situated at the bottom, and a guide controller unit to transmit signals to the guide driving unit.

In addition, the sheet thickness detector 100 is not limited to the structure or form described in the second embodiment. Any detector that can detect the thickness of the sheet 91 before the sheet 91 contacts the sheet feeding guide 75 can be suitably used. Furthermore, although the movable guide is rotated in the first and second embodiments, a movable guide that moves up and down in FIG. 3 can be suitably used as illustrated in the embodiment 4 described later.

Figure 6:
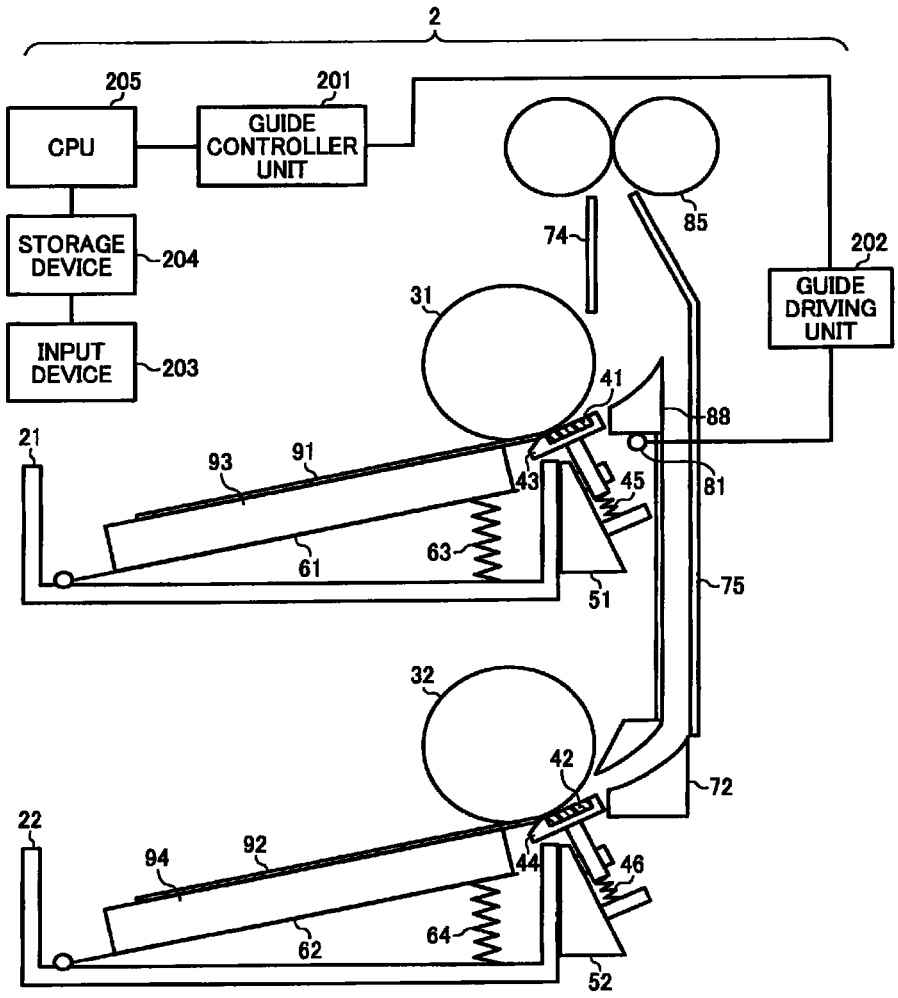
FIG. 6 is a longitudinal cross-sectional view illustrating an example of the sheet feeder of the image forming apparatus of the embodiment 3 described later.
Figure 7:
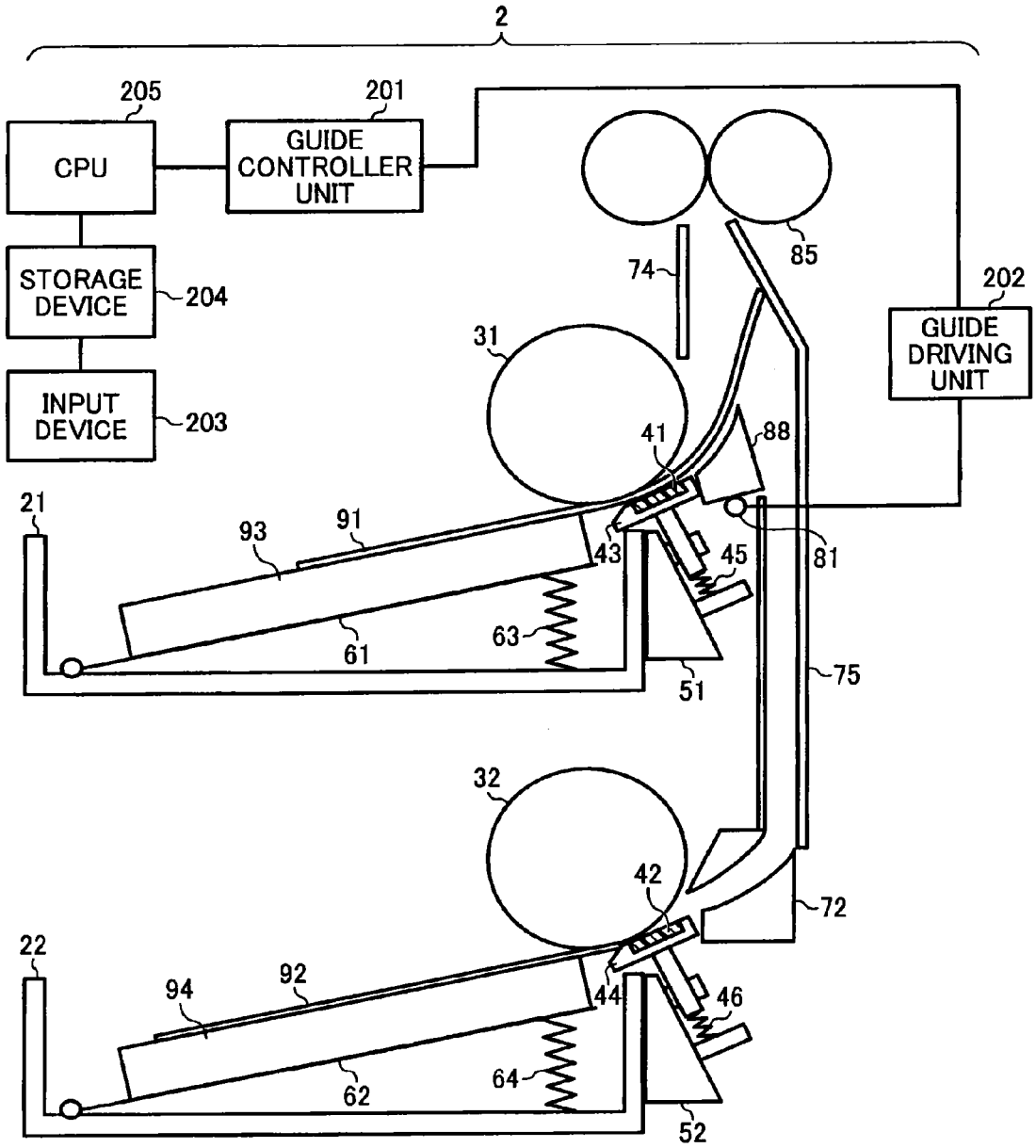
FIG. 7 is a diagram illustrating a longitudinal cross-sectional view illustrating an example of the sheet feeder of the image forming apparatus of the embodiment 3 described later in which the contact angle of the sheet and the movable guide becomes narrower.

The third embodiment (embodiment 3) of the sheet feeder is described in detail with reference to FIGS. 6 and 7. FIG. 6 is a longitudinal cross-sectional view of an example of the sheet feeder of the image forming apparatus of the embodiment 3 and FIG. 7 is a longitudinal cross-sectional view illustrating an example of the sheet feeder of the image forming apparatus of the embodiment 3 in which the contact angle of the sheet and the sheet transfer guide becomes narrower.

With regard to a sheet feeder 2, property information about the sheet such as the kind, thickness, or elasticity (bending rigidity) thereof is input or selected from an input device 203. The input information about the sheet is sequentially stored in a storage device 204. A CPU 205 controls the property information in the storage device 204. For example, a user can select the brand of sheet at the display provided to the image forming apparatus or from a data processing device (e.g., a home computer) connected to the image forming apparatus via a network.

The CPU 205 transmits the property information about the next sheet 91 to the guide controller unit 201. Based on the transmitted information about the sheet 91, the guide controller unit 201 determines the movement of the movable guide 88 to move it. As a result, the movable guide 88 rotates counterclockwise as illustrated in FIG. 7, narrowing the contact angle between the leading end of the sheet 91 and the sheet feeding guide 75.

Consequently, the contact resistance between the leading end of the sheet 91 and the sheet feeding guide 75 decreases so that the sheet 91 is transferred to the sheet feeding guide 75 without jamming or halting. After the sheet 91 has passed through the movable guide 88, the movable guide 88 is returned to the original position. The property information with regard to the sheet finished with feeding is deleted from the storage device 204 by the CPU 205. According to the third embodiment, a sheet feeder that stably feeds sheets without jamming or halting can be provided.

The property information about the sheet is not limited to the information described in the third embodiment. Any information usable to detect the thickness of the sheet 91 before the sheet 91 contacts the sheet feeding guide 75 is suitable. Furthermore, although the movable guide is rotated in the third embodiment, as illustrated in the embodiment. 4, a movable guide that moves up and down in FIG. 6 can be suitably used.

Figure 8:
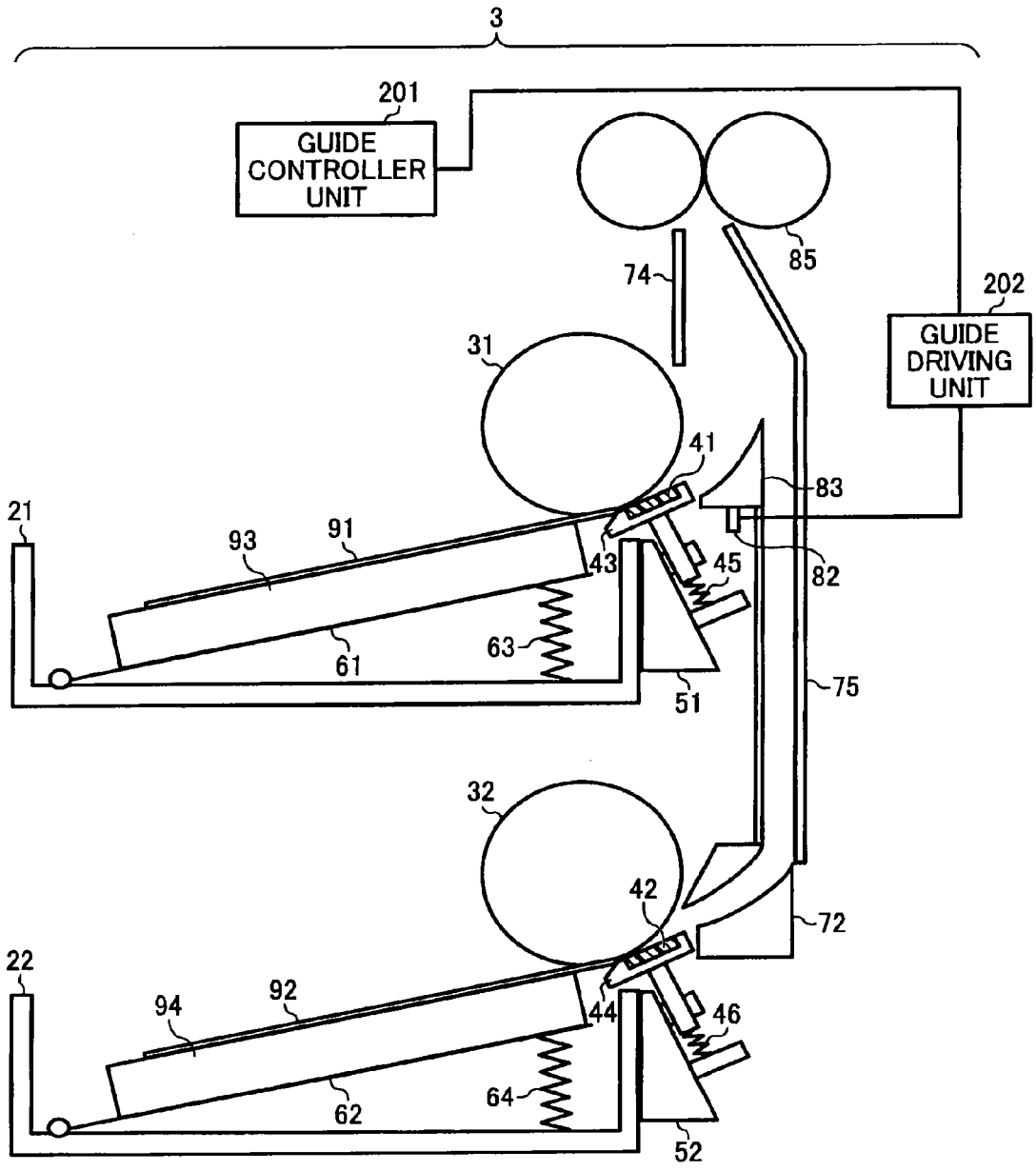
FIG. 8 is a longitudinal cross-sectional view illustrating an example of the sheet feeder of the image forming apparatus of the embodiment 4 described later.
Figure 9:
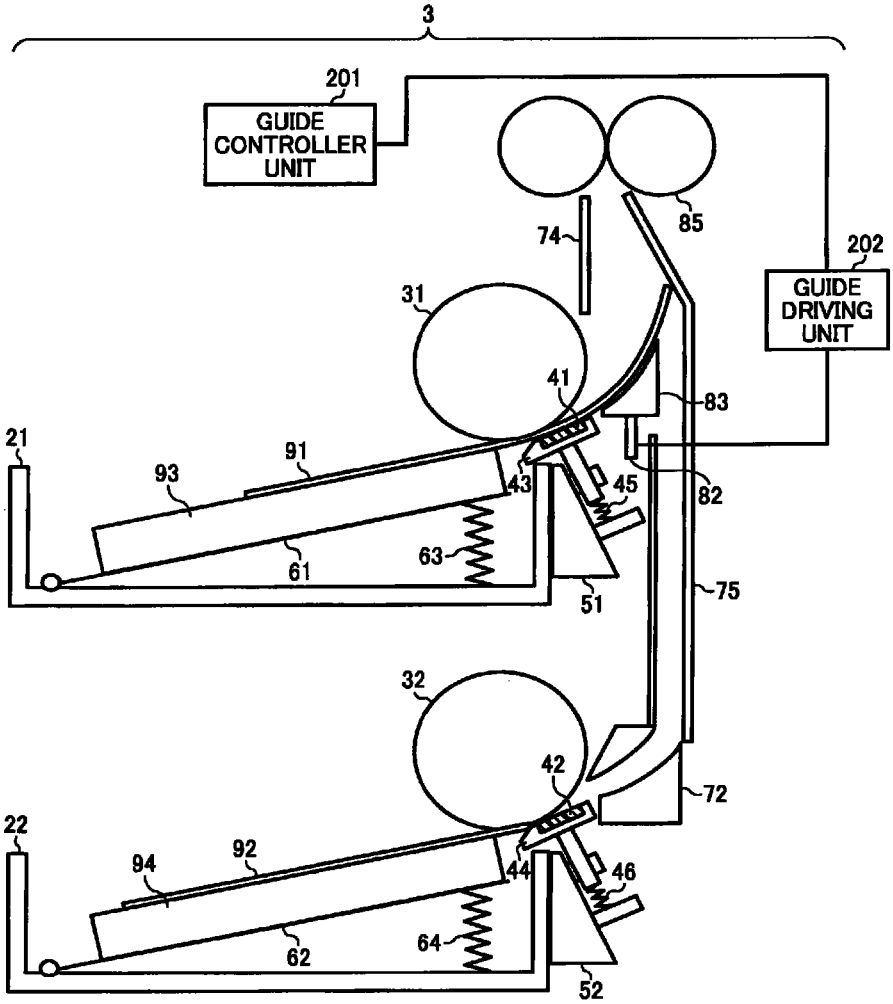
FIG. 9 is a diagram illustrating a longitudinal cross-sectional view illustrating an example of the sheet feeder of the image forming apparatus of the embodiment 4 described later in which the contact angle of the sheet and the movable guide becomes narrower.

Next, the fourth embodiment (embodiment 4) of the sheet feeder is described in detail with reference to FIGS. 8 and 9. FIG. 8 is a longitudinal cross-sectional view of an example of the sheet feeder of the image forming apparatus of the embodiment 4 and FIG. 9 is a longitudinal cross-sectional view illustrating an example of the sheet feeder of the image forming apparatus of the embodiment 4 in which the contact angle of the sheet and the sheet transfer guide becomes narrower.

The guide controller unit 201 determines the movement of a movable guide 83 to the elapse time of sheet transfer and the position of the sheet 91 to gradually move the movable guide 83 upward in FIG. 8 to the process of sheet transfer. For example, for the starting time which starts at when the feeding roller 31 starts rotation, pulse signals are stored in the guide controller unit 201 to regulate the movement of the movable guide 83 based on the transfer speed or the position of the sheet 91. The transfer speed and the position of the sheet 91 are obtained from the number of rotation of the feeding roller 31 and the rotation speed of the feeding roller 31.

The guide driving unit 202 is, for example, a stepping motor and moves a linear slider 82 according to the pulse signal transmitted from the guide controller unit 201. As a result, the movable guide 83 is movable up and down in FIG. 8. That is, a guide controller unit having a sheet transfer detector is provided in the middle of the sheet transfer path to measure the elapse time of the sheet transfer or detect the position of the sheet 91 when the feeder roller (also referred to as the transfer roller) starts transferring the sheet 91.

Based on the processes described above, the guide controller unit 201 determines the movement of the movable guide 83 and the guide driving unit 202 moves the movable guide 83. As a result, the movable guide 83 moves up and down as illustrated in FIG. 9, narrowing the contact angle between the leading end of the sheet 91 and the sheet feeding guide 75. Consequently, the contact resistance between the leading end of the sheet 91 and the sheet feeding guide 75 decreases so that the sheet 91 is transferred to the sheet feeding guide 75 without jamming or halting. After the sheet 91 has passed through the movable guide 83, the movable guide 83 is returned to the original position. According to the fourth embodiment, a sheet feeder that stably feeds sheets without jamming or halting can be provided.

Figure 10:
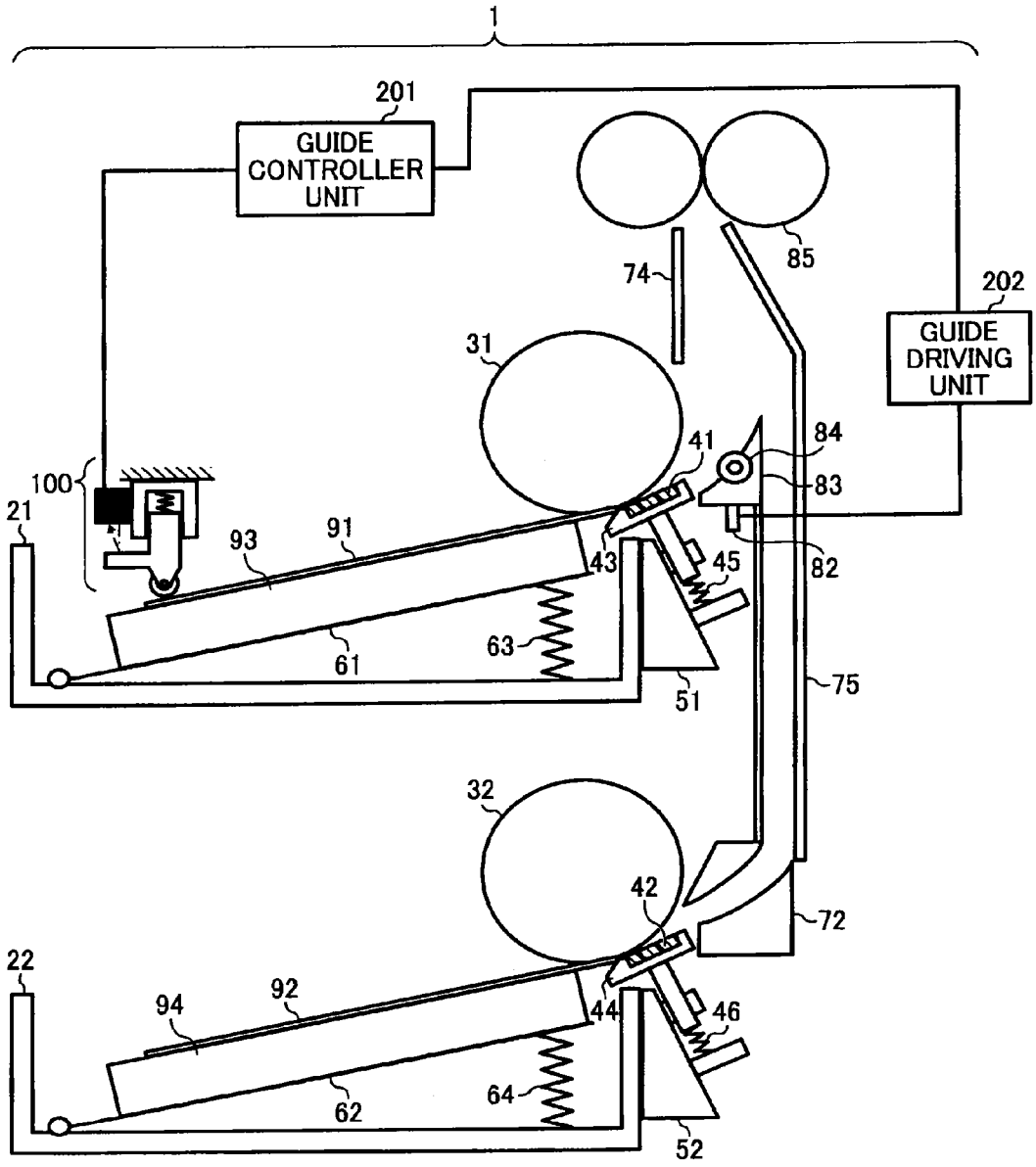
FIG. 10 is a longitudinal cross-sectional view illustrating an example of the sheet feeder of the image forming apparatus of the embodiment 5 described later.

Next, the fifth embodiment (embodiment 5) of the sheet feeder is described in detail with reference to FIGS. 10 and 11. FIG. 10 is a longitudinal cross-sectional view of an example of the sheet feeder of the image forming apparatus of the embodiment 5 and FIG. 11 is a longitudinal cross-sectional view illustrating an example of the sheet feeder of the image forming apparatus of the embodiment 5 in which the contact angle of the sheet and the sheet transfer guide becomes narrower.

The sheet feeding cassette 21 has the sheet thickness detector 100 to detect the thickness of the sheet 91 placed on top of the bundle of sheets 93. In addition, the sheet feeder 1 has a guide controller unit 201 that receives information about the thickness of the sheet from the sheet thickness detector 100 and generates signals to drive the movable guide 83 and a guide driving unit 202 that drives the movable guide 83 based on the signals from the guide controller unit 201. The guide driving unit 202 is, for example, a stepping motor and moves the linear slider 82 according to the pulse signal transmitted from the guide controller unit 201. As a result, the movable guide 80 is movable up and down in FIG. 10. The sheet thickness detector 100 is identical to that illustrated in FIG. 5 in the second embodiment and the description thereof is omitted.

Figure 11:
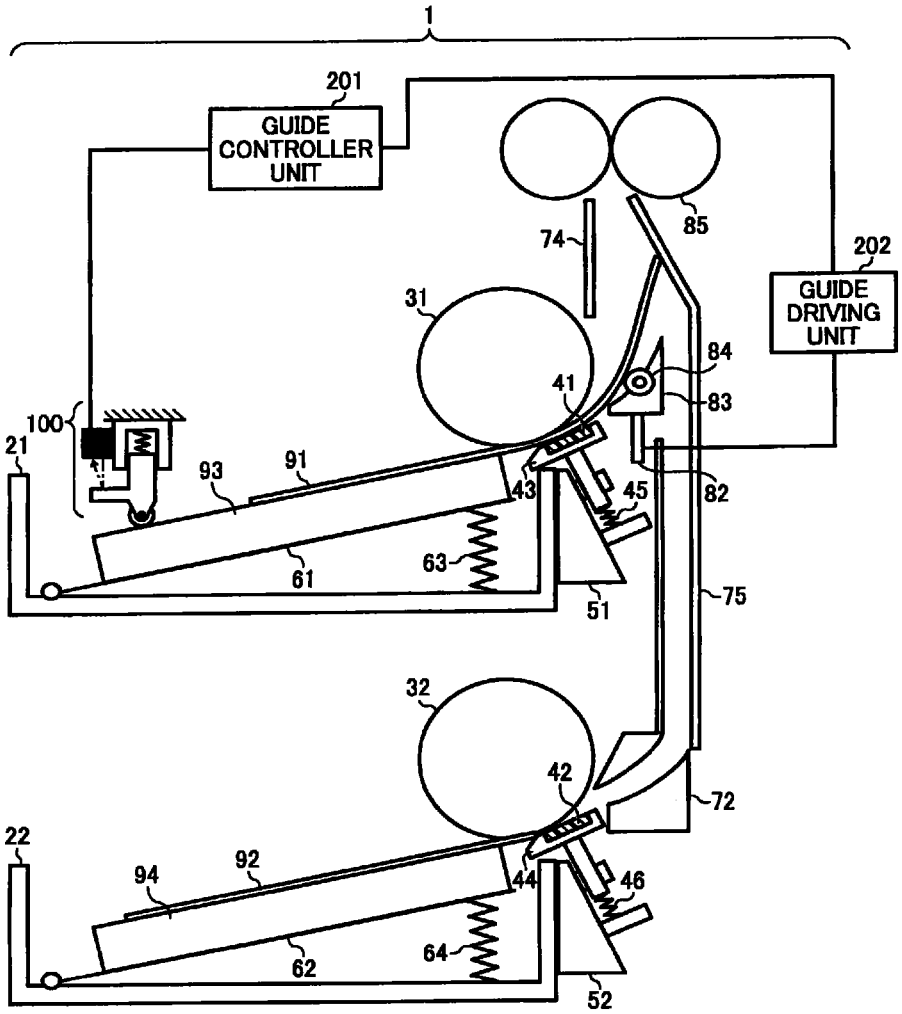
FIG. 11 is a diagram illustrating a longitudinal cross-sectional view illustrating an example of the sheet feeder of the image forming apparatus of the embodiment 5 described later in which the contact angle of the sheet and the movable guide becomes narrower.

FIGS. 10 and 11 are the same as FIGS. 8 and 9 of the fourth embodiment except for the form of the movable guide 83. That is, the movable guide 83 has a roller 84 at the position where the movable guide 83 contacts the sheet 91. The roller 84 is set to be able to freely rotate along the transfer direction of the sheet 91 so as not to become a resistance to the transfer operation of the sheet 91.

The guide controller unit 201 determines the displacement amount of the movable guide 83 based on the information about the thickness of the sheet 91 transmitted from the displacement measuring portion 105 in FIG. 5 and the movement of the movable guide 83 for the elapse time of sheet transfer and the position of the sheet 91 to gradually move the movable guide 83 upward in FIG. 10 to the process of sheet transfer.

For example, a guide controller unit having a sheet transfer detector is provided in the middle of the sheet transfer path to measure the elapse time of the sheet transfer or detect the position of the sheet 91 when the feeder (transfer) roller starts transferring the sheet 91.

In terms of the size reduction of the sheet feeder 1, it is preferable that the movable guide 83 and a pair of rollers 85 are arranged in such a manner that the vertical straight line in FIG. 10 that passes through the center of the rotation of the roller 84 is on the right hand side of the nipping portion of the pair of rollers 85 (which is arranged as the rollers immediately after the movable guide 83 relative to the sheet transfer direction).

For example, for the starting time which starts at when the sheet thickness detector 100 detects the thickness of the sheet 91, pulse signals to regulate the movement of the movable guide 83 by the transfer speed of the sheet 91 obtained from the rotation speed of the feeding roller 31 are stored in the guide controller unit 201. Based on the processes described above, the guide controller unit 201 determines the movement of the movable guide 83 and the guide driving unit 202 moves the movable guide 83.

As a result, the movable guide 83 moves upward as illustrated in FIG. 11, narrowing the contact angle between the leading end of the sheet 91 and sheet feeding guide 75. Consequently, the contact resistance between the leading end of the sheet 91 and the sheet feeding guide 75 decreases so that the sheet 91 is transferred to the sheet feeding guide 75 without jamming or halting. After the sheet 91 has passed through the movable guide 83, the movable guide 83 is returned to the original position. According to the fifth embodiment, a sheet feeder that stably feeds sheets without jamming or halting can be provided.

Figure 12:
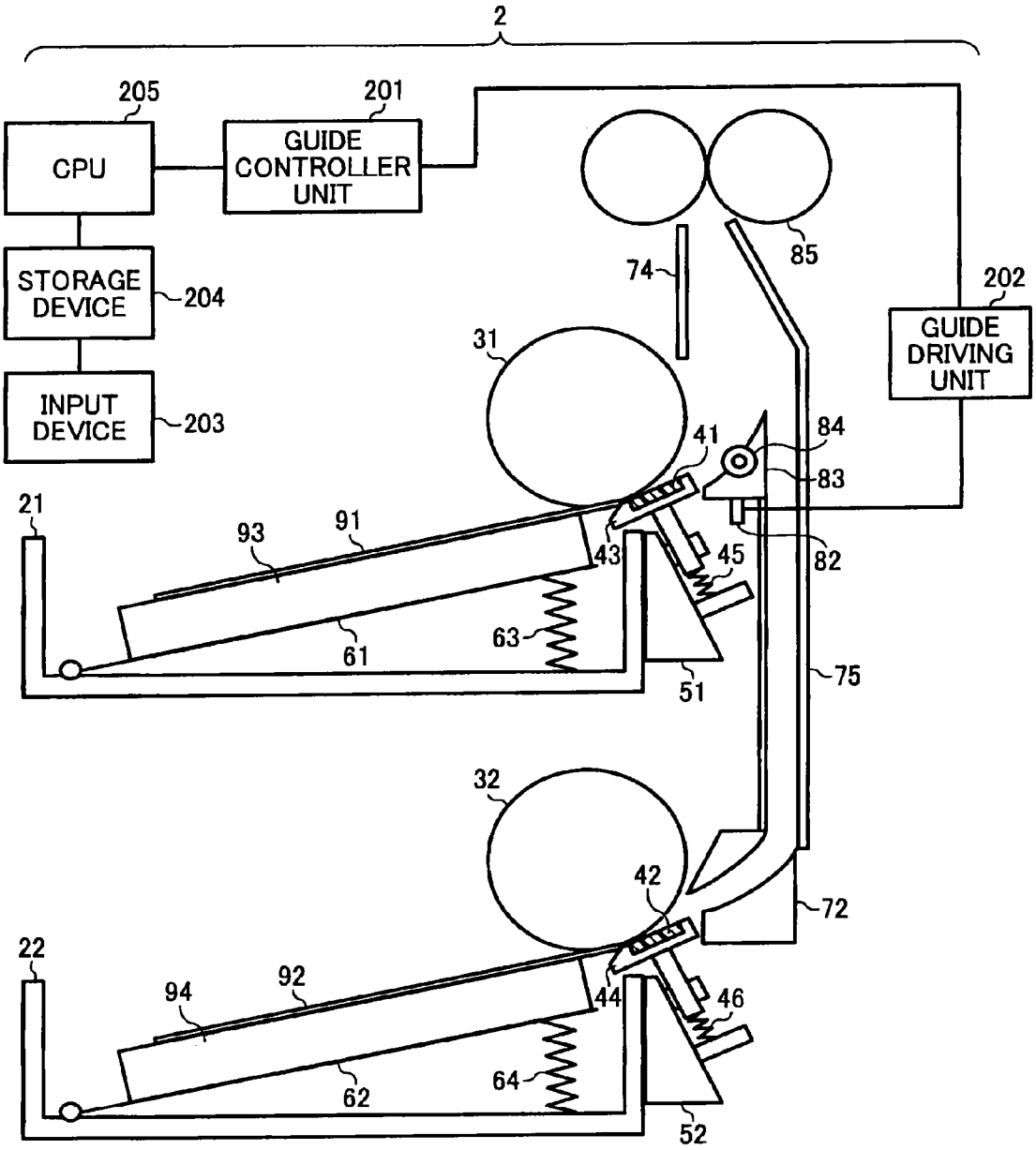
FIG. 12 is a longitudinal cross-sectional view illustrating an example of the sheet feeder of the image forming apparatus of the embodiment 6 described later.

Next, the sixth embodiment (embodiment 6) of the sheet feeder is described in detail with reference to FIGS. 12 and 13. FIG. 12 is a longitudinal cross-sectional view of an example of the sheet feeder of the image forming apparatus of the embodiment 6 and FIG. 13 is a longitudinal cross-sectional view illustrating an example of the sheet feeder of the image forming apparatus of the embodiment 6 in which the contact angle of the sheet and the sheet transfer guide becomes narrower.

Figure 13:
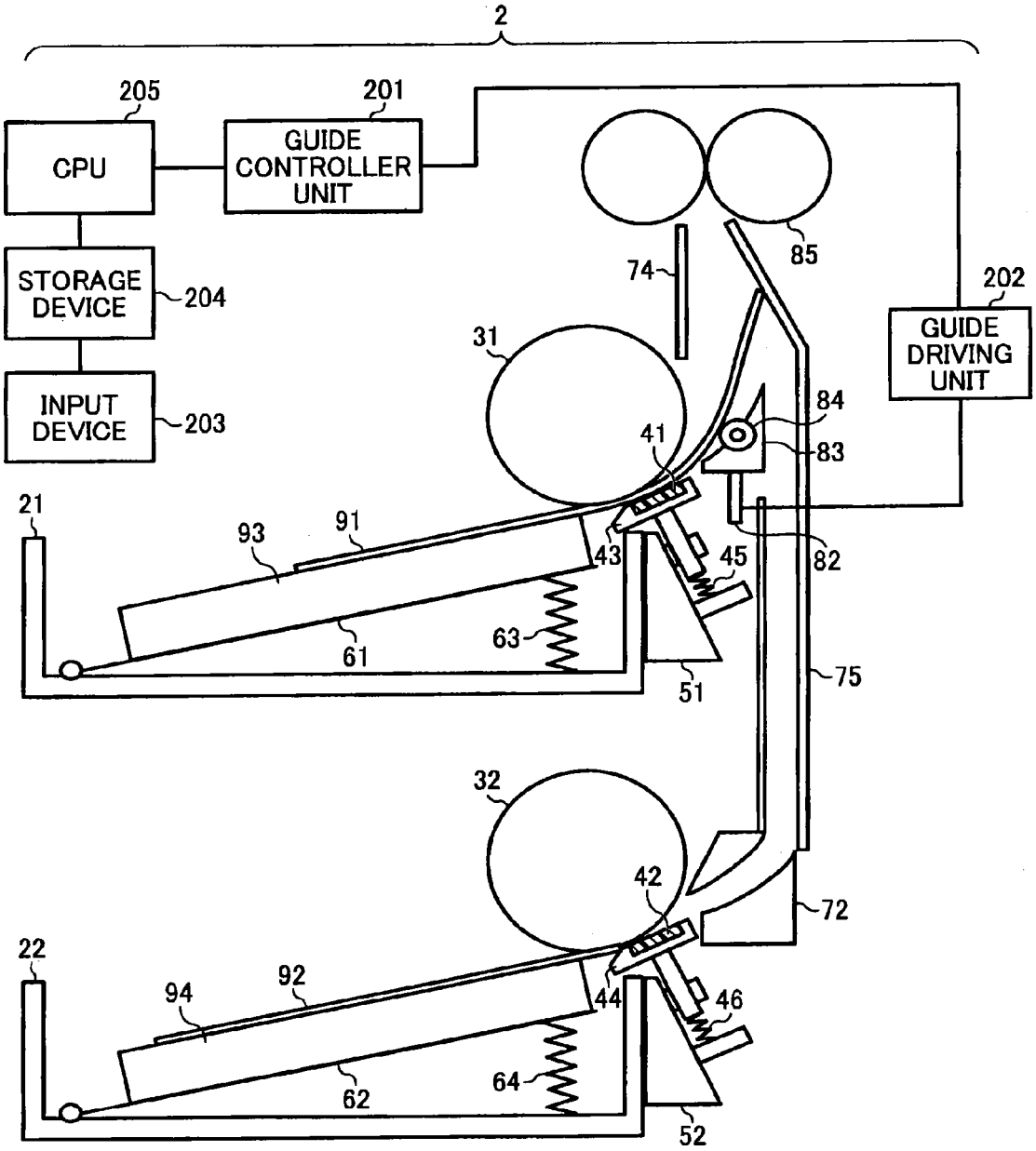
FIG. 13 is a diagram illustrating a longitudinal cross-sectional view illustrating an example of the sheet feeder of the image forming apparatus of the embodiment 6 described later in which the contact angle of the sheet and a movable guide becomes narrower.

Since FIGS. 12 and 13 are the same as FIGS. 10 and 11 in the fifth embodiment except that the input device 203, the storage device 204, and the CPU 205 of the third embodiment are used instead of the sheet thickness detector 100 of the fifth embodiment, the detailed description about FIGS. 12 and 13 is omitted. According to the sixth embodiment, a sheet feeder that stably feeds sheets without jamming or halting can be provided.

Figure 14:
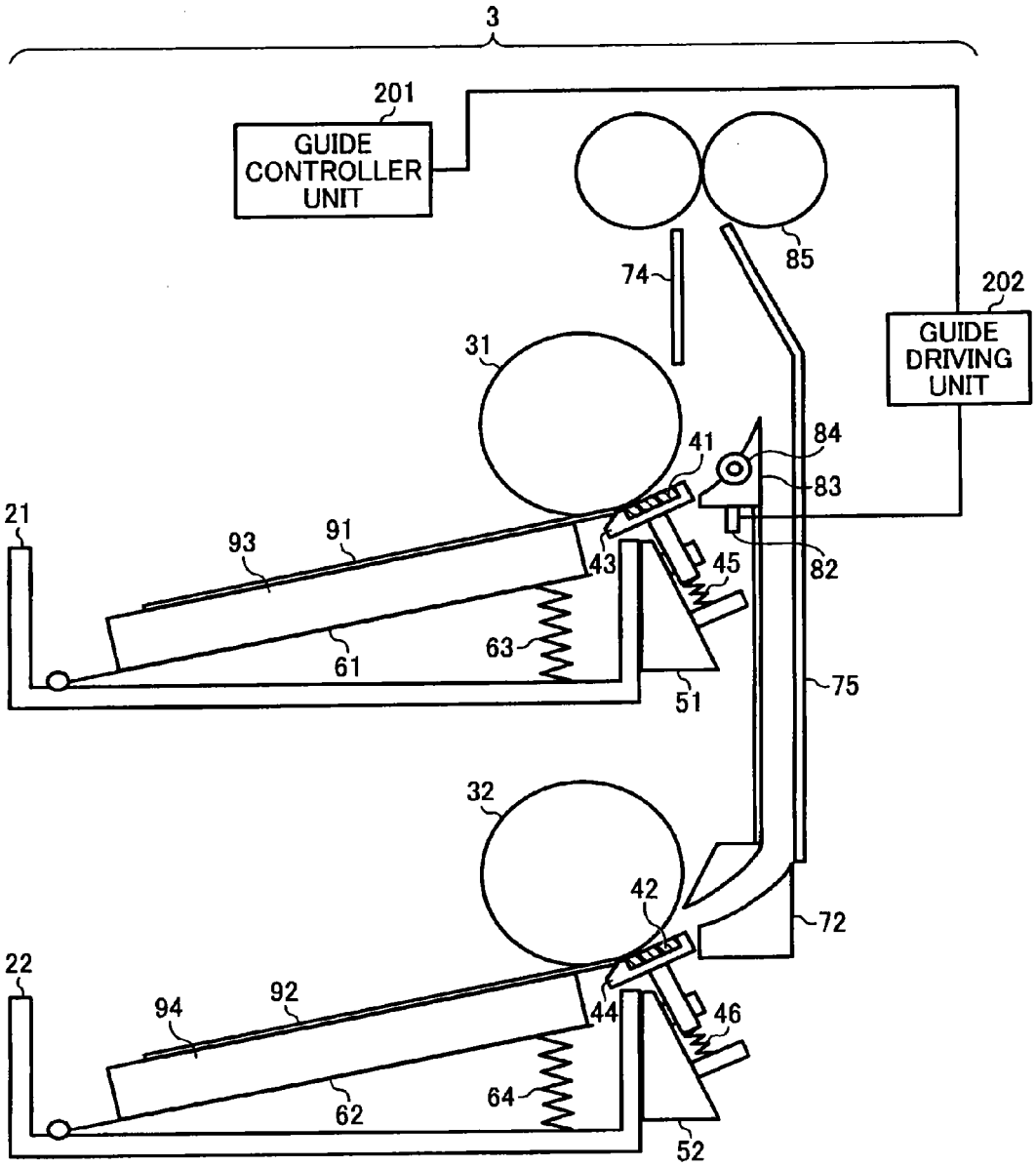
FIG. 14 is a longitudinal cross-sectional view illustrating an example of the sheet feeder of the image forming apparatus of the embodiment 7 described later.

Next, the seventh embodiment (embodiment 7) of the sheet feeder is described in detail with reference to FIGS. 14 and 15. FIG. 14 is a longitudinal cross-sectional view of an example of the sheet feeder of the image forming apparatus of the embodiment 7 and FIG. 15 is a longitudinal cross-sectional view illustrating an example of the sheet feeder of the image forming apparatus of the embodiment 7 in which the contact angle of the sheet and the sheet transfer guide becomes narrower.

Figure 15:
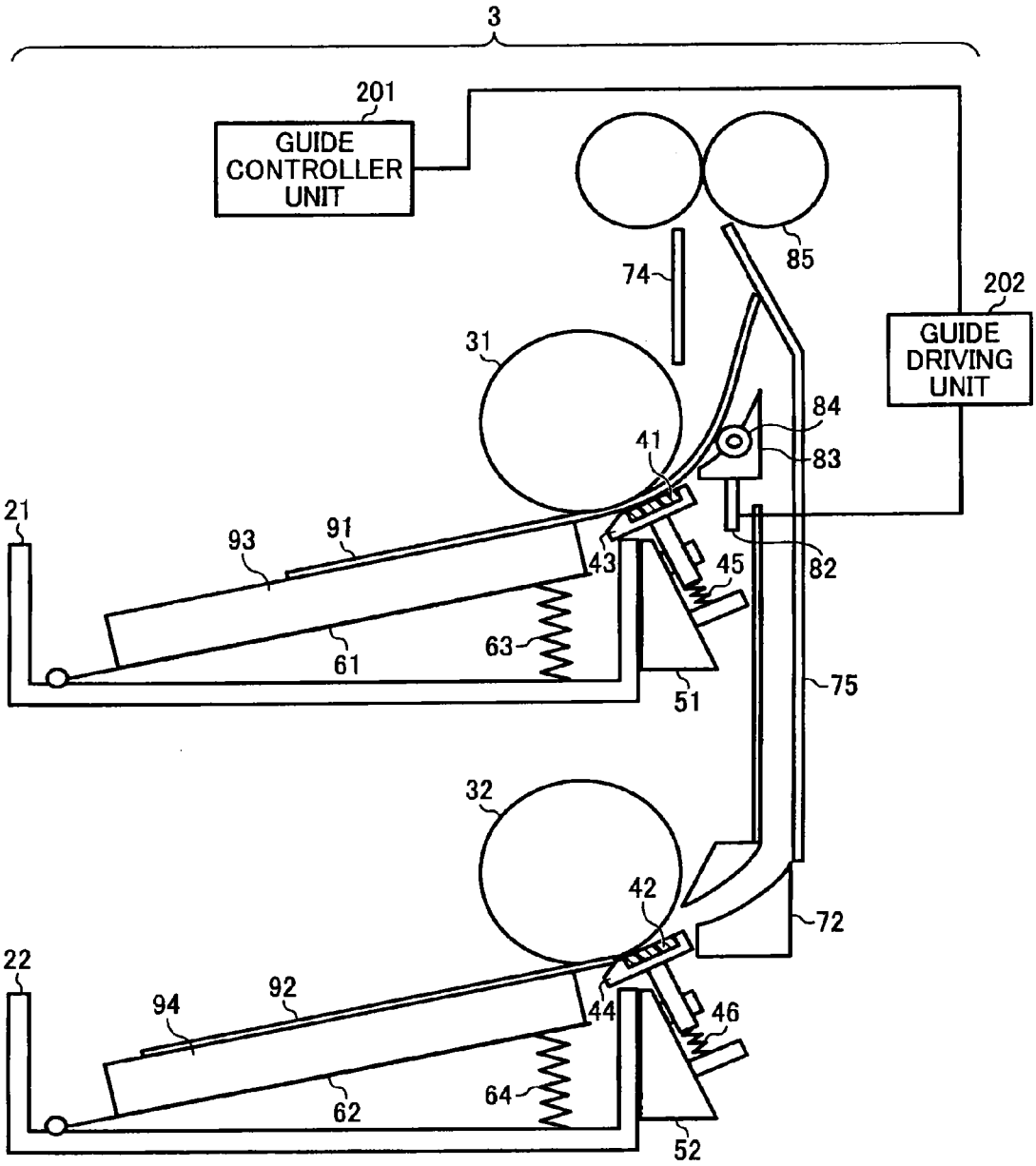
FIG. 15 is a diagram illustrating a longitudinal cross-sectional view illustrating an example of the sheet feeder of the image forming apparatus of the embodiment 7 described later in which the contact angle of the sheet and the movable guide becomes narrower.

Since FIGS. 14 and 15 are basically the same as FIGS. 8 and 9 in the fourth embodiment, the detailed description about FIGS. 14 and 15 is omitted. According to the seventh embodiment, a sheet feeder that stably feeds sheets without jamming can be provided.

Figure 16:
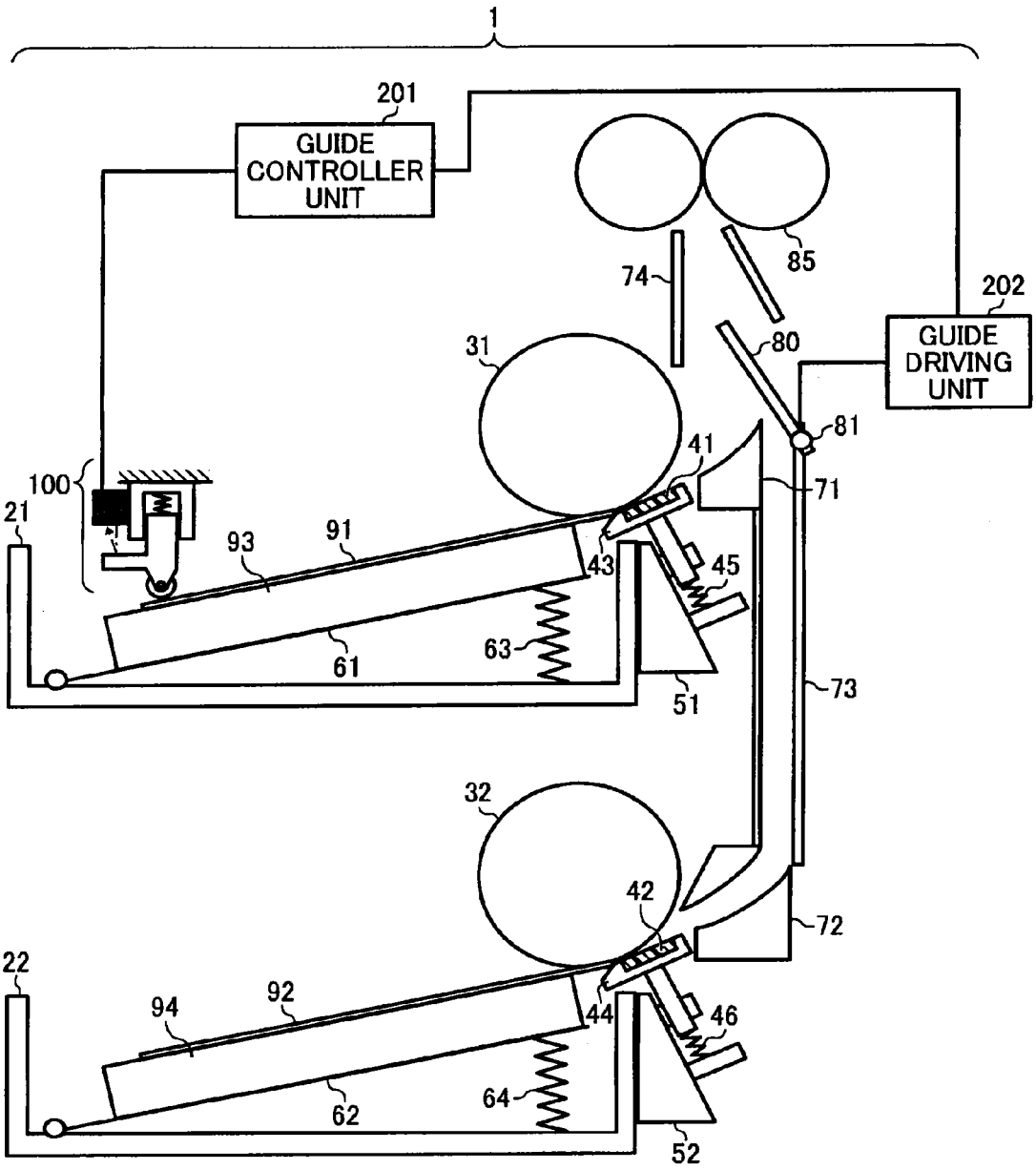
FIG. 16 is a longitudinal cross-sectional view illustrating an example of the sheet feeder of the image forming apparatus of the embodiment 8 described later.

Next, the eighth embodiment (embodiment 8) of the sheet feeder is described in detail with reference to FIGS. 16 and 17. FIG. 16 is a longitudinal cross-sectional view of an example of the sheet feeder of the image forming apparatus of the embodiment 8 and FIG. 17 is a longitudinal cross-sectional view illustrating an example of the sheet feeder of the image forming apparatus of the embodiment 8 in which the contact angle of the sheet and the movable guide becomes narrower.

Figure 17:
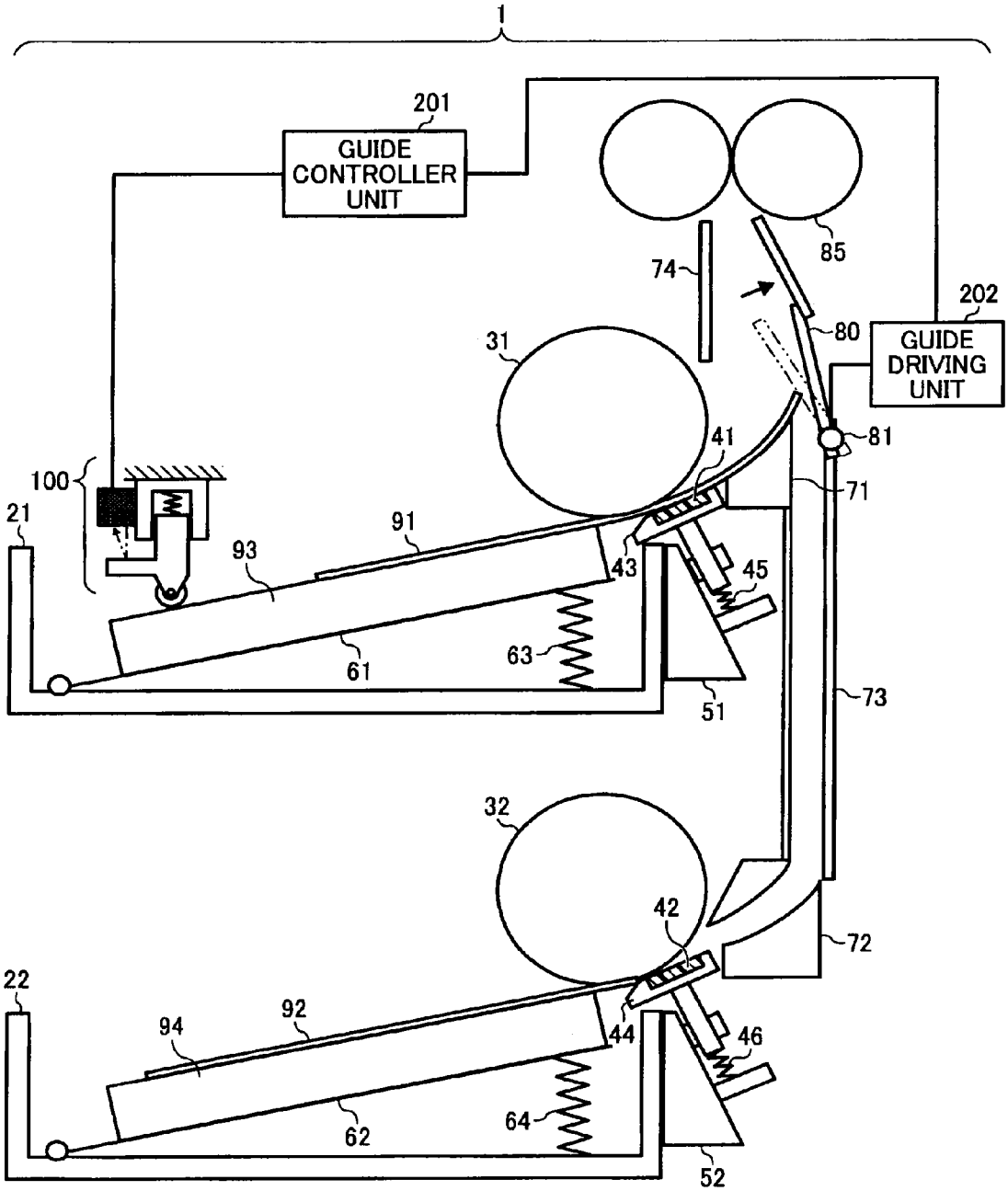
FIG. 17 is a diagram illustrating a longitudinal cross-sectional view illustrating an example of the sheet feeder of the image forming apparatus of the embodiment 8 described later in which the contact angle of the sheet and the movable guide becomes narrower.

FIGS. 16 and 17 are the same as FIGS. 1 and 2 of the first embodiment except that the movable guide 80 is different. The movable guide 80 is rotatably supported to the image forming apparatus by the rotation shaft 81, which is connected to the guide driving unit 202. The bottom part of the movable guide 80, which is upstream from the leading part relative to the transfer direction of sheets, is consecutively arranged from, for example, the sheet feeding guide 73 for the sheet feeding cassette 22 provided on the bottom in order not to interrupt the transfer of the sheet 92. There is a gap between the top part of the movable guide 80 (which is on the downstream side relative to the transfer direction of sheet) and the sheet feeding guide 74 located on the side of the feeder roller. Therefore, the sheet 91 advances along the guide 71, contacts the movable guide 80, follows the curve thereof, and passes through the gap between the movable guide 80 and the sheet feeding guide 74.

In addition, the sheet 92 transferred from the sheet feeding cassette 22 situated on the bottom advances along the sheet feeding guide 73, moves between the movable guide 80 and the guide 71, and passes through the gap between movable guide 80 and the sheet feeding guide 74. When the sheet 91 is conveyed, the guide controller unit 201 determines the movement of the movable guide 80 based on the thickness information of the sheet 91 read by the sheet thickness detector 100 and the guide driving unit 202 moves the movable guide 80.

As a result, the movable guide 80 rotates clockwise as illustrated in FIG. 17, narrowing the contact angle between the leading end of the sheet 91 and the movable guide 80. Consequently, the contact resistance between the leading end of the sheet 91 and the movable guide 80 decreases so that the sheet 91 is transferred to the movable guide 80 without jamming or halting. After the sheet 91 has passed through the movable guide 80, the movable guide 80 is returned to the original position by the guide driving unit 202.

According to the eighth embodiment, a sheet feeder that stably feeds sheets without jamming or halting can be provided. The movement of the movable guide 80 is constant against the thickness of the sheet 91 or changeable to, for example, the elapse time of the sheet transfer or the position of the sheet 91 to gradually rotate the movable guide 80 clockwise in FIG. 16 to the sheet transfer process. For example, a guide controller unit having a sheet transfer detector is provided in the middle of the sheet transfer path to measure the elapse time of the sheet transfer or detect the position of the sheet 91 when the feeder (transfer) roller starts transferring the sheet 91.

Figure 18:
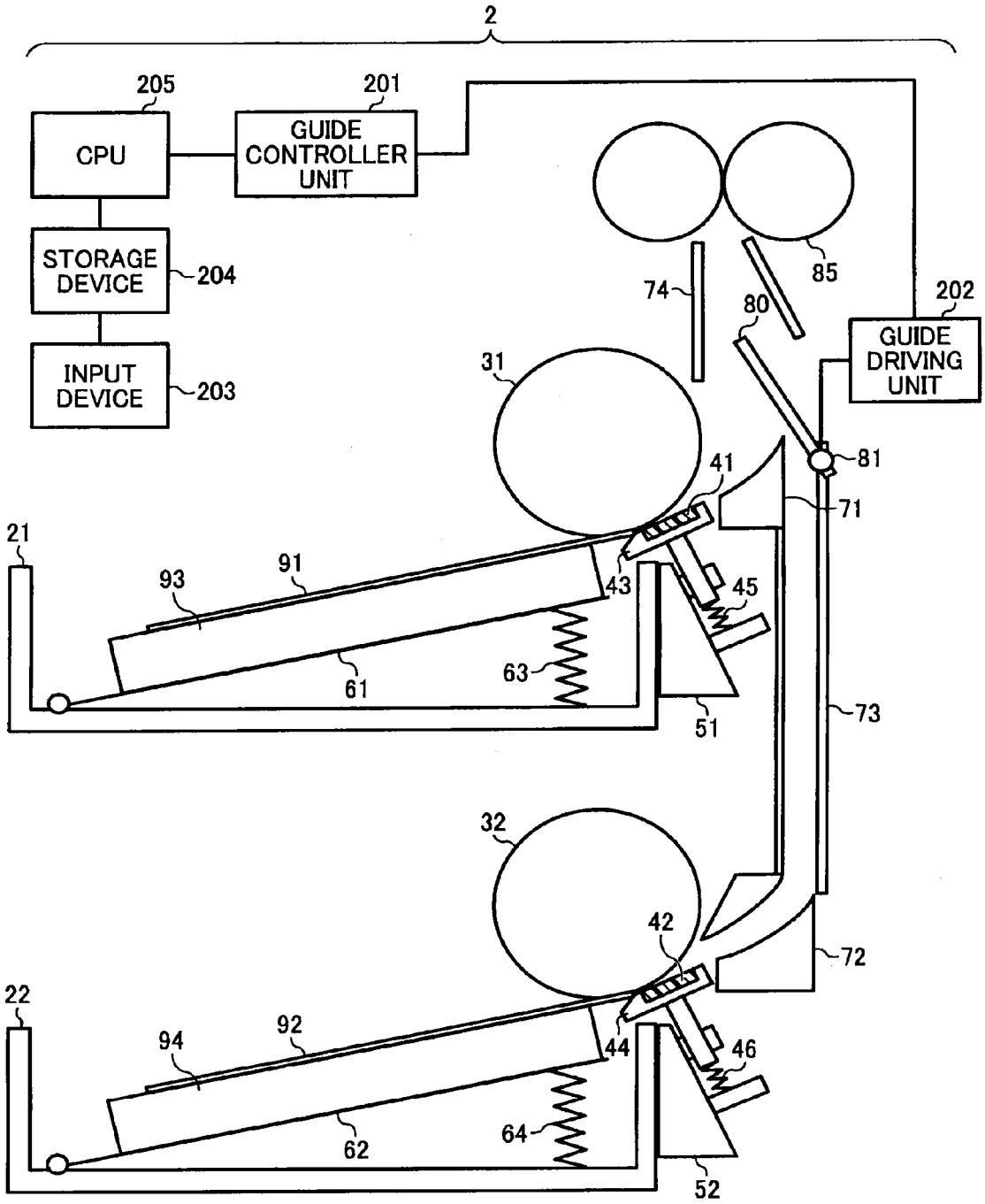
FIG. 18 is a longitudinal cross-sectional view illustrating an example of the sheet feeder of the image forming apparatus of the embodiment 9 described later.

Next, the ninth embodiment (embodiment 9) of the sheet feeder is described in detail with reference to FIGS. 18 and 19. FIG. 18 is a longitudinal cross-sectional view of an example of the sheet feeder of the image forming apparatus of the embodiment 9 and FIG. 19 is a longitudinal cross-sectional view illustrating an example of the sheet feeder of the image forming apparatus of the embodiment 9 in which the contact angle of the sheet and the movable guide makes an acuter angle.

Figure 19:
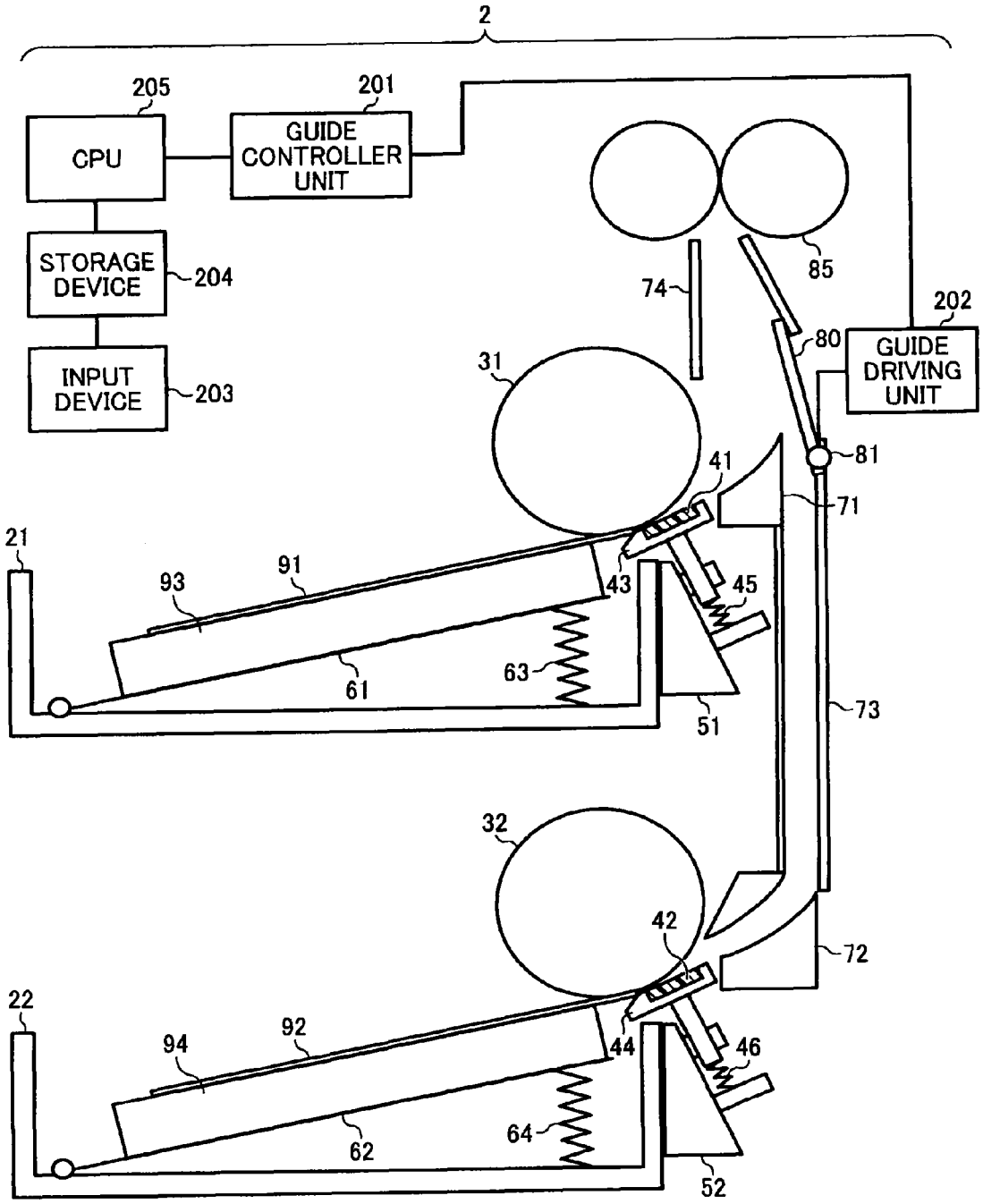
FIG. 19 is a diagram illustrating a longitudinal cross-sectional view illustrating an example of the sheet feeder of the image forming apparatus of the embodiment 9 described later in which the contact angle of the sheet and the movable guide becomes narrower.

FIGS. 18 and 19 are basically the same as FIGS. 12 and 13 in the sixth embodiment except that the form of the movable guide 80 is different and the movement of the movable guide 80 is rotation or up-and-down movement. Since the basic operation is the same, the detailed description about FIGS. 18 and 19 is omitted. According to the ninth embodiment, a sheet feeder that stably feeds sheets without jamming or halting can be provided.

The movement of the movable guide 80 is constant against the thickness of sheet or changeable to the elapse time of the sheet transfer or the position of the sheet 91 to gradually rotate the movable guide 80 clockwise in FIG. 18 to the sheet transfer process. For example, a guide controller unit having a sheet transfer detector is provided in the middle of the sheet transfer path to measure the elapse time of the sheet transfer or detect the position of the sheet 91 when the feeder (transfer) roller starts transferring the sheet 91.

Figure 20:
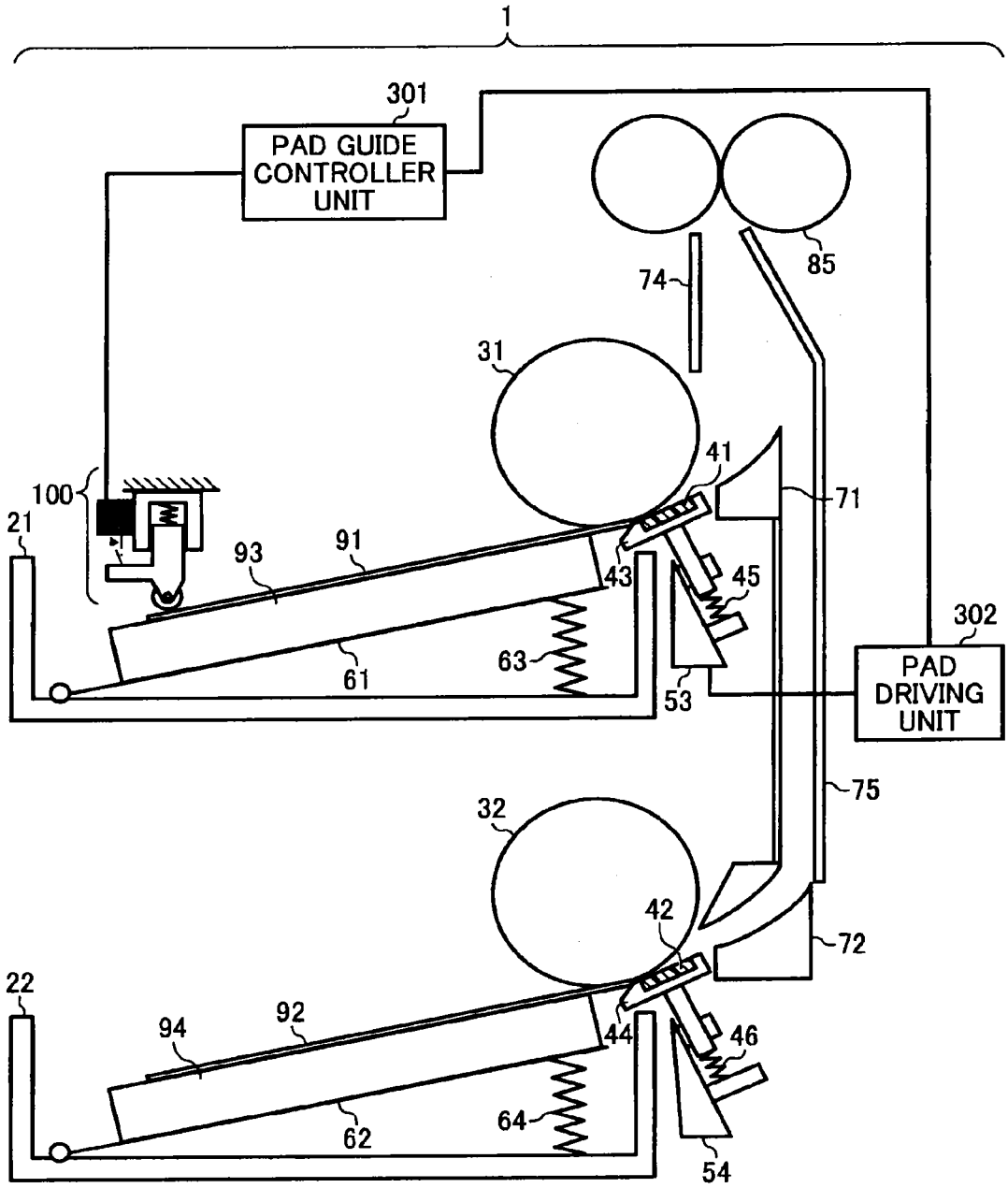
FIG. 20 is a longitudinal cross-sectional view illustrating an example of the sheet feeder of the image forming apparatus of the embodiment 10 described later.
Figure 21:
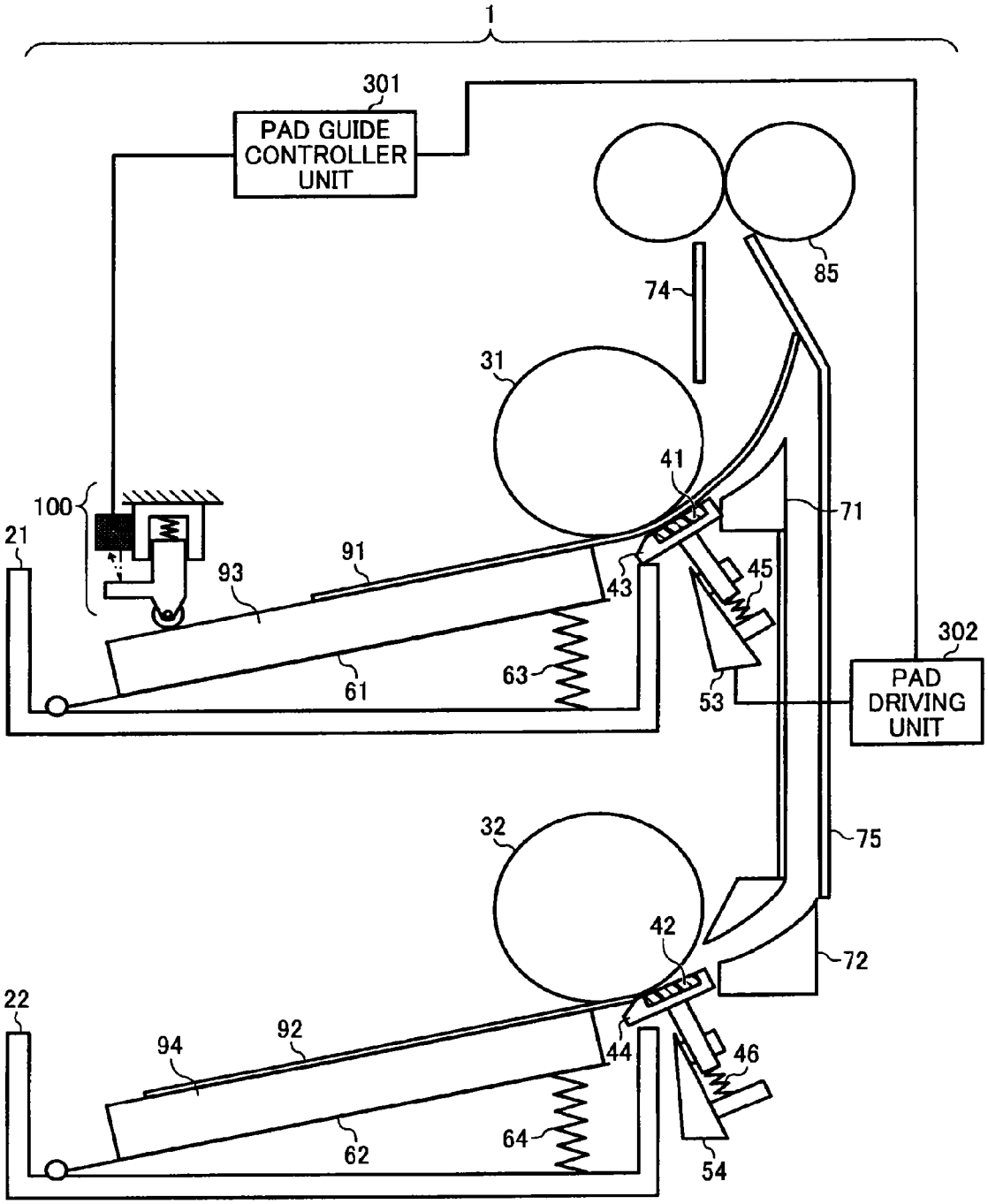
FIG. 21 is a diagram illustrating a longitudinal cross-sectional view illustrating an example of the sheet feeder of the image forming apparatus of the embodiment 10 described later in which the contact angle of the sheet and the movable guide becomes narrower.

Next, the tenth embodiment (embodiment 10) of the sheet feeder is described in detail with reference to FIGS. 20 and 21. FIG. 20 is a longitudinal cross-sectional view of an example of the sheet feeder of the image forming apparatus of the embodiment 10 and FIG. 21 is a longitudinal cross-sectional view illustrating an example of the sheet feeder of the image forming apparatus of the embodiment 10 in which the contact angle of the sheet and the sheet transfer guide becomes narrower.

The sheet feeding cassette 21 has the sheet thickness detector 100 to detect the thickness of the sheet 91 placed at the top of the bundle of sheets 93. In addition, the sheet feeder 1 has a pad guide controller unit 301 that receives information about the thickness of the sheet from the sheet thickness detector 100 and generates signals to drive a pad seating 53 together with a pad 43 and a pad driving unit 302 to drive the pad seating 53 based on the signals from the pad guide controller unit 301. The pad driving unit 302 is, for example, a stepping motor.

As illustrated in FIG. 20, the sheet thickness detector 100 is installed on the upstream portion of the sheet 91 placed upmost relative to the sheet transfer direction. The sheet thickness detector 100 is identical to that illustrated in FIG. 5 in the second embodiment and the description thereof is omitted. The pad seating 53 is rotatably supported to the image forming apparatus by the rotation shaft, which is connected to the pad driving unit 302.

When the sheet 91 is conveyed, the pad guide controller unit 301 determines the movement of the pad seating 53 based on the thickness information of the sheet 91 read by the sheet thickness detector 100 and the pad driving unit 302 moves the pad seating 53 together with the pad 43. As a result, the pad 43 rotates counterclockwise as illustrated in FIG. 21, narrowing the contact angle between the leading end of the sheet 91 and the sheet feeding guide 75. Consequently, the contact resistance between the leading end of the sheet 91 and the sheet feeding guide 75 decreases so that the sheet 91 is transferred to the sheet feeding guide 75 without jamming or halting. After the sheet 91 has passed through the pad seating 53, the pad seating 53 is returned to the original position.

According to the tenth embodiment, a sheet feeder that stably feeds sheets without jamming or halting can be provided. The movement of the pad seating 53 and the pad 43 is constant against the thickness of sheet or changeable to the elapse time of the sheet transfer or the position of the sheet 91 to gradually rotate counterclockwise in FIG. 20 to the sheet transfer process. In addition, the sheet thickness detector 100 is not limited to the structure or form described in the tenth embodiment. Any detector that can detect the thickness of the sheet 91 before the sheet 91 contacts the sheet feeding guide 75 can be suitably used.

For example, a pad guide controller unit having a sheet transfer detector is provided in the middle of the sheet transfer path to measure the elapse time of the sheet transfer or detect the position of the sheet 91 when the feeder (transfer) roller starts transferring the sheet 91.

In the tenth embodiment, the structure having the pad seating 53 provided on the top is described. It is naturally suitable to have a structure to drive a pad seating 54 provided on the bottom. In such a case, the sheet feeder 1 has a sheet thickness detector to detect the thickness of the sheet 92, a pad driving unit to drive the pad seating 54 provided on the bottom, and a pad guide controller unit to transmit signals to the pad driving unit. The same is true to eleventh embodiment (embodiment 11) described next.

Figure 22:
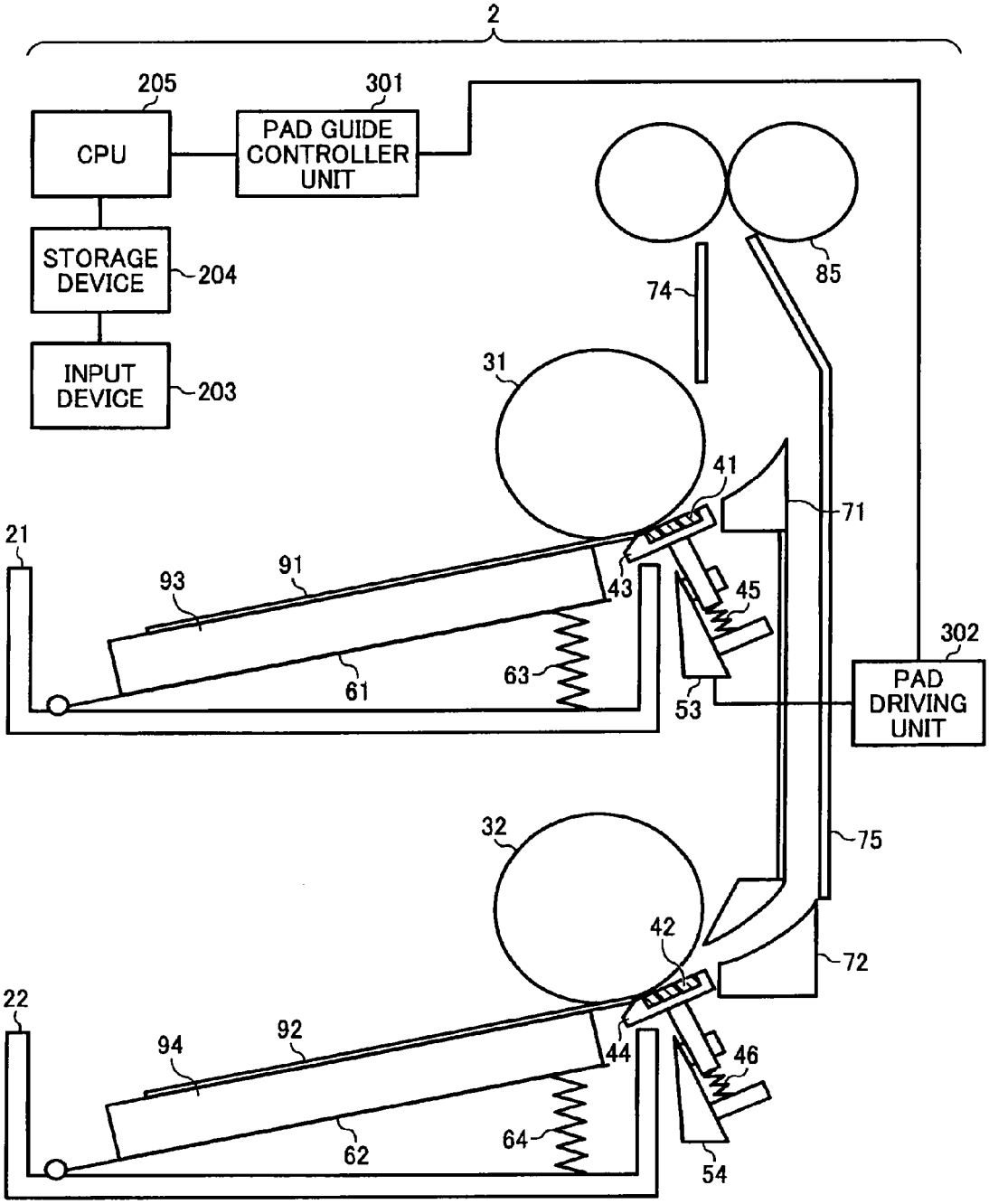
FIG. 22 is a longitudinal cross-sectional view illustrating an example of the sheet feeder of the image forming apparatus of the embodiment 11 described later.
Figure 23:
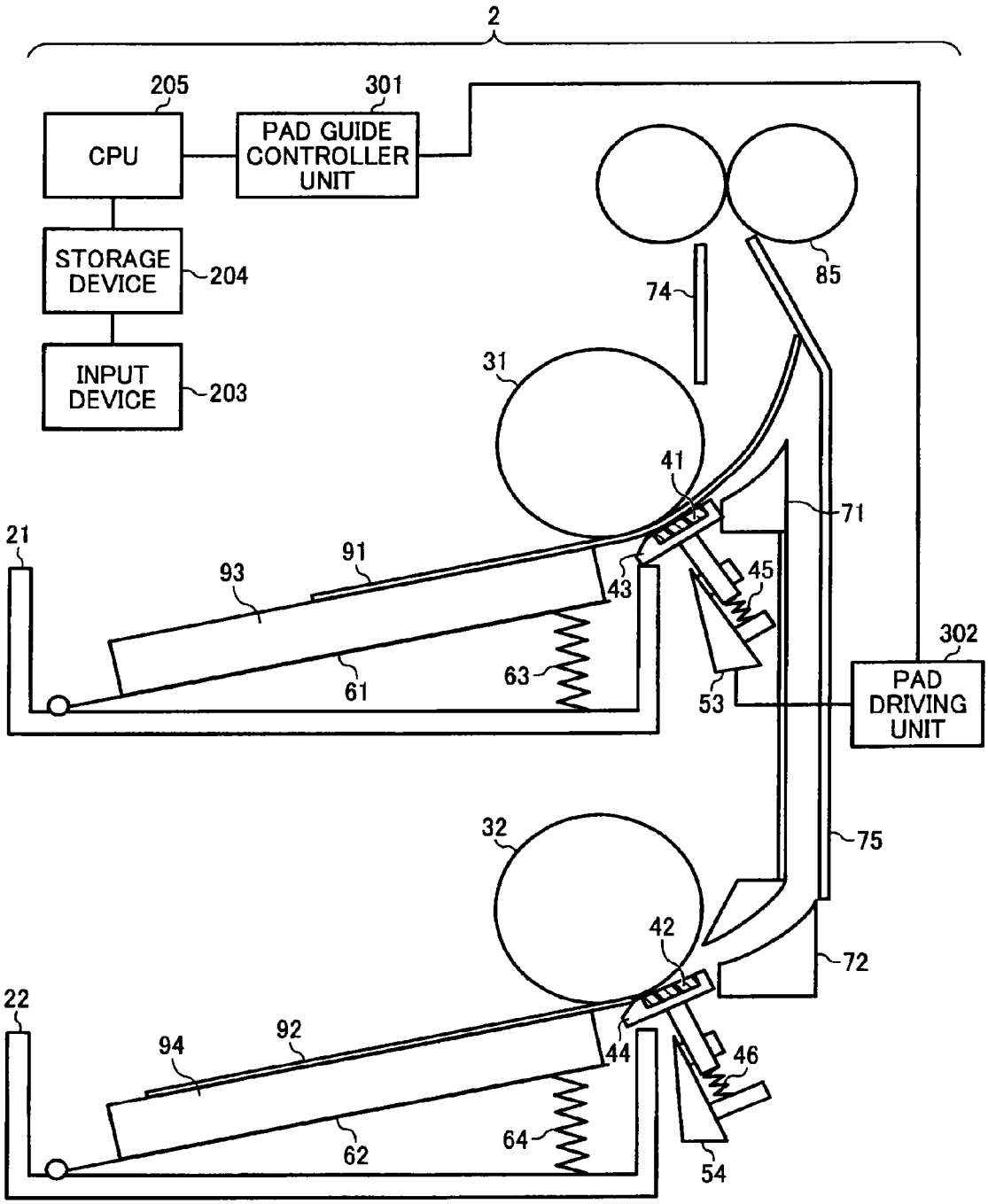
FIG. 23 is a diagram illustrating a longitudinal cross-sectional view illustrating an example of the sheet feeder of the image forming apparatus of the embodiment 11 described later in which the contact angle of the sheet and the movable guide becomes narrower.

Next, the eleventh embodiment (embodiment 11) of the sheet feeder is described in detail with reference to FIGS. 22 and 23. FIG. 22 is a longitudinal cross-sectional view of an example of the sheet feeder of the image forming apparatus of the embodiment 11 and FIG. 23 is a longitudinal cross-sectional view illustrating an example of the sheet feeder of the image forming apparatus of the embodiment 11 in which the contact angle of the sheet and the sheet transfer guide becomes narrower.

With regard to the sheet feeder 21, property information about the sheet such as the kind, thickness, or elasticity (bending rigidity) is input or selected from the input device 203. The input information about the sheet is sequentially stored in the storage device 204. The CPU 205 controls the property information in the storage device 204. The CPU 205 transmits the property information about the next sheet 91 to the pad guide controller unit 301. Based on the transmitted information about the sheet 91, the pad guide controller unit 301 determines the movement of the pad seating 53 and the pad driving unit 302 moves the pad seating 53. As a result, the pad seating 53 rotates together with the pad 43 counterclockwise as illustrated in FIG. 23, narrowing the contact angle between the leading end of the sheet 91 and the sheet feeding guide 75.

Consequently, the contact resistance between the leading end of the sheet 91 and the sheet feeding guide 75 decreases so that the sheet 91 is transferred to the sheet feeding guide 75 without jamming or halting. After the sheet 91 has passed through, the pad seating 53 is returned to the original position. The property information with regard to the sheet finished with feeding is deleted from the storage device 204 by the CPU 205.

According to the eleventh embodiment, a sheet feeder that stably feeds sheets without jamming or halting can be provided. The movement of the pad seating 53 and the pad 43 is constant against the thickness of sheet or changeable to the elapse time of the sheet transfer or the position of the sheet 91 to gradually rotate counterclockwise in FIG. 22 to the sheet transfer process.

For example, a pad guide controller unit having a sheet transfer detector is provided in the middle of the sheet transfer path to measure the elapse time of the sheet transfer or detect the position of the sheet 91 when the feeder (transfer) roller starts transferring the sheet 91.

Figure 24:
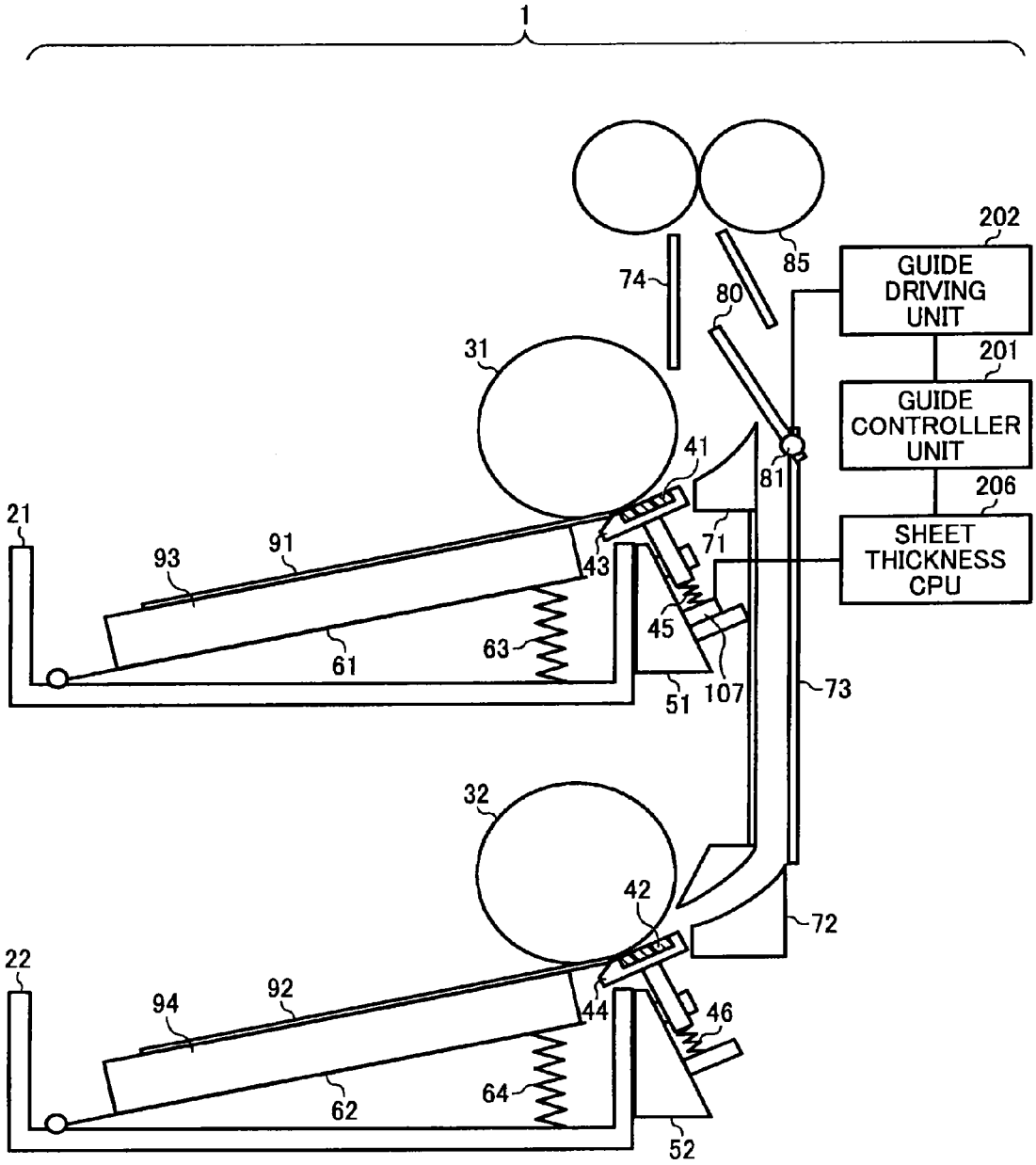
FIG. 24 is a longitudinal cross-sectional view illustrating an example of the sheet feeder of the image forming apparatus of the embodiment 12 described later.
Figure 25:
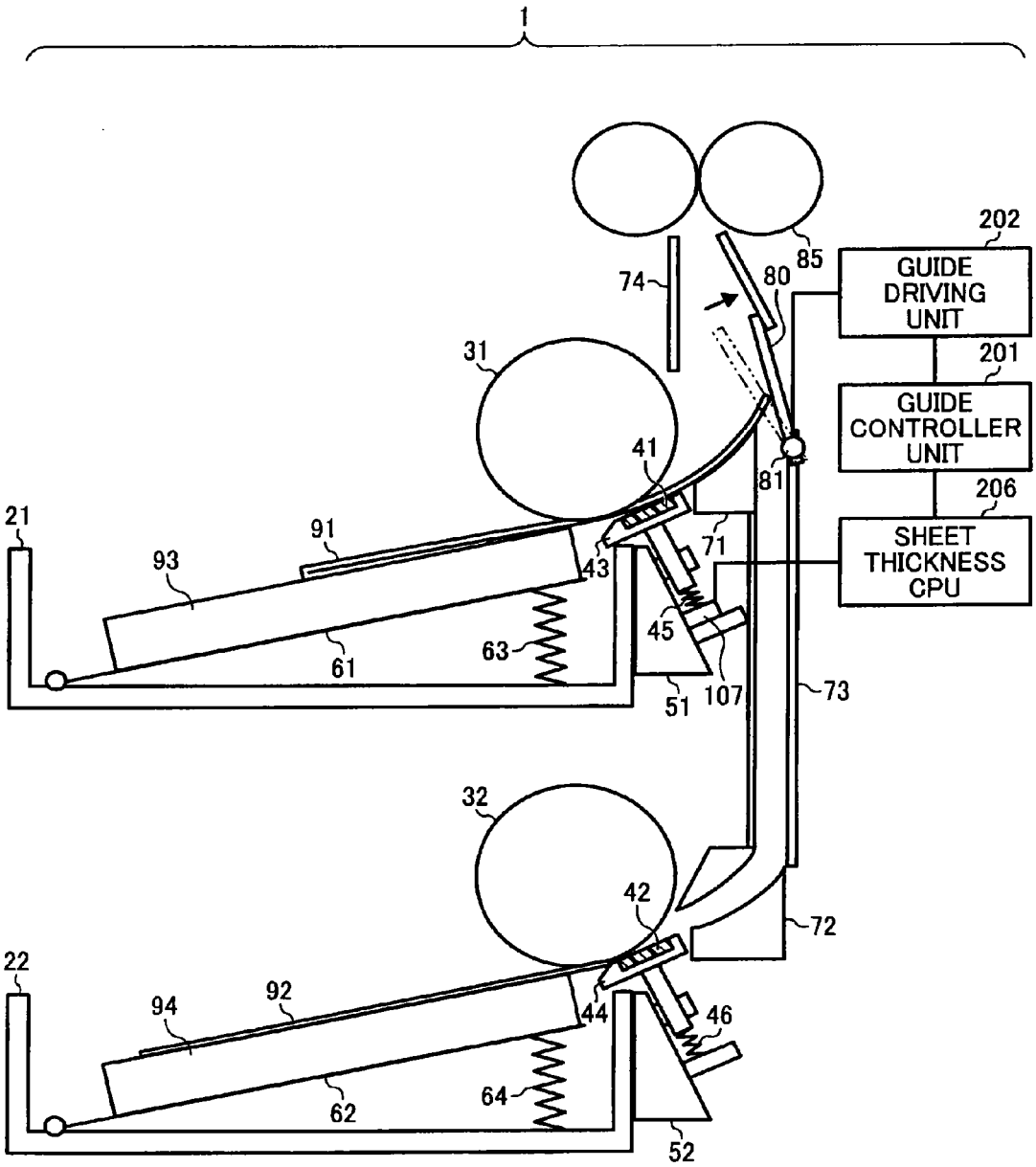
FIG. 25 is a diagram illustrating a longitudinal cross-sectional view illustrating an example of the sheet feeder of the image forming apparatus of the embodiment 12 described later in which the contact angle of the sheet and the movable guide becomes narrower.

Next, the twelfth embodiment (embodiment 12) of the sheet feeder is described in detail with reference to FIGS. 24 and 25. FIG. 24 is a longitudinal cross-sectional view of an example of the sheet feeder of the image forming apparatus of the embodiment 12 and FIG. 25 is a longitudinal cross-sectional view illustrating an example of the sheet feeder of the image forming apparatus of the embodiment 12 in which the contact angle of the sheet and the movable guide becomes narrower.

In the sheet feeder 1, the feeding rollers 31 and 32 are rotatably supported to an image forming apparatus such as a photocopier and the friction pads 41 and 42 that are pressed against the feeding rollers 31 and 32, respectively are supported at the upper parts of the pad 43 and 44. The friction pads 41 and 42 are frictional members made of resins, corks, etc.

The pad 43 and 44 are linked with the sheet feeding cassettes 21 and 22 by the pad seatings 51 and 52, respectively. To press the pads 43 and 44 against the feeding rollers 31 and 32, pad biasing members 45 and 46 such as coil springs are inserted between the pads 43 and 44 and the pad seatings 51 and 52 to provide the pad pressure serving as a contact pressure by the elastic forces of the pad biasing members 45 and 46.

In the sheet feeding cassettes 21 and 22, the base plates 61 and 62 movable up and down by the base plate biasing members 63 and 64 such as coil springs are provided and the bundles of sheets 93 and 94 are placed on the base plates 61 and 62. The sheets 91 and 92 placed uppermost of the bundles are pressed against the feeding rollers 31 and 32 by the elastic force of the base plate biasing members 63 and 64.

When the feeding rollers 31 and 32 rotate counterclockwise in FIG. 24, the sheets 91 and 92 receive the friction force from the feeding rollers 31 and 32 and advances between the feeding rollers 31 and 32 and the friction pads 41 and 42. When multiple sheets advances between the feeding rollers 31 and 32 and the friction pads 41 and 42 at the same time, the sheets are separated by the difference in the friction force caused by each friction index and only a single sheet is fed into the image forming apparatus.

The pad seating 53 has a pad pressure detector 107. The pad pressure detector 107 is, for example, a load cell. The pad pressure detector 107 measures the pad pressure which is a force applied to the friction pad 41 toward the side of the feeding roller 31. The pad pressure information detected by the pad pressure detector 107 is sent to a sheet thickness CPU 206 as electric signals.

The sheet thickness CPU 206 determines whether the sheet 91 has advanced between the feeding roller 31 and the friction pad 41 based on the pad pressure information sent from the pad pressure detector 107. When the sheet thickness CPU 206 determines the sheet 91 has advanced between the feeding roller 31 and the friction pad 41, it calculates the thickness of the sheet 91.

An example of the method of calculating the thickness of a sheet is described. First, the output of the pad pressure detector 107 is A (N) when no sheet is present between the feeding roller 31 and the friction pad 41. The constant of spring of the pad biasing members 45 that biases the friction pad 41 towards the direction of the feeding roller 31 is K (N/m). When the output of the pad pressure detector 107 is B (N) at a certain point of time, C (m), which is obtained by the relationship $C=(B-A)/K$, is determined as the thickness of the sheet 91 lying between the feeding roller 31 and the friction pad 41.

The sheet feeder 1 has the guide controller unit 201 that receives the sheet information containing the thickness calculated by the sheet thickness CPU 206 from the sheet thickness CPU 206 and generates signals to drive the movable guide 80 and the guide driving unit 202 to drive the movable guide 80 based on the signals from the guide controller unit 201. The guide driving unit 202 is, for example, a stepping motor.

The guide controller unit 201 determines the tilting angle of the movable guide 80 based on the thickness information sent from the sheet thickness CPU 206 and transmits a signal, for example, a pulse signal to the guide driving unit 202 to move the guide driving unit 202. The movable guide 80 is rotatably supported to the image forming apparatus by the rotation shaft 81, which is connected to the guide driving unit 202. The bottom part of the movable guide 80, which is the upstream side relative to the sheet transfer direction, is arranged continuously from the sheet feeding guide 73 from the sheet feeding cassette 22 provided on the bottom.

There is a gap between the top part of the movable guide 80 (which is the downstream side relative to the transfer direction of sheet) and the sheet feeding guide 74 on the side of the feeding roller 31. Therefore, the sheet 91 advances along the guide 71, contacts the movable guide 80, follows the curve thereof, and passes through the gap between the movable guide 80 and the sheet feeding guide 74. In addition, the sheet 92 transferred from the sheet feeding cassette 22 situated on the bottom advances along the sheet feeding guide 73, moves between the movable guide 80 and the guide 71 along the movable guide 80, and passes through the gap between movable guide 80 and the sheet feeding guide 74.

When the sheet 91 is conveyed, the guide controller unit 201 determines the movement of the movable guide 80 based on the thickness information of the sheet 91 calculated by the sheet thickness CPU 206 and the guide driving unit 202 moves the movable guide 80. As a result, the rotation shaft 81 rotates clockwise and the movable guide 80 moves in the direction indicated by the arrow in FIG. 25, narrowing the contact angle between the leading end of the sheet 91 and the movable guide 80. Consequently, the contact resistance between the leading end of the sheet 91 and the movable guide 80 decreases so that the sheet 91 is transferred to the movable guide 80 without jamming or halting. After the sheet 91 has passed through the movable guide 80, the movable guide 80 is returned to the original position by the guide driving unit 202.

When the pad pressure of the pad 43 returns to the value A, which is the value obtained before the sheet 91 advances between the feeding roller 31 and the friction pad 41, the sheet 91 is determined to have completely passed between the feeding roller 31 and the friction pad 41. For example, a guide controller unit having a sheet transfer detector is provided in the middle of the sheet transfer path to measure the elapse time of the sheet transfer or detect the position of the sheet 91 when the feeder (transfer) roller starts transferring the sheet 91. In addition, it is possible to provide another mechanism in which the position of the sheet 91 is transmitted to the guiding device after the sheet thickness CPU 206 detects whether the sheet is transferred based on the pad pressure detected by the pad pressure detector 107.

Therefore, according to the embodiment 12, the thickness of the sheet 91 can be securely detected at the position of the friction pad 41 before the leading end of the sheet 91 contacts the sheet feeding guide 73. As result, since the rotation shaft 81 rotates before the leading end of the sheet 91 contacts the movable guide 80, the angle of the movable guide 80 can be adjusted to make an acuter contact angle of the leading end of the sheet and the movable guide 80, thereby reducing the transfer resistance of the movable guide 80 to the leading end of the sheet. Therefore, a sheet feeder that stably feeds sheets without jamming or halting can be provided.

In addition, with regard to the thickness C of the sheet mentioned above calculated from the detected pad pressure, for example, when the pad pressure is equal to or less than a certain threshold D, that is, when C< or =D, it is determined that there is no sheet 91 passing between the feeding roller 31 and the friction pad 41 and the friction pad 41 and when the pad pressure is greater than the certain threshold D, that is, when C>D, it is determined that there is a sheet 91 passing between the feeding roller 31 and the friction pad 41. Thereby, the fluctuation of the pad pressure caused by the vibration of the pad 43 is not mistaken as passing of the sheet.

Moreover, the pad pressure detector 107 is not limited to the structure or form described in this embodiment. Any detector that can detect the pad pressure of the pad 43 can be suitably used. Furthermore, in the case in which not the thickness the sheet 91 but only detection of passing of the sheet 91 is required, when the pad pressure of the pad 43 changes or surpasses a certain threshold, it is suitable to determine that there is a sheet 91 passing between the feeding roller 31 and the friction pad 41.

Figure 26:
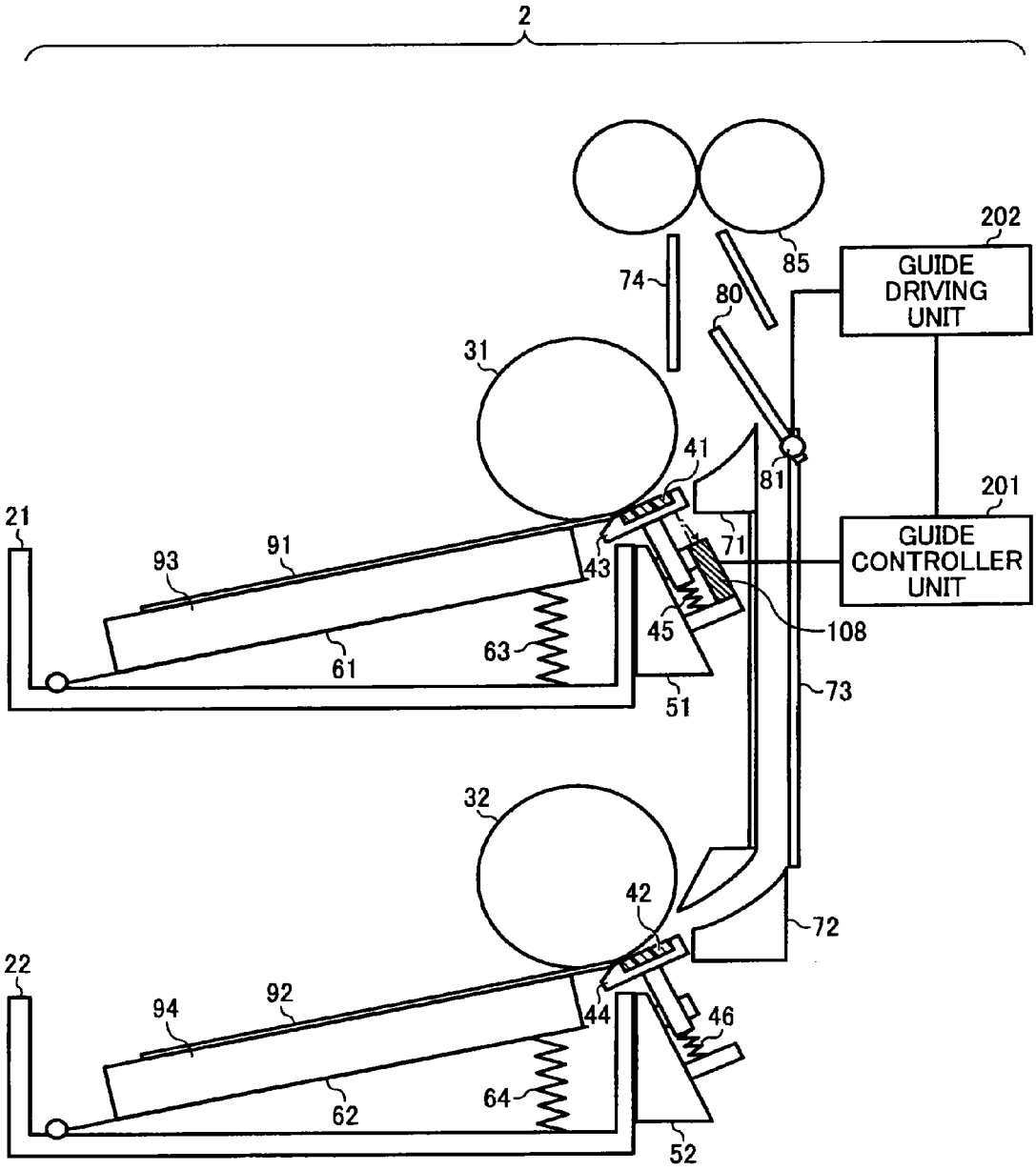
FIG. 26 is a longitudinal cross-sectional view illustrating an example of the sheet feeder of the image forming apparatus of the embodiment 13 described later.
Figure 27:
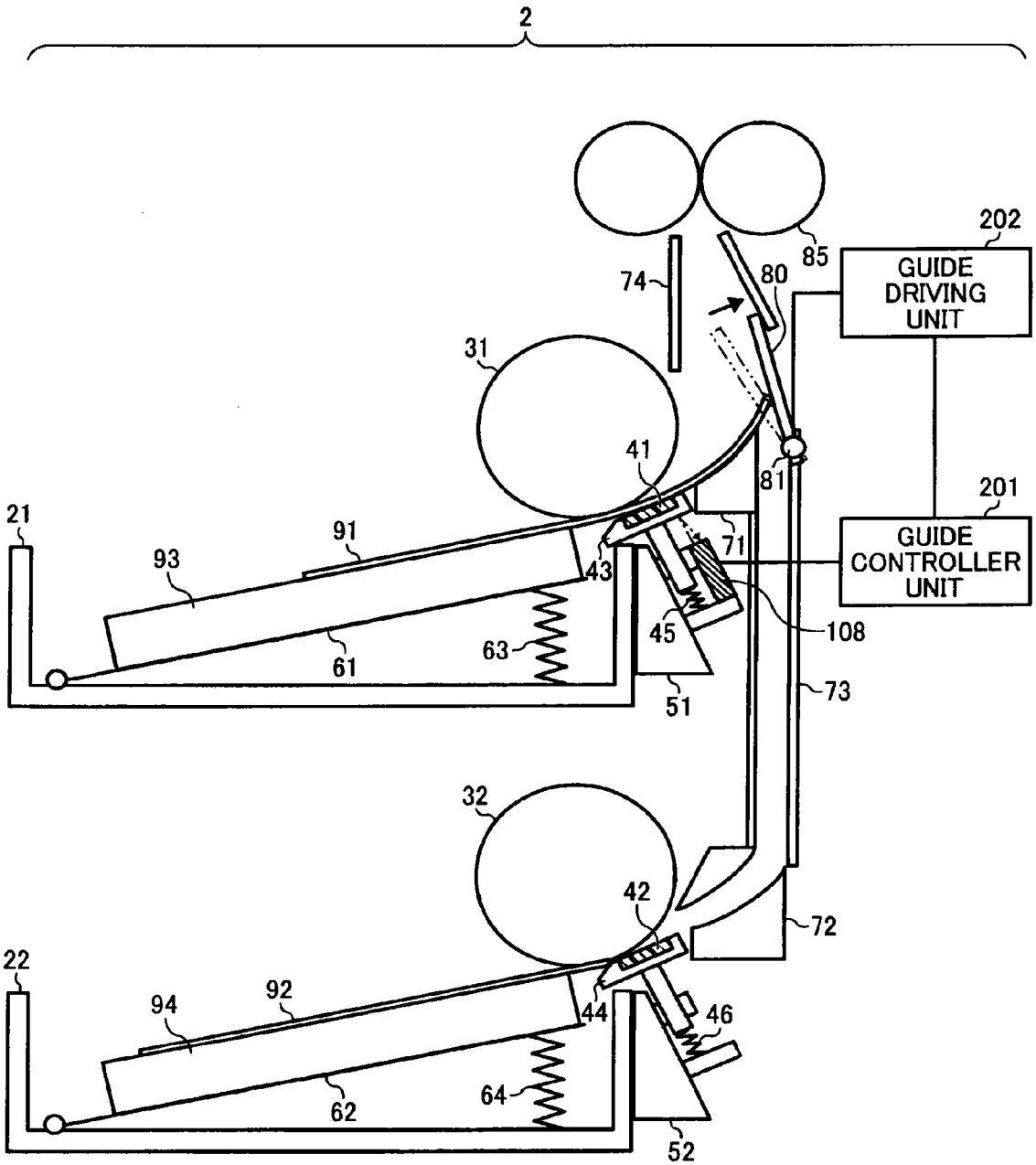
FIG. 27 is a diagram illustrating a longitudinal cross-sectional view illustrating an example of the sheet feeder of the image forming apparatus of the embodiment 13 described later in which the contact angle of the sheet and the movable guide becomes narrower.

Next, the thirteenth embodiment (embodiment 13) of the sheet feeder is described in detail with reference to FIGS. 26 and 27. FIG. 26 is a longitudinal cross-sectional view of an example of the sheet feeder of the image forming apparatus of the embodiment 13 and FIG. 27 is a longitudinal cross-sectional view illustrating an example of the sheet feeder of the image forming apparatus of the embodiment 13 in which the contact angle of the sheet and the movable guide makes an acuter angle.

In FIG. 26, the pad seating 51 has a sheet thickness detector 108. The sheet thickness detector 108 is, for example, a laser displacement gauge. The sheet thickness detector 108 measures the distance between the pad seating 51 and the pad 43. As the measuring method, for example, the laser displacement gauge, i.e., the sheet thickness detector 108 irradiates part of the pad 43 with a laser beam and receives reflection light therefrom to measure the distance by a laser focus displacement gauge, an interference spectroscopy laser displacement gauge, etc.

When the sheet 91 advances between the feeding roller 31 and the friction pad 41, the pad 43 is displaced by an amount equal to the thickness of the sheet 91. Then, the sheet thickness detector 108 measures the amount of the displacement to detect the sheet thickness of the sheet 91. The sheet feeder 2 has a guide controller unit 201 that receives information about the thickness of the sheet from the sheet thickness detector 108 and generates signals to drive the movable guide 80 and a guide driving unit 202 that drives the movable guide 80 based on the signals from the guide controller unit 201. The guide driving unit 202 is, for example, a stepping motor.

The guide controller unit 201 determines the tilting angle of the movable guide 80 based on the thickness information sent from the sheet thickness detector 108 and transmits a signal, for example, a pulse signal to the guide driving unit 202 to move the guide driving unit 202. The movable guide 80 is rotatably supported to the image forming apparatus by the rotation shaft 81, which is connected to the guide driving unit 202. The bottom part of the movable guide 80, which is the upstream side relative to the sheet transfer direction, is arranged continuously from the sheet feeding cassette 73 from the sheet feeding cassette 22 provided on the bottom.

There is a gap between the top part of the movable guide 80 (which is the downstream side relative to the transfer direction of sheet) and the sheet feeding guide 74 on the side of the feeding roller 31. Therefore, the sheet 91 advances along the guide 71, contacts the movable guide 80, follows the curve thereof, and passes through the gap between the movable guide 80 and the sheet feeding guide 74. In addition, the sheet 92 transferred from the sheet feeding cassette 22 situated on the bottom advances along the sheet feeding guide 73 and then along the movable guide 80 and passes through the gap between movable guide 80 and the sheet feeding guide 74.

When the sheet 91 is conveyed, the guide controller unit 201 determines the movement of the movable guide 80 based on the thickness information of the sheet 91 read by the sheet thickness detector 108 and the guide driving unit 202 moves the movable guide 80. As a result, the movable guide 80 rotates clockwise as indicated by the arrow in FIG. 27, narrowing the contact angle between the leading end of the sheet 91 and the movable guide 80. Consequently, the contact resistance between the leading end of the sheet 91 and the movable guide 80 decreases so that the sheet 91 is transferred to the movable guide 80 without jamming or halting. After the sheet 91 has passed through the movable guide 80, the movable guide 80 is returned to the original position by the guide driving unit 202.

When the amount of the displacement of the sheet thickness detector 108 returns to the value before the sheet 91 advances between the feeding roller 31 and the friction pad 41, it is determined that the sheet 91 has completely passed between the feeding roller 31 and the friction pad 41.

For example, a guide controller unit having a sheet transfer detector is provided in the middle of the sheet transfer path to measure the elapse time of the sheet transfer or detect the position of the sheet 91 when the feeder (transfer) roller starts transferring the sheet 91. In addition, it is possible to provide another mechanism in which the position of the sheet 91 is transmitted to the guiding device after a sheet thickness CPU determines whether the sheet is transferred based on the pad pressure detected by a pad pressure detector.

Therefore, according to the embodiment 13, the thickness of the sheet 74 can be securely detected at the position of the friction pad 41 before the leading end of the sheet 91 contacts the sheet feeding guide 74. Therefore, a sheet feeder that stably feeds sheets without jamming or halting can be provided. In addition, with regard to the detected amount of displacement, for example, it is possible to set a threshold therefor. In such a system, when the amount of displacement is equal to or less than a certain threshold, the sheet thickness detector 108 determines that there is no sheet 91 passing between the feeding roller 31 and the friction pad 41 and when the amount of displacement exceeds the threshold, the sheet thickness detector 108 determines that there is a sheet 91 passing between the feeding roller 31 and the friction pad 41.

Thereby, the fluctuation of the pad pressure caused by the vibration of the pad 43 is not mistaken as passing of the sheet. Moreover, the sheet thickness detector 108 is not limited to the structure or form described in this embodiment. Any detector that can detect the amount of displacement of the pad 43 can be suitably used. Furthermore, in the case in which not the thickness the sheet 91 but only detection of passing of the sheet 91 is required, when the amount of displacement of the pad 43 changes or surpasses a certain threshold, it is suitable to determine that there is a sheet 91 passing between the feeding roller 31 and the friction pad 41.

As described above, in the embodiment 13, since the thickness of the sheet is detected by the friction pad forming part of the sheet feeder, there is no need to provide another sensor in the sheet transfer path to detect the thickness of the sheet. Therefore, an increase in the number of the parts of the sheet feeder is limited to the minimum and no unnecessary load is applied to the sheet during transfer thereof so that the thickness of the sheet can be detected without interfering the transfer of the sheet. Furthermore, an increase of the space in the apparatus caused by adding a sensor can be avoided.

The embodiment 13 describes the sheet feeder having the sheet feeding cassette but is not limited thereto and the present invention can be applied to a sheet feeder having a manual tray. In such a case, the sheet feeding cassette in the embodiment 13 is replaced with a manual tray.

In the embodiments described above, an image forming portion (unit) that forms images on sheets are provided downstream of the pair of rollers 85 relative to the sheet transfer direction. The image forming portion (unit) and the sheet feeder form an image forming apparatus such as a photocopier.

Figure 28:
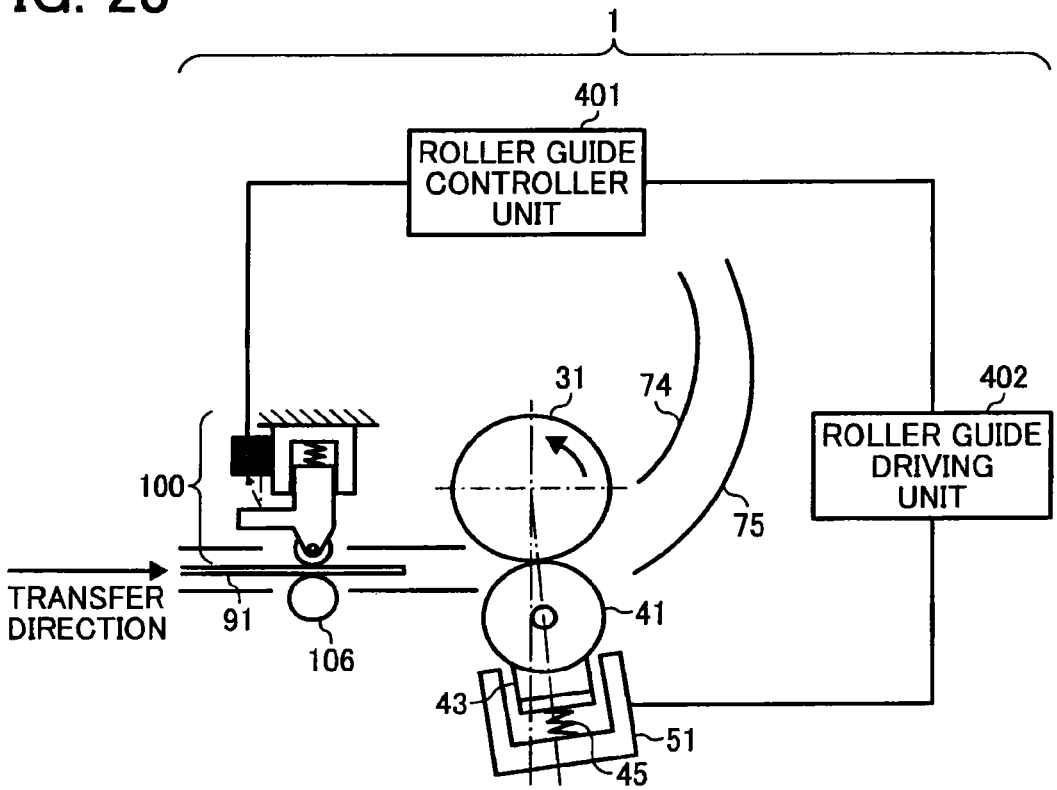
FIG. 28 is a longitudinal cross-sectional view illustrating an example of the sheet feeder of the image forming apparatus of the embodiment 14 described later.
Figure 29:
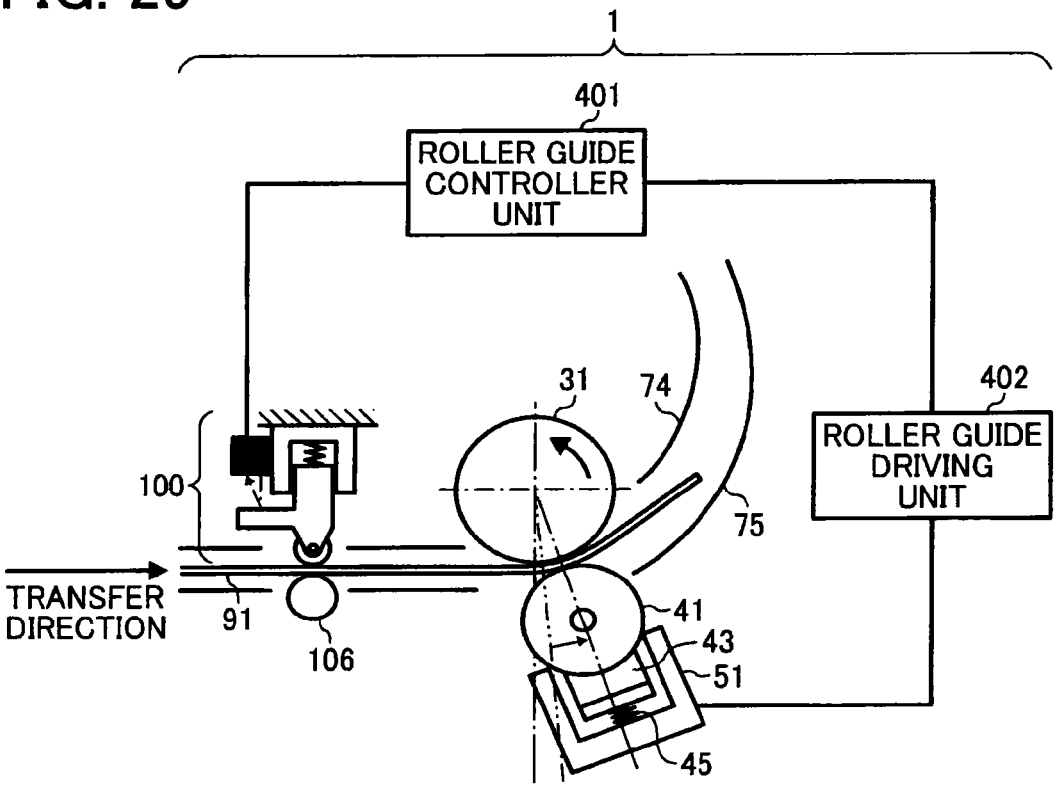
FIG. 29 is a diagram illustrating a longitudinal cross-sectional view illustrating an example of the sheet feeder of the image forming apparatus of the embodiment 14 described later in which the contact angle of the sheet and the movable guide becomes narrower.
Figure 30:
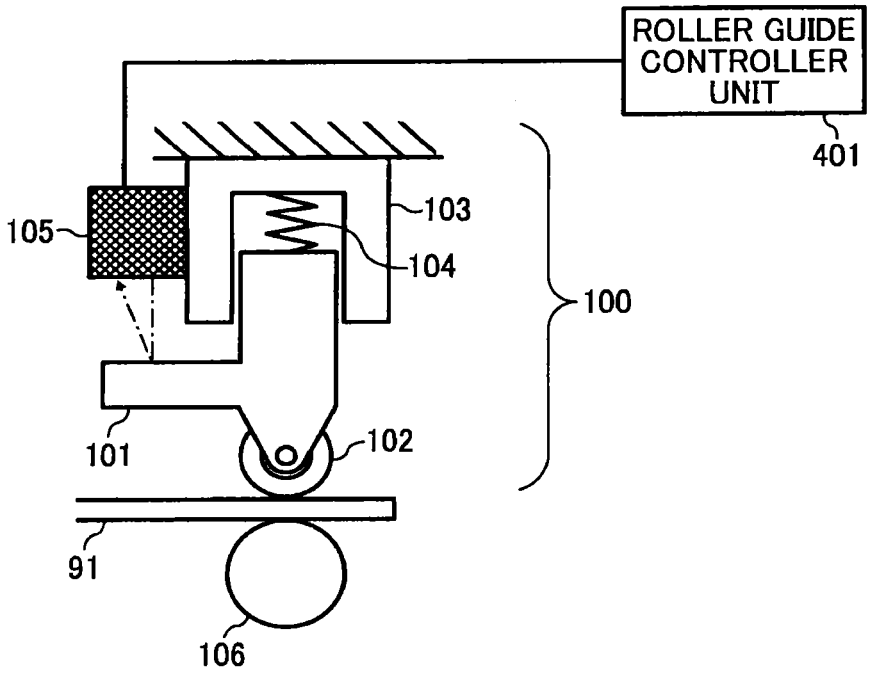
FIG. 30 is a lateral view illustrating the structure of an example of the sheet thickness detector in the sheet feeder of the image forming apparatus in the embodiment 14.

Next, the fourteenth embodiment (embodiment 14) of the sheet feeder is described in detail with reference to FIGS. 28, 29, and 30. FIG. 28 is a longitudinal cross-sectional view illustrating an example of the sheet feeder of the image forming apparatus in the embodiment 14, FIG. 29 is a longitudinal cross-sectional view illustrating an example of the sheet feeder of the image forming apparatus of the embodiment 14 in which the contact angle of the sheet and the movable guide becomes smaller, and FIG. 30 is a lateral view illustrating the structure of an example of the sheet thickness detector in the sheet feeder of the image forming apparatus of the embodiment 14.

In the sheet feeder 1, the feeding roller 31 is rotatably supported to an image forming apparatus such as a photocopier and the opposing roller 41 that is pressed against the feeding roller 31 is supported by the roller base 43. The opposing roller 41 freely rotates to avoid becoming a resistance to sheet transfer. The roller base 43 is supported by the roller base support 51. To press the opposing roller 41 against the feeding roller 31, a roller biasing member 45 such as a coil spring is inserted between the roller base 43 and the roller base support 51 to provide this biasing force, i.e., a contact pressure force, by the elastic force of this roller biasing member 45.

The sheet 91 is conveyed between the feeding roller 31 and the opposing roller 41 by, for example, the sheet feeder placed upstream from the feeding roller 31 relative to the sheet transfer direction. The feeding roller 31 rotates counterclockwise in FIG. 28 and, by the force of friction, conveys the sheet 91 that has advanced between the feeding roller 31 and the opposing roller 41.

The sheet feeder 1 has the sheet thickness detector 100 that detects the thickness of the sheet 91. The sheet thickness detector 100 has a feature to detect whether there is a sheet 91 passing between the feeding roller 31 and the friction pad 41. The sheet feeder 1 has a roller guide controller unit 401 that receives information about the thickness of the sheet from the sheet thickness detector 100 and generates signals to drive the roller base support 51 together with the roller base 43 and a roller guide driving unit 402 that drives the roller base support 51 based on the signals from the roller guide controller unit 401. The guide driving unit 402 is, for example, a stepping motor.

FIG. 30 illustrates the structure of the sheet thickness detector 100. The sheet thickness detector 100 has the sheet feeding roller 102 that contacts the sheet 91, the main portion 101 that supports the sheet feeding roller 102, the guiding portion 103 that supports moving of the main portion 101, the biasing portion 104 that biases the main portion 101 and the sheet feeding roller 102 to the sheet 91, and the displacement measuring portion 105 that measures the displacement of the main portion 101 to measure the thickness of the sheet 91. The biasing portion 104 is, for example, a spring and the displacement measuring portion 105 is, for example, a laser displacement meter.

As illustrated in FIG. 28, the sheet thickness detector 100 is installed upstream from the feeding roller 31 relative to the sheet transfer direction. The guiding portion 103 is fixed onto the apparatus. The sheet feeding roller 102 freely rotates in the sheet transfer direction not to become a resistance to the sheet 91 when the sheet 91 is transferred. The sheet feeding roller 102 has an opposing feeding roller 106 facing the sheet feeding roller 102. The opposing feeding roller 106 is supported by the main portion of the apparatus and freely rotates in the sheet transfer direction.

When the sheet 91 is conveyed toward the feeding roller 31, the sheet 91 passes between the sheet feeding roller 102 of the sheet thickness detector 100 and the opposing feeding roller 106. In addition, the main portion 101 of the sheet thickness detector 100 is displaced by an amount equal to the thickness of the sheet 91 in the middle of passing through the main portion 101. The displacement amount is measured at the displacement measuring portion 105 and the thickness information of the sheet is sent to the roller guide controller unit 401. The roller guide controller unit 401 determines the tilting angle of the roller base support 51 (in FIG. 28) based on the thickness information sent from the displacement measuring portion 105 and transmits a signal, for example, a pulse signal to the roller guide driving unit 402 to move the roller guide driving unit 402.

The roller base support 51 is rotatably supported to the image forming apparatus by the rotation shaft, which is connected to the roller guide driving unit 402 via, for example, a cog. The rotation shaft is arranged in such a manner that the opposing roller 41 and the roller base support 51 together with the roller base 43 are rotated around the center of the axis of the feeding roller 31 along the outer circumference surface in the longitudinal plane of the opposing roller 41.

When the sheet 91 is conveyed, the roller guide controller unit 401 determines the movement pattern and the movement timing of the roller base support 51 based on the thickness information of the sheet 91 read by the sheet thickness detector 100 and the roller guide driving unit 402 moves the roller base support 51 together with the roller base 43. As a result, the roller base support 51 rotates counterclockwise as illustrated in FIG. 29 around the center of the axis of the feeding roller 31, narrowing the contact angle between the leading end of the sheet 91 and the sheet feeding guide 75. Consequently, the contact resistance between the leading end of the sheet 91 and the sheet feeding guide 75 decreases so that the sheet 91 is transferred to the sheet feeding guide 75 without jamming or halting. After the sheet 91 has passed through, roller base support 51 is returned to the original position.

According to the embodiment 14, a sheet feeder that stably feeds sheets without jamming or halting can be provided. The movement of the roller base support 51 and the roller base 43 is constant to the thickness of the sheet during the sheet transfer or changeable to the transfer time of the sheet or the position of the sheet 91 in such a manner that the roller base support 51 and the roller base 43 gradually rotate counterclockwise in FIG. 28 to the sheet transfer process. In addition, the sheet thickness detector 100 is not limited to the structure or form described in the embodiment 14. Any detector that can detect the thickness of the sheet 91 before the sheet 91 contacts the sheet feeding guide 75 can be suitably used. In the present embodiment, although the sheet thickness detector 100 has another feature of detecting the timing of pass-through of the sheet, a separate independent device to detect the pass-through of the sheet can be suitably used.

For example, a roller guide controller unit having a sheet transfer detector is provided in the middle of the sheet transfer path to measure the elapse time of the sheet transfer or detect the position of the sheet 91 when the feeder (transfer) roller starts transferring the sheet 91.

Figure 31:
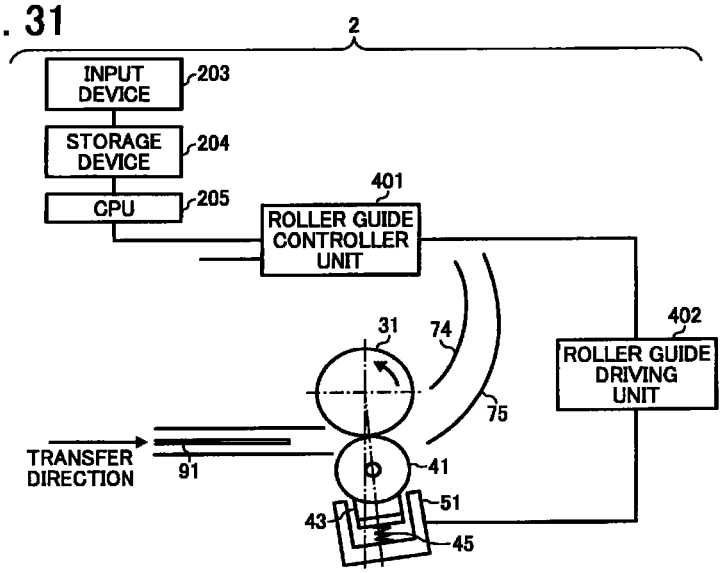
FIG. 31 is a longitudinal cross-sectional view illustrating an example of the sheet feeder of the image forming apparatus of the embodiment 15 described later.
Figure 32:
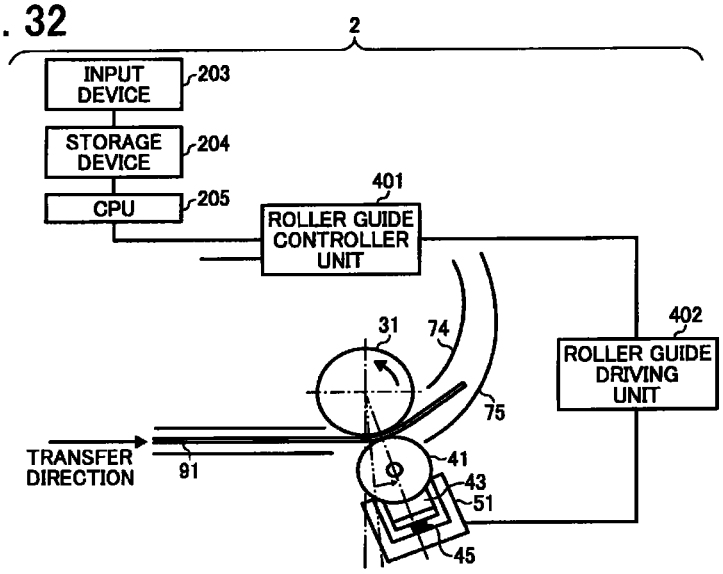
FIG. 32 is a diagram illustrating a longitudinal cross-sectional view illustrating an example of the sheet feeder of the image forming apparatus of the embodiment 15 described later in which the contact angle of the sheet and the movable guide becomes narrower.

Next, the fifteenth embodiment (embodiment 15) of the sheet feeder is described in detail with reference to FIGS. 31 and 32. FIG. 31 is a longitudinal cross-sectional view of an example of the sheet feeder of the image forming apparatus of the embodiment 15 and FIG. 32 is a longitudinal cross-sectional view illustrating an example of the sheet feeder of the image forming apparatus of the embodiment 15 in which the contact angle of the sheet and the sheet transfer guide becomes narrower.

With regard to the sheet feeder 2, property information about the sheet such as the kind, thickness, or elasticity (bending rigidity) is input through or selected from the input device 203. The input property information about the sheet is sequentially stored in the storage device 204. The CPU 205 controls the property information in the storage device 204.

The CPU 205 transmits the property information about the next sheet 91 to the roller guide controller unit 401. In addition, the sheet feeder of the image forming apparatus sends information to the roller guide controller unit 401 about the transfer timing on which the sheet 91 is transferred. The information about the transfer timing means that the starting signal is transmitted to the roller guide controller unit 401 when the feeding roller of the sheet feeder starts rotation.

Based on the transmitted information of the sheet 91 and the transmitted information about the transfer timing, the roller guide controller unit 401 determines the movement of the roller base support 51 and the roller guide driving unit 402 moves the roller base support 51. Then, the roller base support 51 rotates counterclockwise together with the roller base 43 as illustrated in FIG. 32, narrowing the contact angle between the leading end of the sheet 91 and the sheet feeding guide 75.

Consequently, the contact resistance between the leading end of the sheet 91 and the sheet feeding guide 75 decreases so that the sheet 91 is transferred to the sheet feeding guide 75 without jamming or halting. After the sheet 91 has passed through the roller base support 51, the roller base support 51 is returned to the original position. The property information with regard to the sheet finished with feeding is deleted from the storage device 204 by the CPU 205.

According to the embodiment 15, a sheet feeder that stably feeds sheets without jamming or halting can be provided. The movement of the roller base support 51 and the roller base 43 is constant to the thickness of the sheet during the sheet transfer or changeable to the transfer time of the sheet or the position of the sheet 91 in such a manner that the roller base support 51 and the roller base 43 gradually rotate counterclockwise in FIG. 31 to the sheet transfer process. As described above, the roller guide controller unit having the sheet transfer detector is provided in the middle of the sheet transfer path to measure the elapse time of the sheet transfer or detect the position of the sheet 91 when the feeder (transfer) roller starts transferring the sheet 91.

In addition, although the timing of the sheet transfer is obtained from the sheet feeder in the embodiment 15, for example, a detector such as the sheet thickness detector 100 described in the embodiment 14 which detects passage of the sheet can be suitably provided upstream from the feeding roller 31 relative to the sheet transfer direction to obtain the information about the timing of the sheet transfer.

Figure 33:
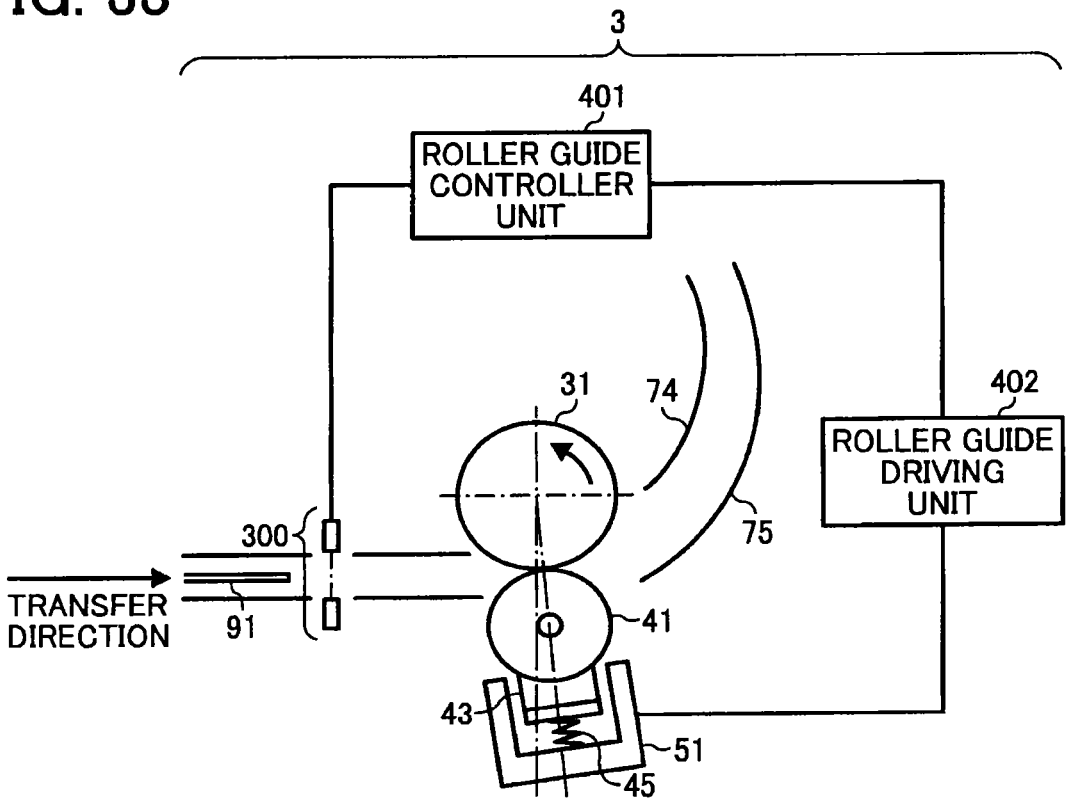
FIG. 33 is a longitudinal cross-sectional view illustrating an example of the sheet feeder of the image forming apparatus of the embodiment 16 described later.

Next, the sixteenth embodiment (embodiment 16) of the sheet feeder is described in detail with reference to FIGS. 33 and 34. FIG. 33 is a longitudinal cross-sectional view of an example of the sheet feeder of the image forming apparatus of the embodiment 16 and FIG. 34 is a longitudinal cross-sectional view illustrating an example of the sheet feeder of the image forming apparatus of the embodiment 16 in which the contact angle of the sheet and the sheet transfer guide becomes narrower.

A sheet transfer 3 has a sheet passing detector 300 arranged upstream from the feeding roller 31 relative to the sheet transfer direction to detect passing of the sheet 91. The sheet passing detector 300 is, for example, a laser sensor. The roller guide controller unit 401 determines the movement of the roller base support 51 to the time or the position of the sheet 91 to gradually rotate the roller base support 51 counterclockwise in FIG. 33 to the process of sheet transfer.

For example, for the starting time starting with when the sheet passing detector 300 detects the passing of the sheet 91, the pulse signals are stored in the roller guide controller unit 401 to regulate the movement of the roller base support 51 by the transfer speed of the sheet 91. The transfer speed of the sheet 91 is obtained by, for example, the rotation speed of the feeding roller 31. Based on the processes described above, the roller guide controller unit 401 determines the movement of the roller base support 51 and the roller guide driving unit 402 moves the roller base support 51.

Figure 34:
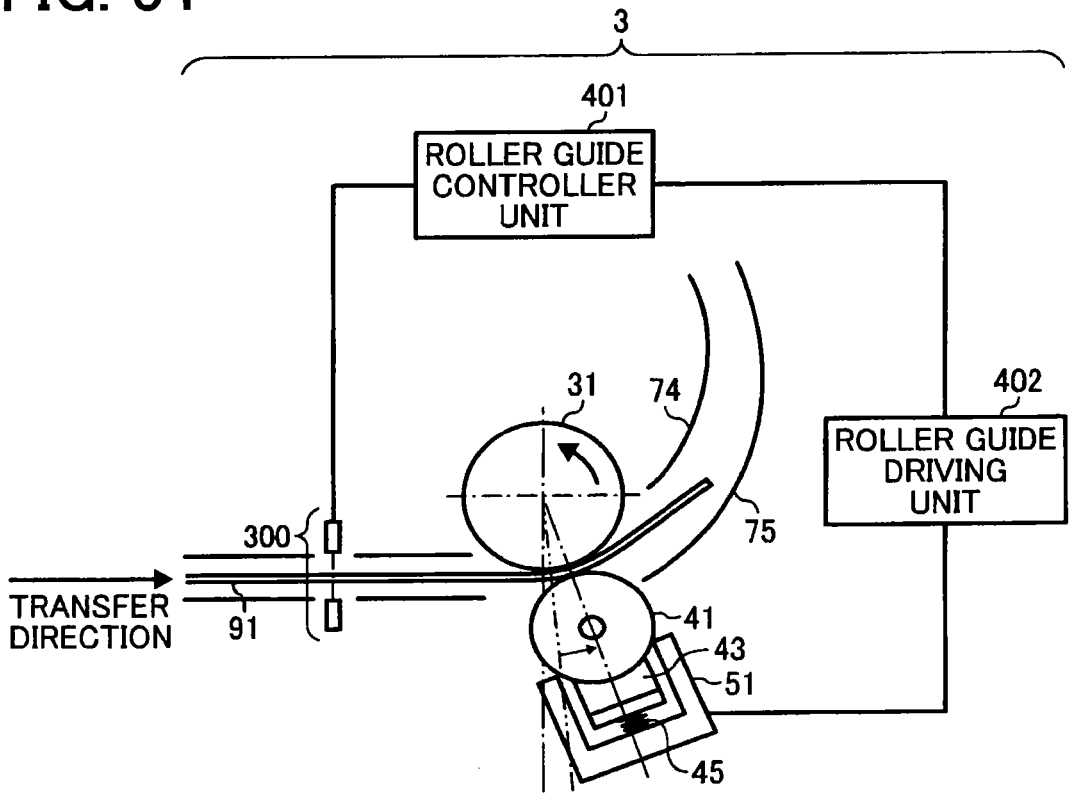
FIG. 34 is a diagram illustrating a longitudinal cross-sectional view illustrating an example of the sheet feeder of the image forming apparatus of the embodiment 16 described later in which the contact angle of the sheet and the movable guide becomes narrower.

Then, the roller base support 51 rotates counterclockwise together with the roller base 43 as illustrated in FIG. 34, narrowing the contact angle between the leading end of the sheet 91 and the sheet feeding guide 75. Consequently, the contact resistance between the leading end of the sheet 91 and the sheet feeding guide 75 decreases so that the sheet 91 is transferred to the sheet feeding guide 75 without jamming or halting. After the sheet 91 has passed through the roller base support 51, the roller base support 51 is returned to the original position.

According to the embodiment 16, a sheet feeder that stably feeds sheets without jamming or halting can be provided. In addition, although the timing of the sheet transfer is obtained from the sheet passing detector 300 in the embodiment 16, for example, it can be obtained from the sheet feeder as described in the embodiments 14 and 15. In addition, the sheet passing detector 300 in the embodiment 16 is a laser sensor as an example but not limited thereto.

Figure 35:
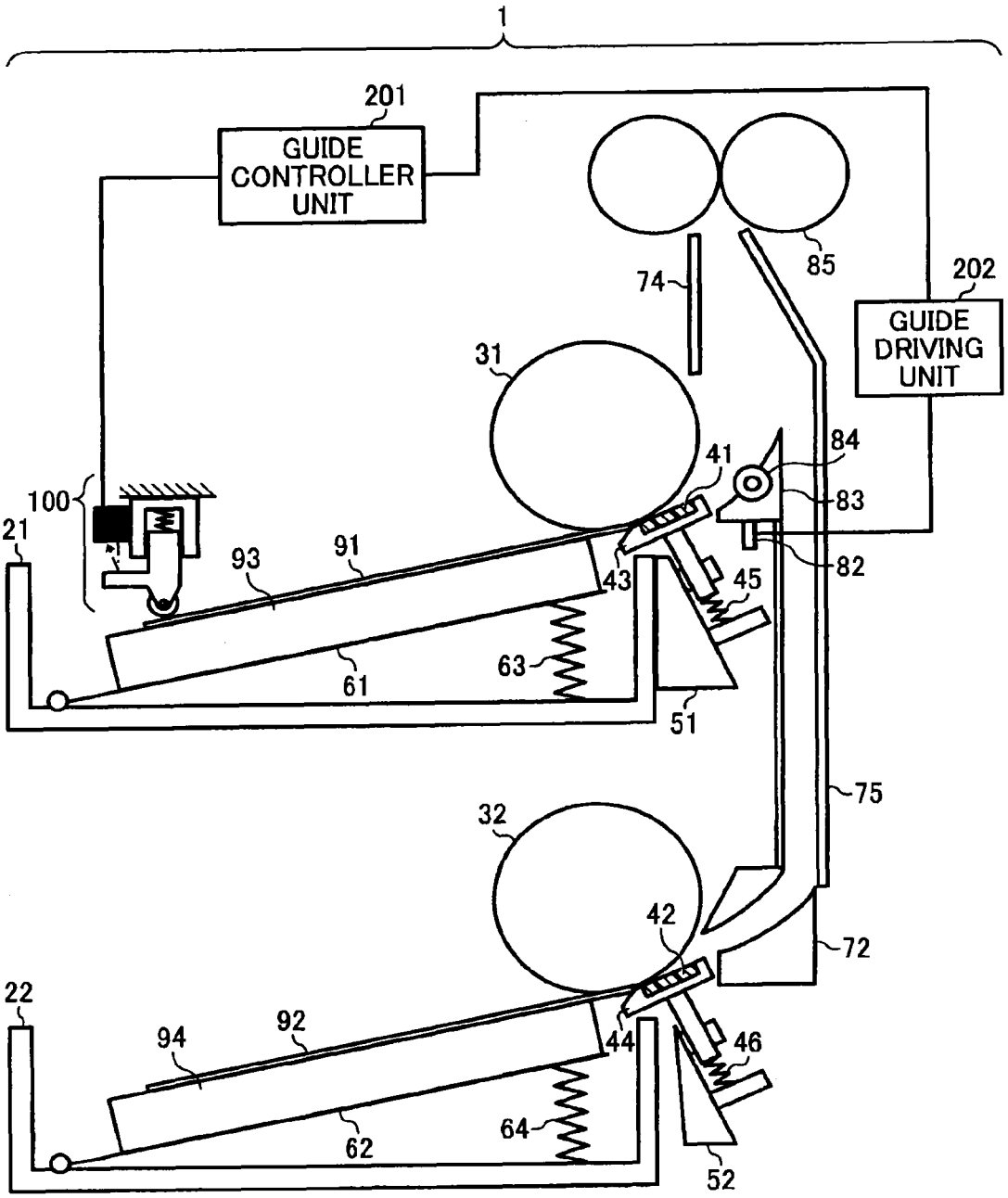
FIG. 35 is a longitudinal cross-sectional view illustrating an example of the sheet feeder of the image forming apparatus of the embodiment 17 described later.
Figure 36:
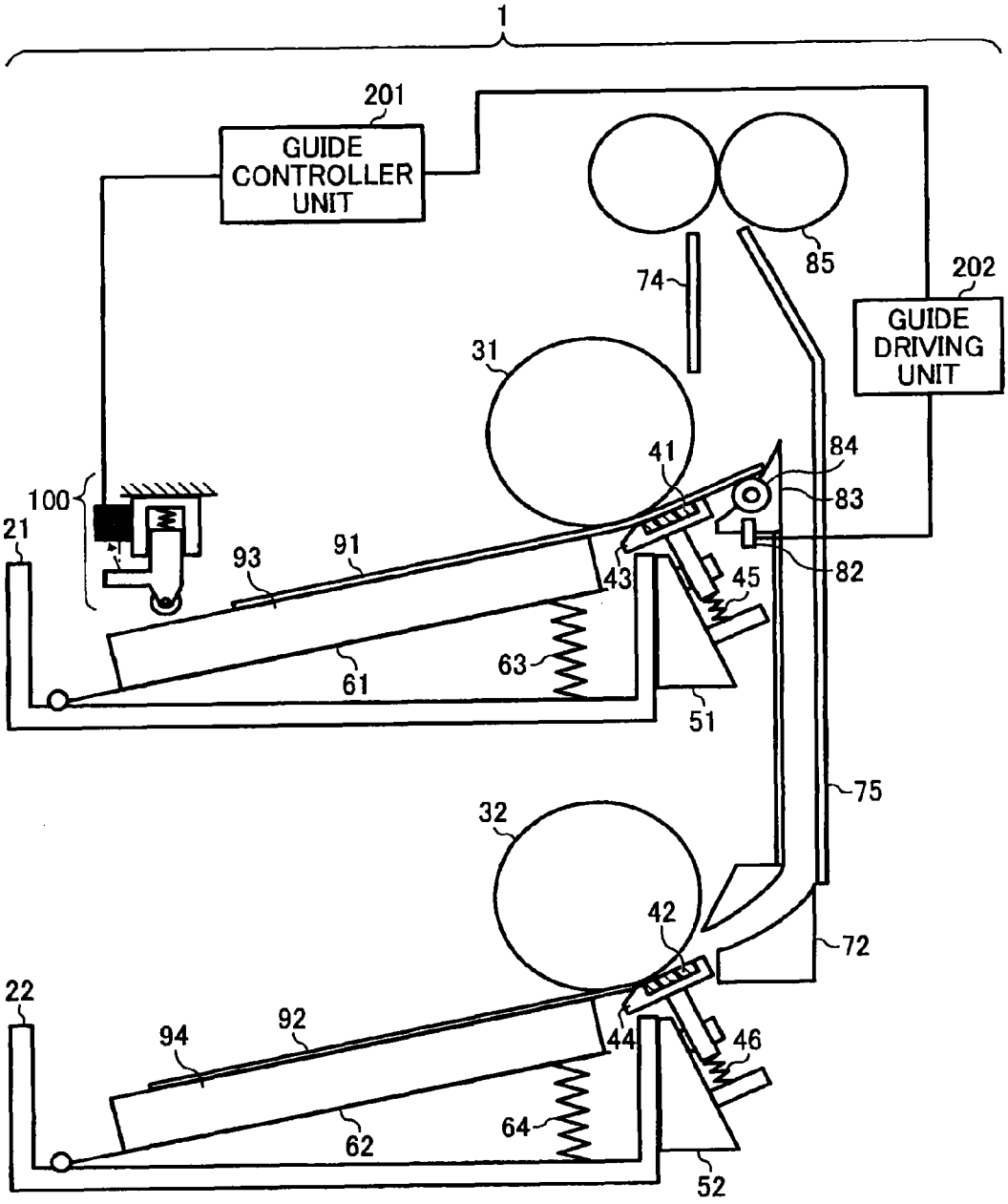
FIG. 36 is a longitudinal cross-sectional view illustrating an example of the sheet feeder of the image forming apparatus of the embodiment 17 described later.
Figure 37:
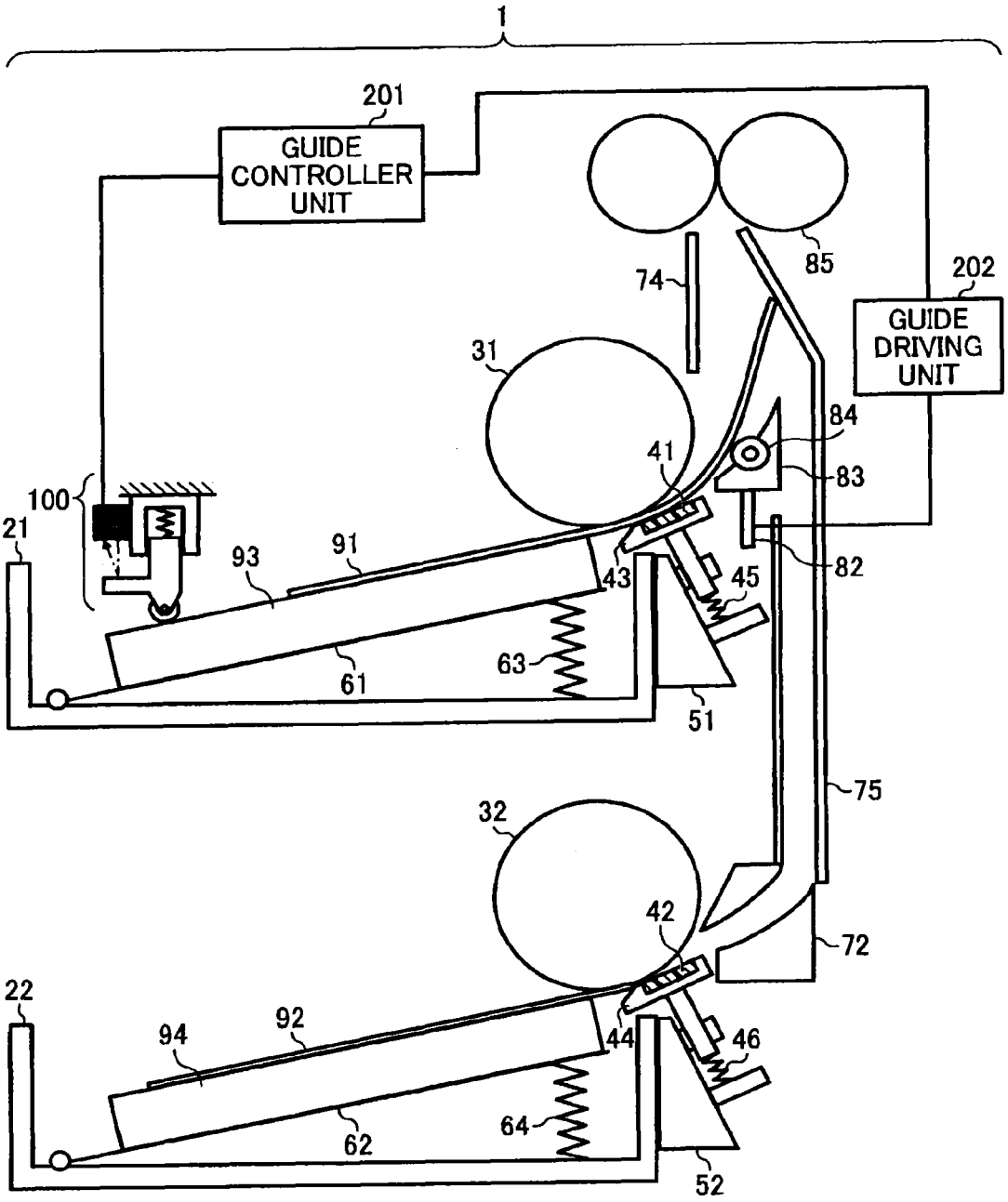
FIG. 37 is a diagram illustrating a longitudinal cross-sectional view illustrating an example of the sheet feeder of the image forming apparatus of the embodiment 17 described later in which the contact angle of the sheet and the movable guide becomes narrower.

The seventeenth embodiment (embodiment 17) of the sheet feeder is described in detail with reference to FIGS. 35, 36, and 37. FIG. 35 is a longitudinal cross-sectional view illustrating an example of the sheet feeder of the image forming apparatus in embodiment 17, FIG. 36 is a diagram illustrating a longitudinal cross-sectional view illustrating an example of the sheet feeder of the image forming apparatus of the embodiment 17 in which the movable guide 80 is lowered, and FIG. 37 is a longitudinal cross-sectional view illustrating an example of the sheet feeder of the image forming apparatus of the embodiment 17 in which the contact angle of the sheet and the sheet transfer guide becomes narrower.

The embodiment 17 is suitable in cases in which the sheet 91 is jammed or halt at the movable guide 83 even when the movable guide 83 is positioned as in FIG. 35 because the bending rigidity of the sheet 91 is extremely large.

The sheet feeding cassette 21 has the sheet thickness detector 100 to detect the thickness of the sheet 91 placed on top of the bundle of sheets 93. The sheet feeder 1 has a guide controller unit 201 that receives information about the thickness of the sheet 91 from the sheet thickness detector 100 and generates signals to drive the movable guide 83 and the guide driving unit 202 that drives the movable guide 80 based on the signals from the guide controller unit 201.

The guide driving unit 202 is, for example, a stepping motor and moves the linear slider 82 according to the pulse signal transmitted from the guide controller unit 201. As a result, the movable guide 83 is movable up and down in FIG.

35. The sheet thickness detector 100 is identical to that illustrated in FIG. 5 in the second embodiment and the description thereof is omitted.

FIGS. 35 and 37 are basically the same as FIGS. 10 and 11 of the fifth embodiment. FIG. 36 is basically the same as FIGS. 10 and 11 of the fifth embodiment except that the position of the movable guide 83 is situated further down below in comparison with FIG. 35.

For example, the movable guide 83 is initially positioned as in FIG. 35. For the starting time starting with when the sheet thickness detector 100 detects the thickness of the sheet 91, pulse signals to regulate the movement of the movable guide 83 by the transfer speed of the sheet 91 obtained from the rotation speed of the feeding roller 31 are stored in the guide controller unit 201. Based on the processes described above, the guide controller unit 201 determines the movement of the movable guide 83 and the guide driving unit 202 moves the position of the movable guide 83.

As a result, the movable guide 83 moves downward and is positioned as illustrated in FIG. 36 before the leading end of the sheet 91 reaches the movable guide 83. The movable guide 83 moves upward when the leading end of the sheet 91 passes through the roller 84, thereby bending the leading end of the sheet 91 upward. Therefore, the contact angle of the leading end of the sheet 91 and the sheet feeding guide 75 results in an acuter angle. Consequently, the contact resistance between the leading end of the sheet 91 and the sheet feeding guide 75 decreases so that the sheet 91 is transferred to the sheet feeding guide 75 without jamming or halting. After the sheet 91 has passed through the movable guide 83, the movable guide 83 is returned to the original position.

As described above, the roller guide controller unit having the sheet transfer detector is provided in the middle of the sheet transfer path to measure the elapse time of the sheet transfer or detect the position of the sheet 91 when the feeder (transfer) roller starts transferring the sheet 91.

According to the embodiment 17, a sheet feeder that stably feeds sheets without jamming or halting can be provided.

Figure 38:
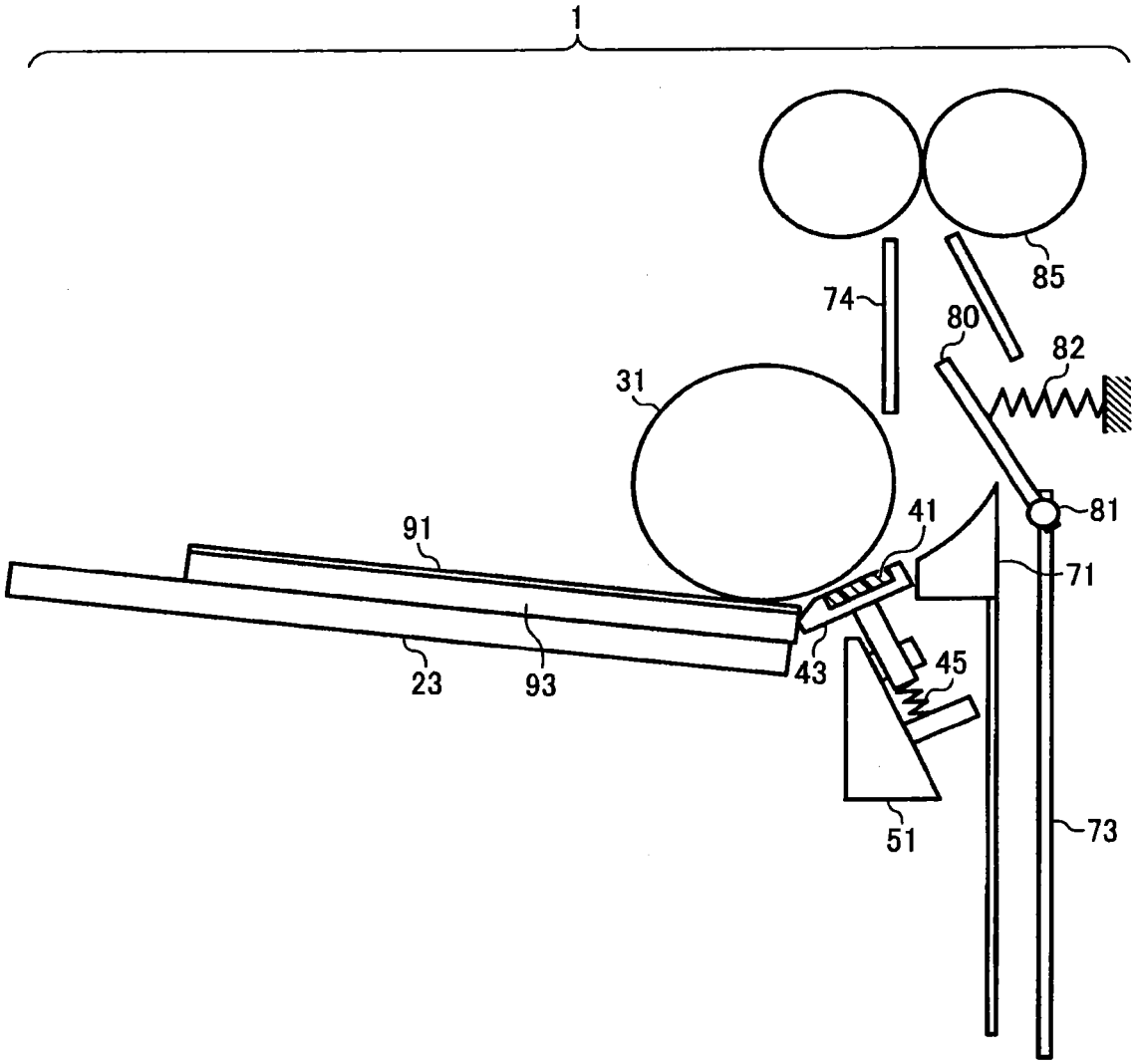
FIG. 38 is a longitudinal cross-sectional view illustrating an example of the sheet feeder of the image forming apparatus of the embodiment 18 described later.

Next, the eighteenth embodiment (embodiment 18) of the sheet feeder is described in detail with reference to FIG. 38. FIG. 38 is a cross-sectional view illustrating an example of the sheet feeder of the image forming apparatus of the embodiment 18. In the embodiment 18, the sheet feeder of the image forming apparatus described in the embodiment 1 is replaced with a sheet feeder having a manual tray.

FIG. 38 is the same as FIG. 1 of the first embodiment except that the sheet feeding cassette 21 is replaced with a manual tray 23. In the sheet feeder 1, the bundle of sheets 93 is placed on the manual tray 23. The sheet 91 placed uppermost is pressed against the feeding roller 31 by a biasing member.

When the feeding roller 31 rotates counterclockwise in FIG. 38, the sheet 91 receives the force of friction from the feeding roller 31 and advances between the feeding roller 31 and the friction pad 41. When multiple sheets advance between the feeding roller 31 and the friction pad 41 at the same time, the sheets 91 are separated by the difference in the friction forces having different friction indices and only a single sheet 91 is fed into the image forming apparatus. The movement thereafter is identical to that illustrated in FIGS. 1 and 2 of the first embodiment. Therefore, the description is omitted.

According to the embodiment 18, a sheet feeder that stably feeds sheets without jamming can be provided. In addition, although the feeding roller 31 feeds and separates the sheet 91 from the manual tray 23 in the embodiment 18, it is also suitable to provide a feeding roller upstream from the feeding roller 31 relative to the sheet transfer direction to feed the sheet 91. Moreover, the structure and the form of the manual tray are not limited to those illustrated in FIG. 38.

Figure 39:
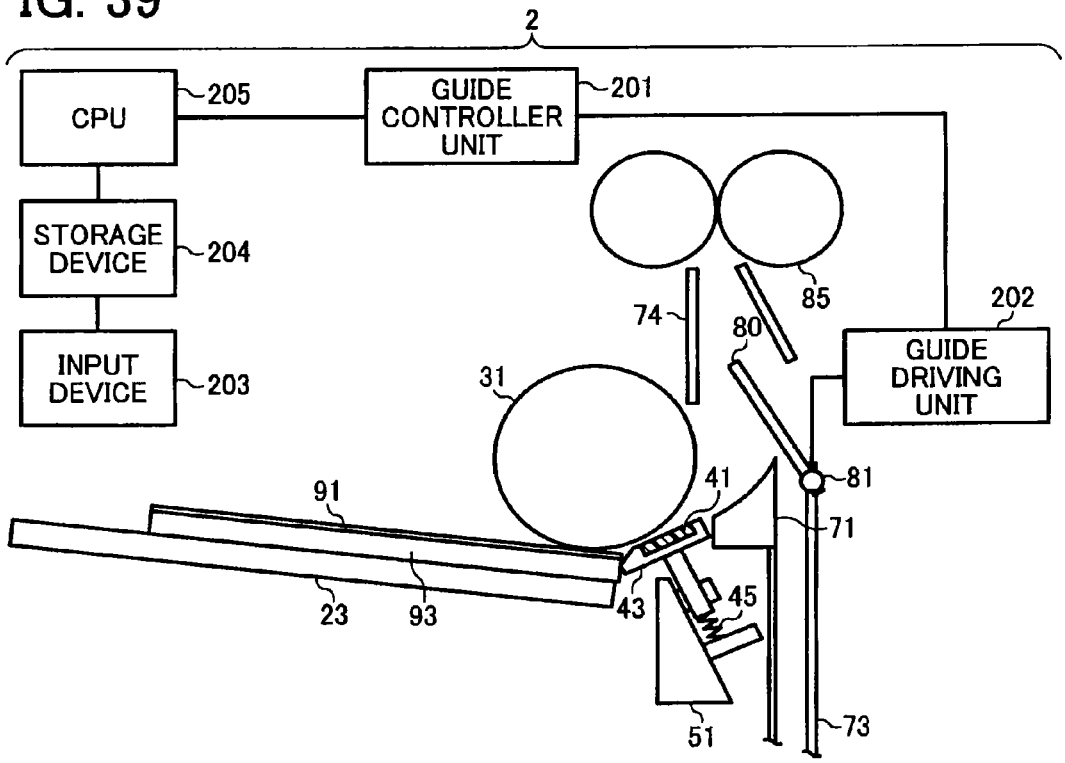
FIG. 39 is a longitudinal cross-sectional view illustrating an example of the sheet feeder of the image forming apparatus of the embodiment 19 described later.

Next, the nineteenth embodiment (embodiment 19) of the sheet feeder is described in detail with reference to FIG. 39. FIG. 39 is a cross-sectional view illustrating an example of the sheet feeder of the image forming apparatus of the embodiment 19.

In the sheet feeder 2, the bundle of sheets 93 is placed on the manual tray 23. The sheet 91 placed uppermost is pressed against the feeding roller 31 by a biasing member. When the feeding roller 31 rotates counterclockwise in FIG. 39, the sheet 91 receives the force of friction from the feeding roller 31 and advances between the feeding roller 31 and the friction pad 41. When multiple sheets advance between the feeding roller 31 and the friction pad 41 at the same time, the sheets 91 are separated by the difference in the friction forces having different friction indices and only a single sheet 91 is fed into the image forming apparatus. The movement thereafter is identical to that illustrated in FIGS. 18 and 19 of the embodiment 9. Therefore, the description is omitted.

According to the embodiment 19, a sheet feeder that stably feeds sheets without jamming or halting can be provided. In addition, although the feeding roller 31 feeds and separates the sheet 91 from the manual tray in the embodiment 19, it is also suitable to provide a feeding roller upstream from the feeding roller 31 relative to the sheet transfer direction to feed the sheet 91. Moreover, the structure and the form of the manual tray are not limited to those illustrated in FIG. 39.

Figure 40:
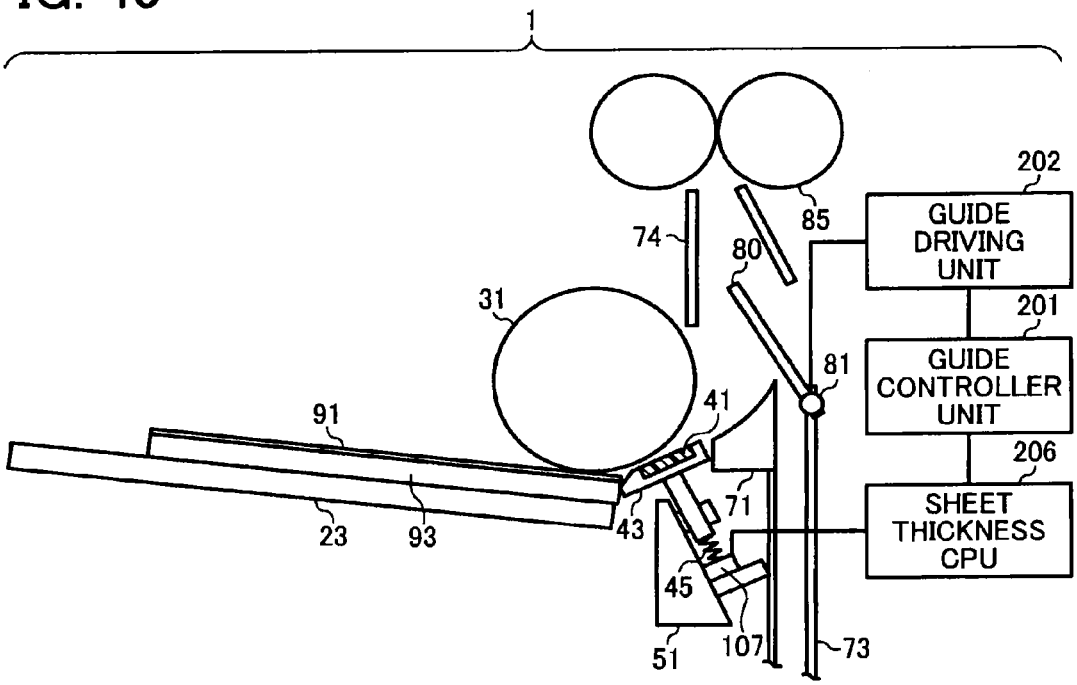
FIG. 40 is a longitudinal cross-sectional view illustrating an example of the sheet feeder of the image forming apparatus of the embodiment 20 described later.

Next, the twentieth embodiment (embodiment 20) of the sheet feeder is described in detail with reference to FIG. 40. FIG. 40 is a cross-sectional view illustrating an example of the sheet feeder of the image forming apparatus of the embodiment 20.

In the sheet feeder 1, the bundle of sheets 93 is placed on the manual tray 23. The sheet 91 placed uppermost is pressed against the feeding roller 31 by a biasing member. When the feeding roller 31 rotates counterclockwise in FIG. 40, the sheet 91 receives the force of friction from the feeding roller 31 and advances between the feeding roller 31 and the friction pad 41. When multiple sheets advance between the feeding roller 31 and the friction pad 41 at the same time, the sheets 91 are separated by the difference in the friction forces having different friction indices and only a single sheet 91 is fed into the image forming apparatus. The movement thereafter is identical to that illustrated in FIGS. 24 and 25 of the twelfth embodiment. Therefore, the description is omitted.

According to the embodiment 20, a sheet feeder that stably feeds sheets without jamming or halting can be provided. In addition, although the pad pressure detector 107 in the embodiment 12 is used in the embodiment 20, any detector that can detect the thickness of the sheet 91 before the sheet 91 contacts the movable guide 80 can be suitably used and is not limited to the form or the structure described in the embodiment 20. For example, the sheet thickness detector 108 illustrated in FIGS. 26 and 27 of the embodiment 13 can be used.

In addition, although the feeding roller 31 feeds and separates the sheet 91 from the manual tray in the embodiment 20, it is also suitable to provide a feeding roller upstream from the feeding roller 31 relative to the sheet transfer direction to feed the sheet 91. Moreover, the structure and the form of the manual tray are not limited to those illustrated in FIG. 40.

Figure 41:
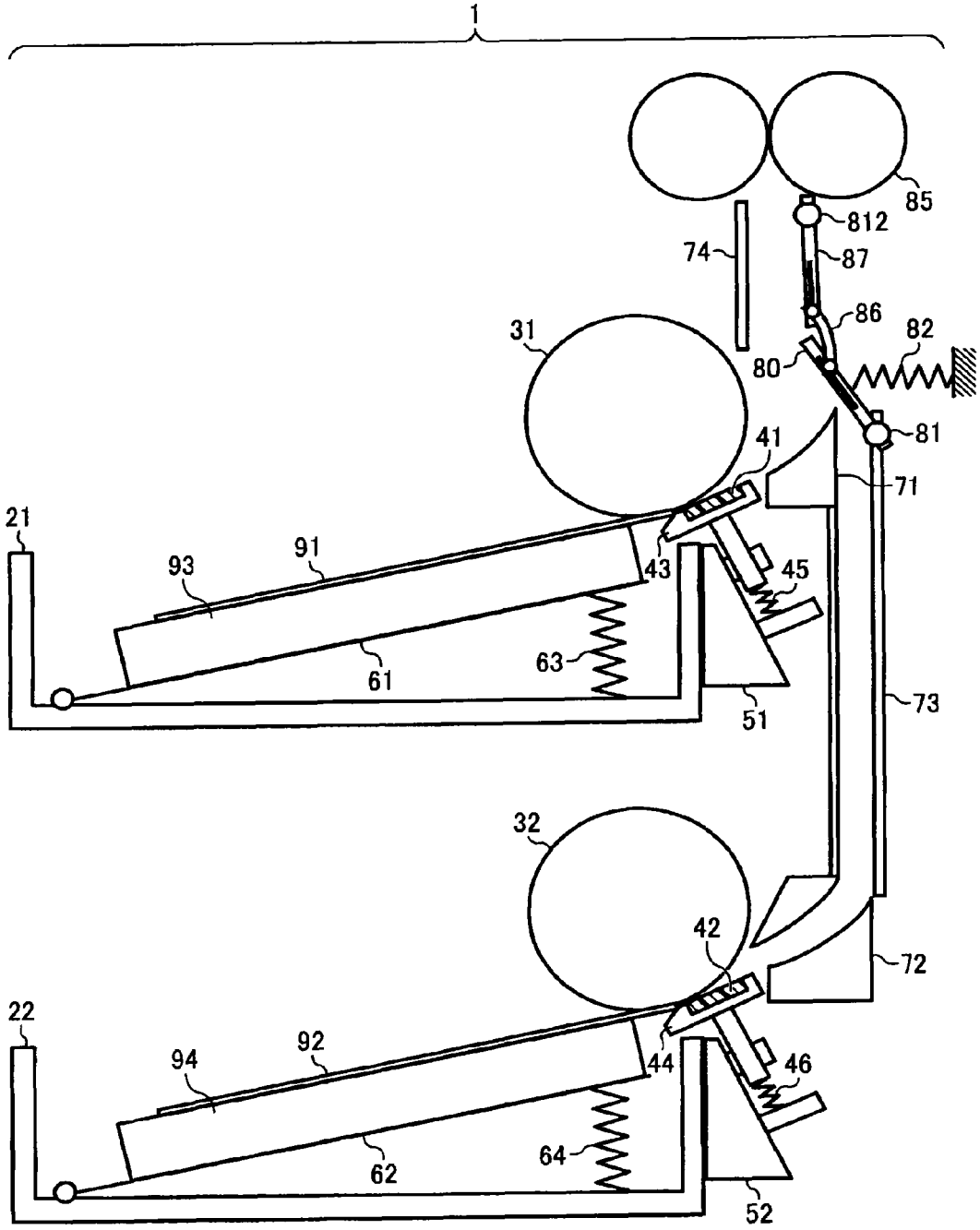
FIG. 41 is a longitudinal cross-sectional view illustrating an example of the sheet feeder of the image forming apparatus of the embodiment 21 described later.
Figure 42:
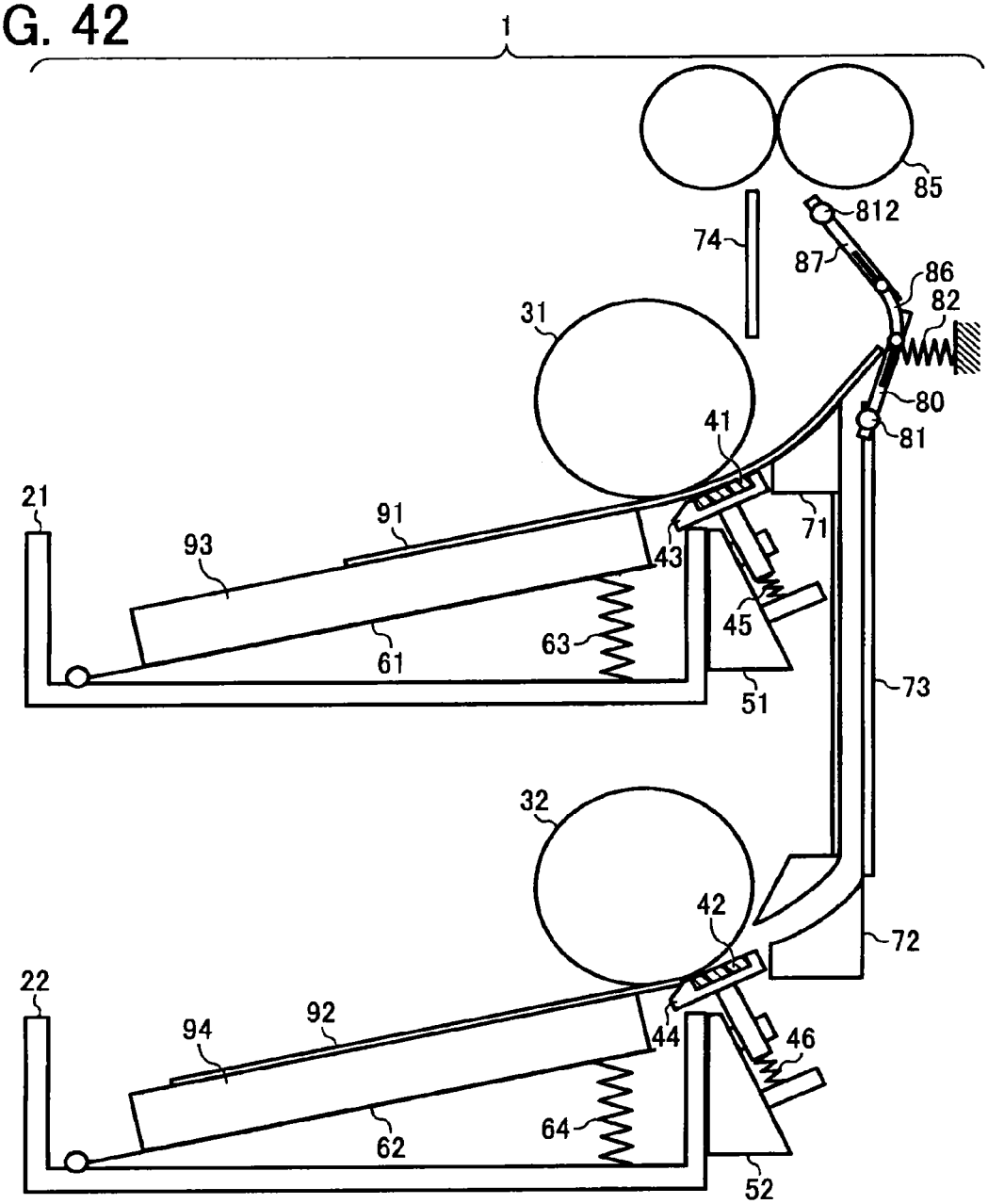
FIG. 42 is a diagram illustrating a longitudinal cross-sectional view illustrating an example of the sheet feeder of the image forming apparatus of the embodiment 21 described later in which the contact angle of the sheet and the movable guide becomes narrower.
Figure 43:
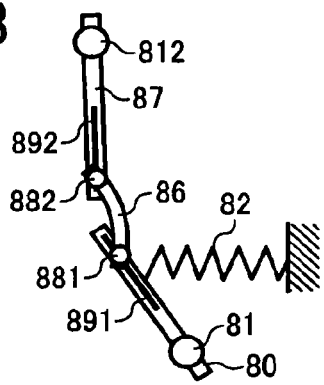
FIG. 43 is a longitudinal cross-sectional view illustrating an example of the structure of the movable guide of the sheet feeder of the image forming apparatus of embodiment 21 described later.

The twenty first embodiment (embodiment 21) of the sheet feeder is described in detail with reference to FIGS. 41, 42, and 43. FIG. 41 is a longitudinal cross-sectional view illustrating an example of the sheet feeder of the image forming apparatus in the embodiment 21, FIG. 42 is a diagram illustrating a longitudinal cross-sectional view illustrating an example of the sheet feeder of the image forming apparatus of the embodiment 21 in which the contact angle of the sheet and the movable guide becomes narrower, and FIG. 43 is a longitudinal cross-sectional view illustrating an example of the structure of the movable guide of the sheet feeder of the image forming apparatus of the embodiment 21.

With regard to the sheet feeder 1 and the movement thereof, the description of the same portions as those illustrated in FIGS. 1 and 2 of the first embodiment is omitted. The movable guide in the embodiment 21 is formed by the movable guides 80, 86, and 87. As illustrated in FIG. 43, the movable guides 80 and 86 are connected with each other via a rotation shaft 881 and the movable guides 86 and 87 are connected with each other via a rotation shaft 882. Initially, the movable guides 80, 86, and 87 are arranged as illustrated in FIG. 41.

The structure of the movable guide of the embodiment 21 is described with reference to FIG. 43. As described above, the movable guide is formed of the movable guides 80, 86, and 87. The movable guides 80 and 86 are connected with each other via a rotation shaft 881 and the movable guides 86 and 87 are connected with each other via a rotation shaft 882. The rotation shaft 881 is engaged with a slot 891 of the movable guide 80 and slidable along the slot 891 and the rotation shaft 882 is engaged with a slot 892 of the movable guide 87 and slidable along the slot 892.

Therefore, the rotation axes 881 and 882 are slidable and rotatable. In addition, as illustrated in FIG. 41, the form of the movable guide 86 is, for example, arc at where the movable guide 86 contacts the sheet 91 and the center of the arc is preferably on the side on which the sheet passes through.

The movable guide 87 is rotatably supported in the image forming apparatus via the rotation shaft 812. The movable guides 80, 86, and 87 can be continuously changed from the arrangement illustrated in FIG. 41 to that in FIG. 42. In addition, the movable guides 80, 86, and 87 can be also continuously changed from the arrangement illustrated in FIG. 42 to that in FIG. 41.

As illustrated in FIG. 41, the sheet 91 is conveyed diagonally upward toward the movable guide 80 along the guide 71 after the friction pad 41 and the feeding roller 31. The movable guide 80 is rotatably supported by a rotation shaft 81 to the image forming apparatus and biased by a guide biasing member 82 such as a coil spring toward the sheet feeding guide 74 on the side of the feeding roller 31.

The bottom part of the movable guide 80, which is the upstream part relative to the transfer direction of sheets, is consecutively arranged from, for example, the sheet feeding guide 73 for the sheet feeding cassette 22 provided on the bottom in order not to hinder the transfer of the sheet 92. As illustrated in FIG. 41, the center of the rotation of the rotation shaft 81 is down below the downstream part of the surface of the guide 71 relative to the sheet transfer direction and when the leading end of the sheet 91 contacts the movable guide 80, it is preferable that the leading end contacts the portion above the center of the rotation of the rotation shaft 81, i.e., the downstream portion relative to the sheet transfer direction.

At the top part of the movable guide 87, i.e., the downstream part relative to the sheet transfer, there is a gap between the upper part and the sheet feeding guide 74 on the side of the feeding roller 31. Therefore, a sheet having a low elasticity such as a thin sheet advances along the guide 71, contacts the movable guide 80, is bent at and advances along the movable guide 80, and is transferred through the gap between the movable guide 87 and the sheet feeding guide 74.

In addition, the sheet 92 transferred from the sheet feeding cassette 22 situated on the bottom advances along the sheet feeding guide 73 and then along the movable guide 80 and passes through the gap between movable guide 87 and the sheet feeding guide 74.

Moreover, in the case of a sheet having a high elasticity such as a thick sheet, the leading end thereof passes through the friction pad 41, advances diagonally upward right in FIG. 41 along the guide 71, and contacts the upper part (above the rotation shaft 81) of the movable guide 80. The movable guide 80 is pressed by the leading end of the sheet 91 at the upper part above the rotation shaft 81 and rotates clockwise in FIG. 41.

As a result, the contact angle of the leading end of the sheet 91 and the movable guide 80 becomes sharper. FIG. 43 illustrates this state. Consequently, the transfer resistance of the movable guide 80 against the leading end of the sheet 91 decreases so that the sheet 80 is transferred to the movable guide 80 without jamming or halting. In addition, as illustrated in FIG. 42, the movable guides 86 and 87 change their positions by the rotation of the rotation shaft 812, 881, and 882 and the sliding in the slots 891 and 892.

Thereafter, while the contact angle between the movable guides 86 and 87 and the sheet 91 is kept acute, the sheet 91 passes through the movable guides 86 and 87. After the sheet 91 passes through the movable guide 80, the movable guide 80 is returned to its original position by the guide biasing member 82 and accordingly the movable guides 86 and 87 are back to their original positions.

According to the embodiment 21, a sheet feeder that stably feeds sheets without jamming or halting can be provided. In addition, in the embodiment 21, the form of the movable guides 80 and 87 is flat, but not limited thereto. For example, it is suitable to use the movable guides having a curved (e.g., arc) contact surface with the sheet. In addition, although the form of the movable guide 86 is arc in the embodiment 21, it can be flat as long as the contact angle with the sheet is kept acute.

In the embodiment 21, the movable guide is formed of three movable guides, i.e., the movable guides 80, 86, and 87. It is also suitable to use a movable guide having the movable guides 80 and 87 which are linked with each other via a rotation shaft and a slot. Furthermore, the movable guide can be formed of four or more parts.

Figure 44:
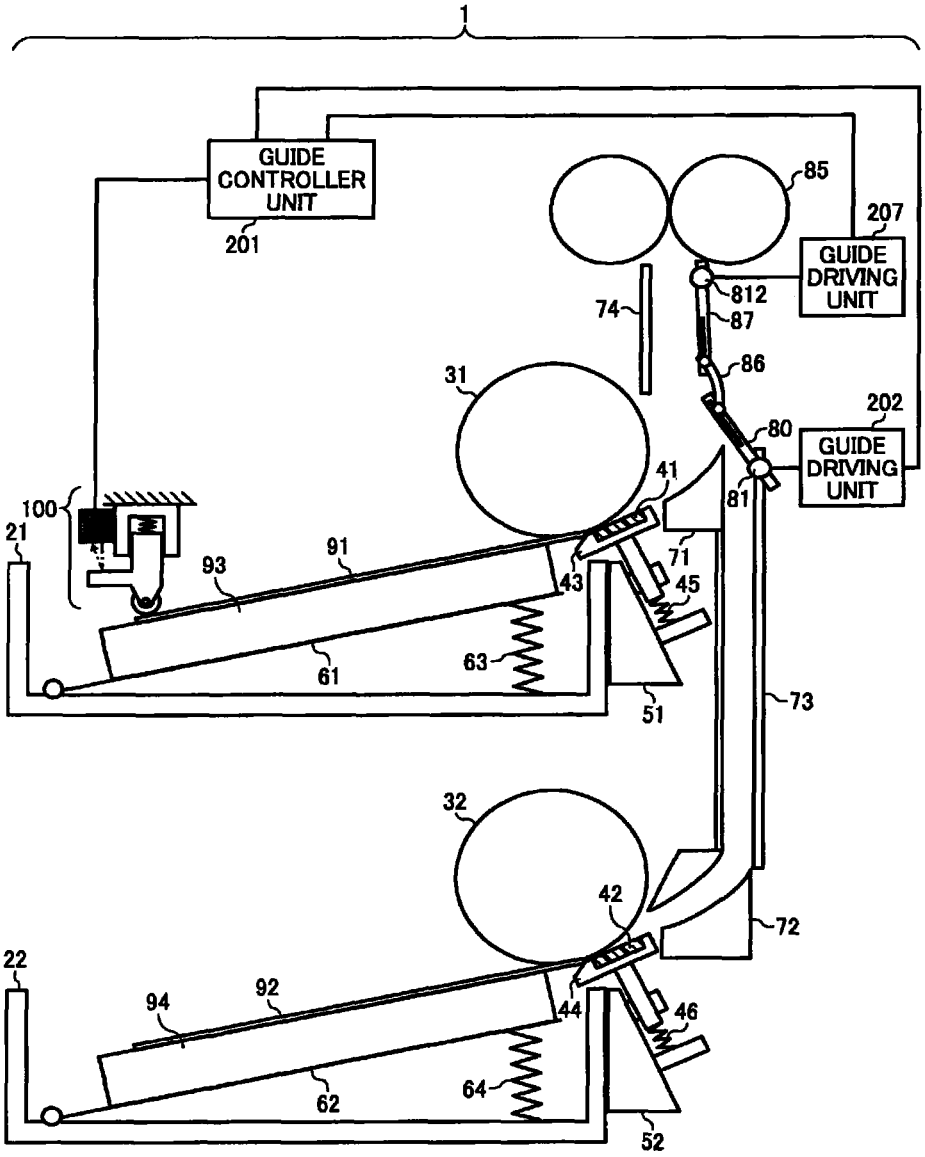
FIG. 44 is a longitudinal cross-sectional view illustrating an example of the sheet feeder of the image forming apparatus of the embodiment 22 described later.
Figure 45:
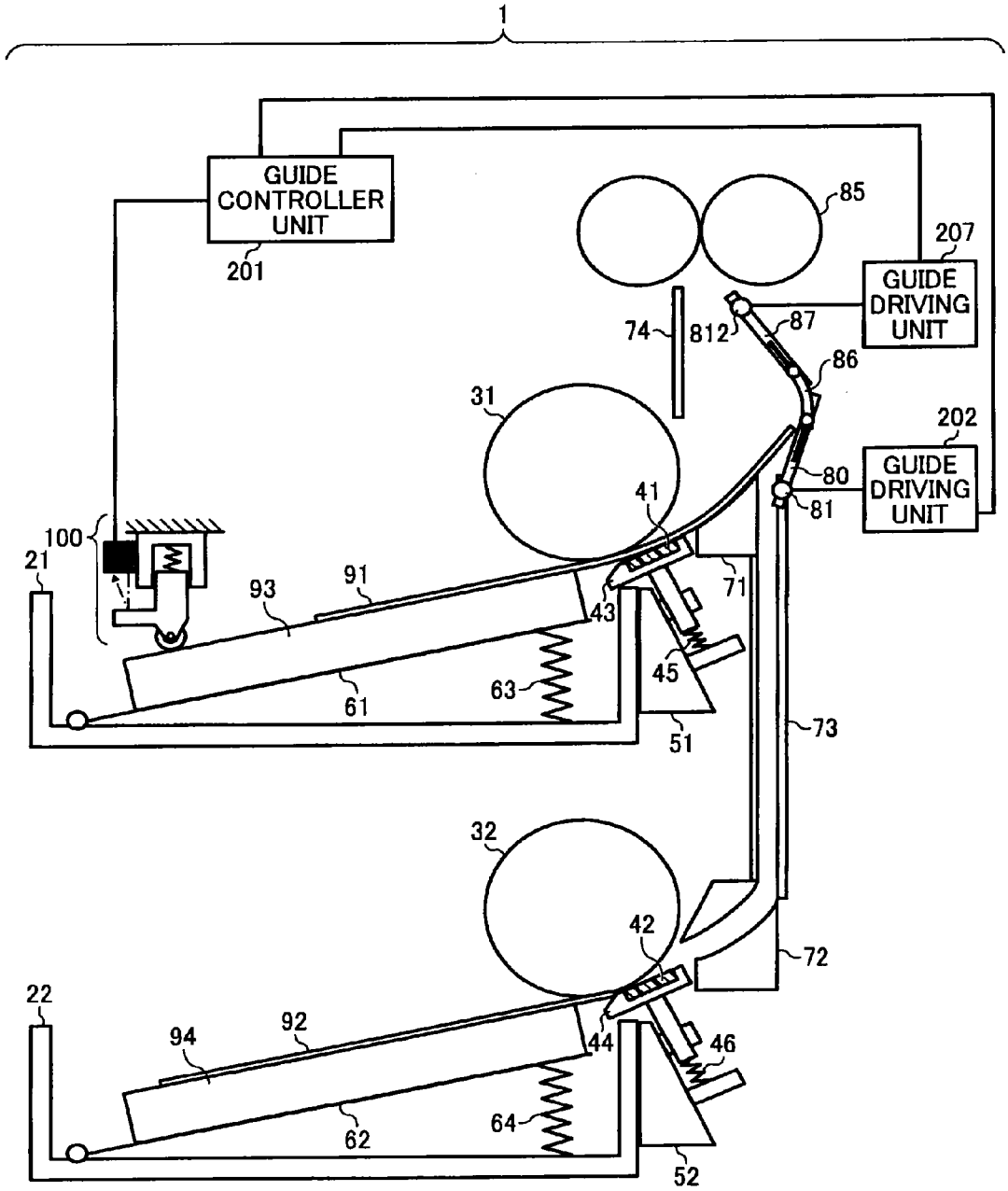
FIG. 45 is a diagram illustrating a longitudinal cross-sectional view illustrating an example of the sheet feeder of the image forming apparatus of the embodiment 22 described later in which the contact angle of the sheet and the movable guide becomes narrower.

Next, the twenty second embodiment (embodiment 22) of the sheet feeder is described in detail with reference to FIGS. 44 and 45. FIG. 44 is a longitudinal cross-sectional view of an example of the sheet feeder of the image forming apparatus of the embodiment 22 and FIG. 45 is a longitudinal cross-sectional view illustrating an example of the sheet feeder of the image forming apparatus of the embodiment 22 in which the contact angle of the sheet and the movable guide becomes narrower. In the embodiment 22, the movable guide 80 of the sheet feeder of the image forming apparatus illustrated in FIGS. 16 and 17 of the embodiment 8 is changed to that identical to the movable guide of the embodiment 21.

In the embodiment 21, the movable guides 80, 86, and 87 are driven by the guide biasing member 82, which can be called a passive driving mechanism. To the contrary, as described in the embodiment 8, the guide driving units 202 and 207 are used to have a so-called active driving mechanism in the embodiment 22.

As illustrated in FIG. 44, the movable guide 80 is connected to the guide driving unit 202 via the rotation shaft 81 and the movable guide 87 is linked with the guide driving unit 207 via the rotation shaft 812. By operating the guide driving units 202 and 207, the movable guides 80, 86, and 87 can be continuously changeable from the arrangement illustrated in FIG. 44 to the arrangement illustrated in FIG. 45. In addition, the movable guides 80, 86, and 87 can be also continuously changed from the arrangement illustrated in FIG. 45 to that in FIG. 44.

The sheet feeding cassette 21 has the sheet thickness detector 100 to detect the thickness of the sheet 91 placed on top of the bundle of sheets 93. The sheet thickness detector 100 is identical to that illustrated in FIG. 5 in the second embodiment and the description thereof is omitted.

The sheet feeder 1 has a guide controller unit 201 that receives information about the thickness of the sheet from the sheet thickness detector 100 and generates signals to drive the movable guides 80 and 87, a guide driving unit 202 that drives the movable guide 80 based on the signals from the guide controller unit 201, and the guide driving unit 207 that drives the movable guide 87 based on the signals from the guide controller unit 201. The guide driving units 202 and 207 are, for example, stepping motors.

When the feeding roller 31 starts rotation to feed the sheet 91, the sheet 91 passes through the feeding roller 31 and the friction pad 41 and is conveyed to diagonally upward toward the movable guide 80. The sheet 91 passes through the sheet feeding roller 102 of the sheet thickness detector 100 while contacting the sheet feeding roller 102. In addition, the main portion 101 of the sheet thickness detector 100 is displaced by an amount equal to the thickness of the sheet 91 in the middle of passing through the main portion 101. The displacement amount is measured at the displacement measuring portion 105 as in FIG. 5 and the thickness information of the sheet is sent to the guide controller unit 201.

The guide controller unit 201 determines the tilting angle of the movable guides 80 and 87 based on the thickness information sent from the displacement measuring portion 105 and transmits a signal, for example, a pulse signal to the guide driving units 202 and 207 to move the guide driving units 202 and 207.

The movable guide 80 is rotatably supported to the image forming apparatus by the rotation shaft 81, which is connected to the guide driving unit 202. When the sheet 91 is thick, i.e., highly elastic, the guide controller unit 201 determines the movement of the movable guide 80 based on the thickness information of the sheet 91 read by the sheet thickness detector 100 and the guide driving unit 202 moves the movable guide 80 before conveying the sheet 91.

The movable guide 87 is rotatably supported to the image forming apparatus by the rotation shaft 812, which is connected to the guide driving unit 207. When the sheet 91 is thick, i.e., highly elastic, the guide controller unit 201 determines the movement of the movable guide 87 based on the thickness information of the sheet 91 read by the sheet thickness detector 100 and the guide driving unit 207 moves the movable guide 87 before conveying the sheet 91.

As a result, the movable guide 80 rotates clockwise and the movable guide 87 rotates counterclockwise as illustrated in FIG. 45, narrowing the contact angle between the leading end of the sheet 91 and the movable guides 80, 86, and 87. Consequently, the contact resistance between the leading end of the sheet 91 and the movable guides 80, 86, and 87 decreases so that the sheet 91 is transferred to the movable guides 80, 86, and 87 without jamming and halt. After the sheet 91 has passed through the movable guides 80, 86, and 87, the movable guides 80, 86, and 87 are returned to the original positions by the guide driving units 202 and 207.

According to the twenty second embodiment (embodiment 22), a sheet feeder that stably feeds sheets without jamming or halting can be provided. Although the sheet thickness detector 100 is used to detect the thickness of the sheet 91 in the twenty second embodiment, the information about the kind, the thickness thereof, the elasticity (bending rigidity), etc. of the sheet is input or selected by using the inputting device to use such information as illustrated in FIGS. 18 and 19 of the ninth embodiment.

The sheet thickness detector 100 in FIGS. 44 and 45 takes the place of the input device 203 to the CPU 205 illustrated in FIG. 18. Furthermore, the sheet thickness detector 100 may have the pad pressure detector 107 illustrated in FIGS. 24 and 25 of the embodiment 12 or the sheet thickness detector 108 illustrated in FIGS. 26 and 27 of the embodiment 13 and use the information about the sheet obtained therefrom. Any other sheet thickness detector than the detector described above can be suitably used.

In addition, although the guide driving units 202 and 207 drive the movable guides 80 and 87 together with the movable guide 86 in the embodiment 22, the movable guide 86 may be driven by the guide driving unit. In addition, the movable guide 87 is rotatably supported to the image forming apparatus via a rotation shaft to change the arrangement of the movable guides 80, 86, and 87 by the rotation of the movable guide 80 driven by the guide driving unit 202.

Alternatively, the movable guide 80 is rotatably supported to the image forming apparatus via a rotation shaft to change the arrangement of the movable guides 80, 86, and 87 by the movement of the movable guides 86 and/or 87 driven by the guiding device. Furthermore, the guide biasing member 82 illustrated in FIG. 1 of the first embodiment can be attached to the movable guides 80, 86, and 87.

In the embodiment 22, the two guide driving units 202 and 207 are controlled by the single guide controller unit 201 but a guiding controller can be provided to each of the guiding devices. Furthermore, the movable guides 80 and 87 can be moved by using a single guide driving device.

Figure 46:
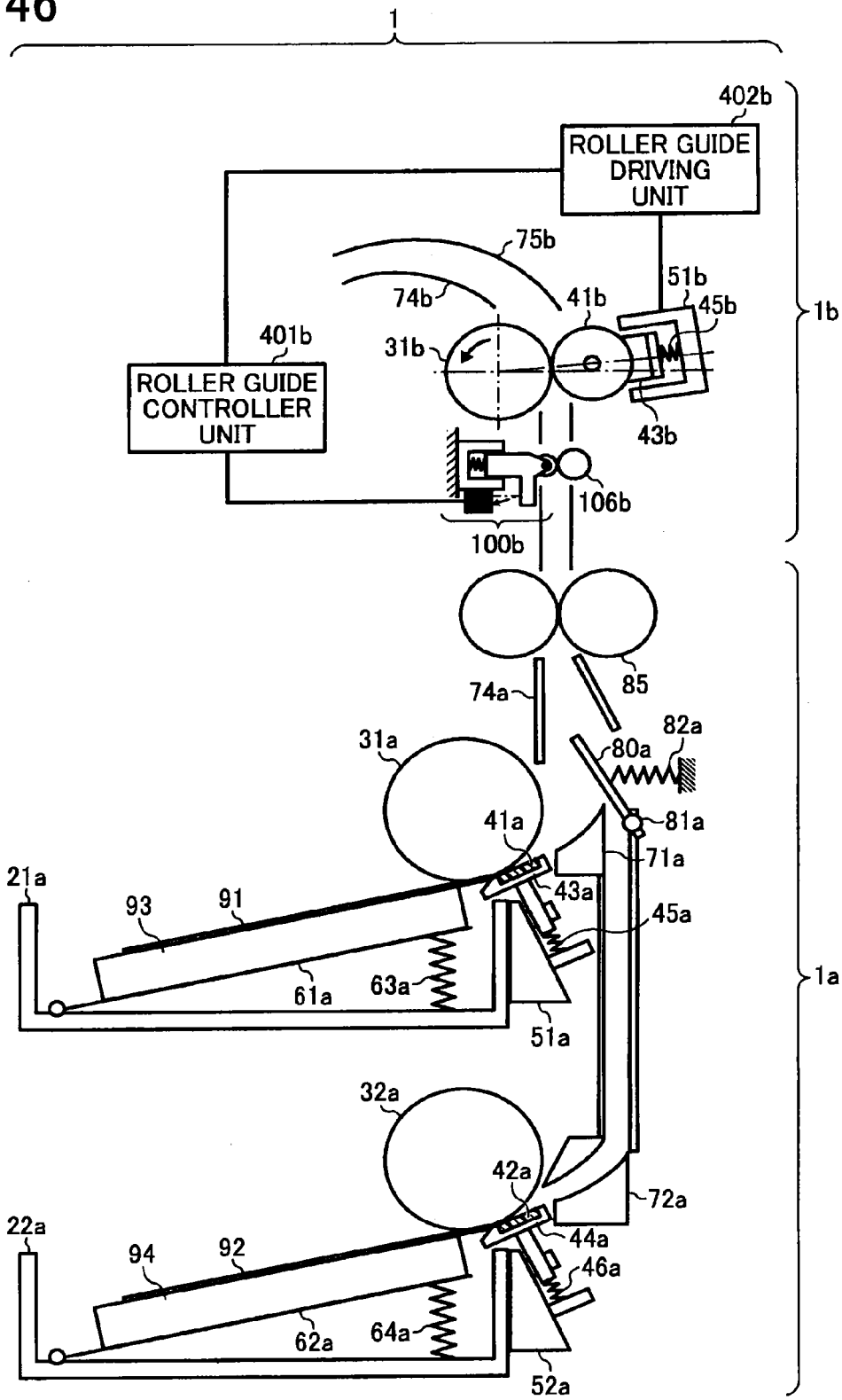
FIG. 46 is a longitudinal cross-sectional view illustrating an example of the sheet feeder of the image forming apparatus of the embodiment 23 described later.

Next, the twenty third embodiment (embodiment 23) of the sheet feeder is described in detail with reference to FIG. 46. FIG. 46 is a cross-sectional view illustrating an example of the sheet feeder of the image forming apparatus of the embodiment 23. The embodiment 23 is an example of the combination of the sheet feeder of the image forming apparatus in the embodiment 1 illustrated in FIG. 1 and the sheet feeder of the image forming apparatus in the embodiment 14 illustrated in FIG. 28. A symbol "a" is put in the end of the numbers in FIG. 46 with regard to the same portions as in the embodiment 1 and a symbol "b" is put in the end of the numbers in FIG. 46 with regard to the same portions as in the embodiment 14 to distinguish them from each other.

With regard to the sheet feeder 1*a* and the movement thereof, the description of the same portions as those described in the first embodiment is omitted. The sheet feeder 1*a* is operated in the same manner as in the embodiment 1 and the sheets 91 and 92 are fed to the sheet feeder 1*b* after passing through the pair of rollers 85.

With regard to the sheet feeder 1*b* and the movement thereof, the description of the same portions as those described in the embodiment 14 is omitted. The sheet feeder 1*b* is operated in the same manner as in the embodiment 14 and the sheets 91 and 92 are fed to the image forming apparatus.

As described in the embodiments 1 and 14, according to the embodiment 23, a sheet feeder that stably feeds sheets without jamming or halting can be provided. In addition, although an example of the combination of the embodiment 1 and the embodiment 14 is described in the embodiment 23, for example, any combination of any one of the embodiments 2 to 13 (FIG. 3 to FIG. 27) and 17 to 22 (FIG. 35 to FIG. 45) instead of the embodiment 1 and the embodiment 15 (FIGS.

31 and 32) or the embodiment 16 (FIGS. 33 and 34) instead of the embodiment 14 can be used.

In addition, the portion corresponding to the embodiment 14 is arranged immediately after the pair of rollers 85 in the embodiment 23 but the pair of rollers 85 is not necessarily required and the portions corresponding to the pair of rollers 85 can be present at multiple places. Furthermore, any number of the portions corresponding to the embodiment 14 can be present in the sheet transfer path.

Figure 47:
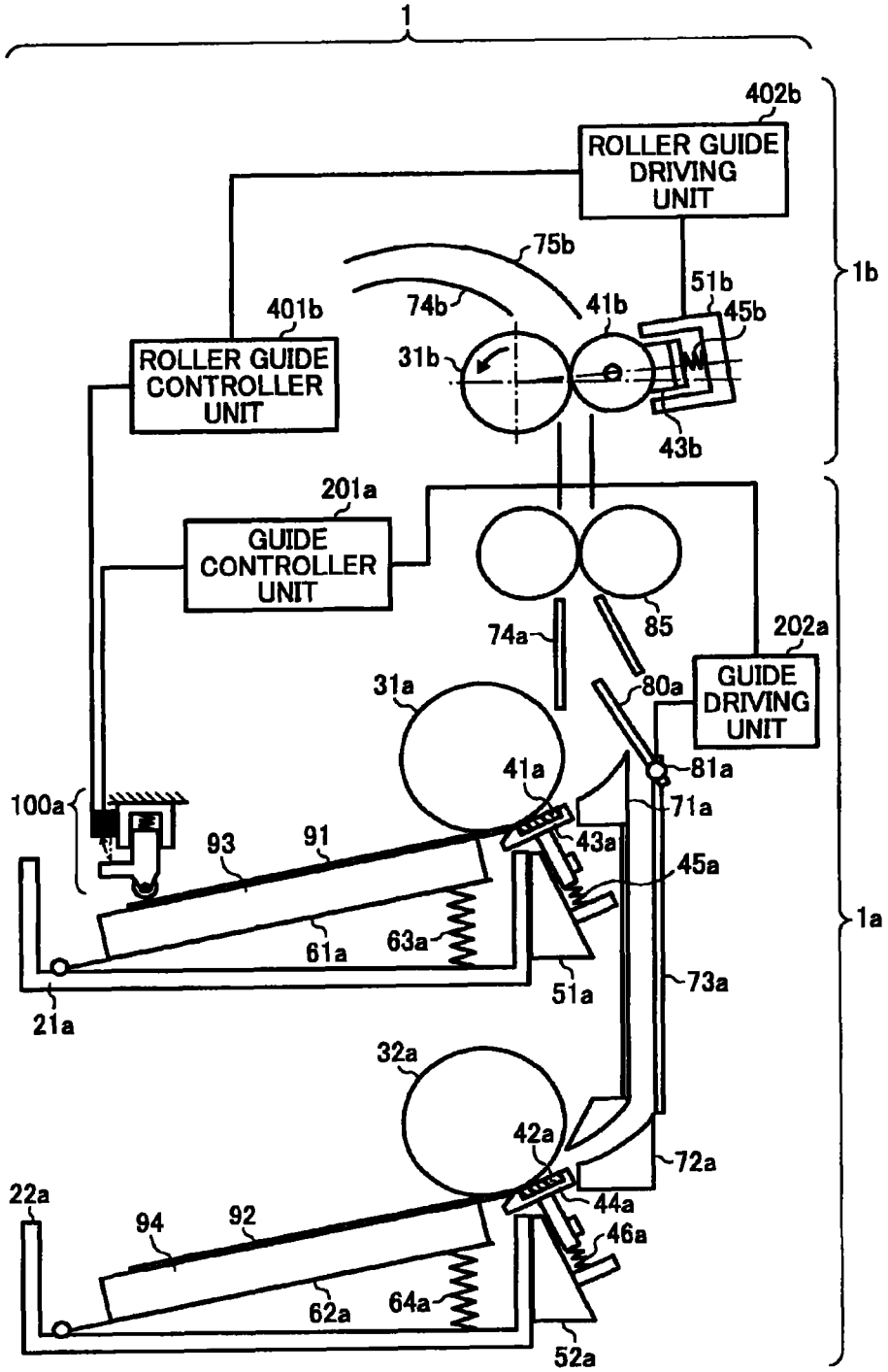
FIG. 47 is a longitudinal cross-sectional view illustrating an example of the sheet feeder of the image forming apparatus of the embodiment 24 described later.

Next, the twenty fourth embodiment (embodiment 24) of the sheet feeder is described in detail with reference to FIG. 47. FIG. 47 is a cross-sectional view illustrating an example of the sheet feeder of the image forming apparatus of the embodiment 24. The embodiment 24 is an example of the combination of the sheet feeder of the image forming apparatus in the embodiment 8 illustrated in FIG. 16 and the sheet feeder of the image forming apparatus in the embodiment 14 illustrated in FIG. 28 A symbol "a" is put in the end of the numbers in FIG. 47 with regard to the same portions as in the embodiment 8 and a symbol "b" is put in the end of the numbers in FIG. 45 with regard to the same portions as in the embodiment 14 to distinguish them from each other.

With regard to the sheet feeder 1*a* and the movement thereof, the description of the same portions as those described in the eighth embodiment is omitted. The sheet feeding cassette 21*a* has the sheet thickness detector 100 to detect the thickness of the sheet 91 placed at the top of the bundle of sheets 93. In addition, the sheet feeder 1*a* has a guide controller unit 201*a* that receives information about the thickness of the sheet from the sheet thickness detector 100*a* and generates signals to drive the movable guide 80*a* and a guide driving unit 202*a* that drives the movable guide 80*a* based on the signals from the guide controller unit 201*a*. The guide driving unit 202*a* is, for example, a stepping motor. The sheet feeder 1*a* is operated in the same manner as in the embodiment 8 and the sheets 91 and 92 are fed to the sheet feeder 1*b* after passing through the pair of rollers 85.

With regard to the sheet feeder 1*b* and the movement thereof, the description of the same portions as those described in the embodiment 14 is omitted. The sheet feeder 1*b* has a roller guide controller unit 401*b* that receives information about the thickness of the sheet from the sheet thickness detector 100*a* and generates signals to drive the roller base support 51*b* together with the roller base 43*b* and a roller guide driving unit 402*b* that drives the roller base support 51*b* based on the signals from the roller guide controller unit 401*b*. The roller guide driving unit 402*b* is, for example, a stepping motor. The sheet feeder 1*b* is operated in the same manner as in the embodiment 14 and the sheets 91 and 92 are fed to the image forming apparatus.

As described in the embodiments 8 and 14, according to the embodiment 24, a sheet feeder that stably feeds sheets without jamming or halting can be provided. In addition, although an example of the combination of the embodiment 8 and the embodiment 14 is described in the embodiment 24, for example, any of the embodiment 2 (FIG. 3 to FIG. 5), the embodiment 5 (FIGS. 10 and 11), the embodiment 10 (FIGS. 20 and 21), the embodiment 12 (FIGS. 24 and 25), the embodiment 13 (FIGS. 26 and 27), the embodiment 17 (FIGS. 35 to 37), the embodiment 20 (FIG. 40), and the embodiment 22 (FIGS. 44 and 45) can be used instead of the embodiment 8.

In the embodiment 24, the guide driving unit 201*a* and the roller guide controller unit 401*b* are independent from each other but can be combined to be a single device. Also, the guide driving unit 202*a* and the roller guide controller unit 402*b* are independent from each other but can be combined to be a single device. In addition, the portion corresponding to the embodiment 14 is arranged immediately after the pair of rollers 85 in the embodiment 24 but the pair of rollers 85 is not necessarily required and to the contrary the portions corresponding to the pair of rollers 85 can be present at multiple places. Furthermore, any number of the portions corresponding portion to the embodiment 14 can be present in the sheet transfer path.

Figure 48:
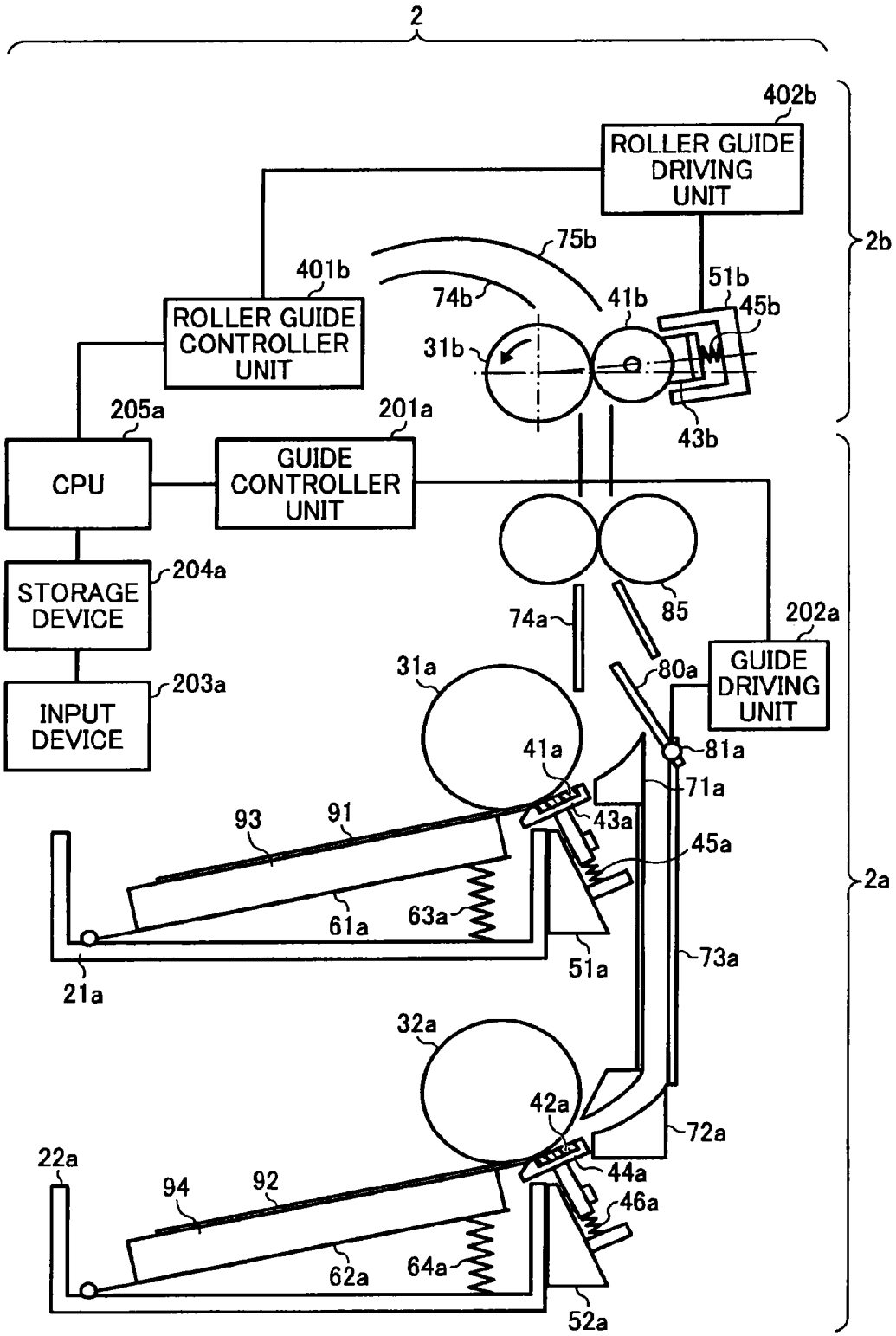
FIG. 48 is a longitudinal cross-sectional view illustrating an example of the sheet feeder of the image forming apparatus of the embodiment 25 described later.
Figure 49:
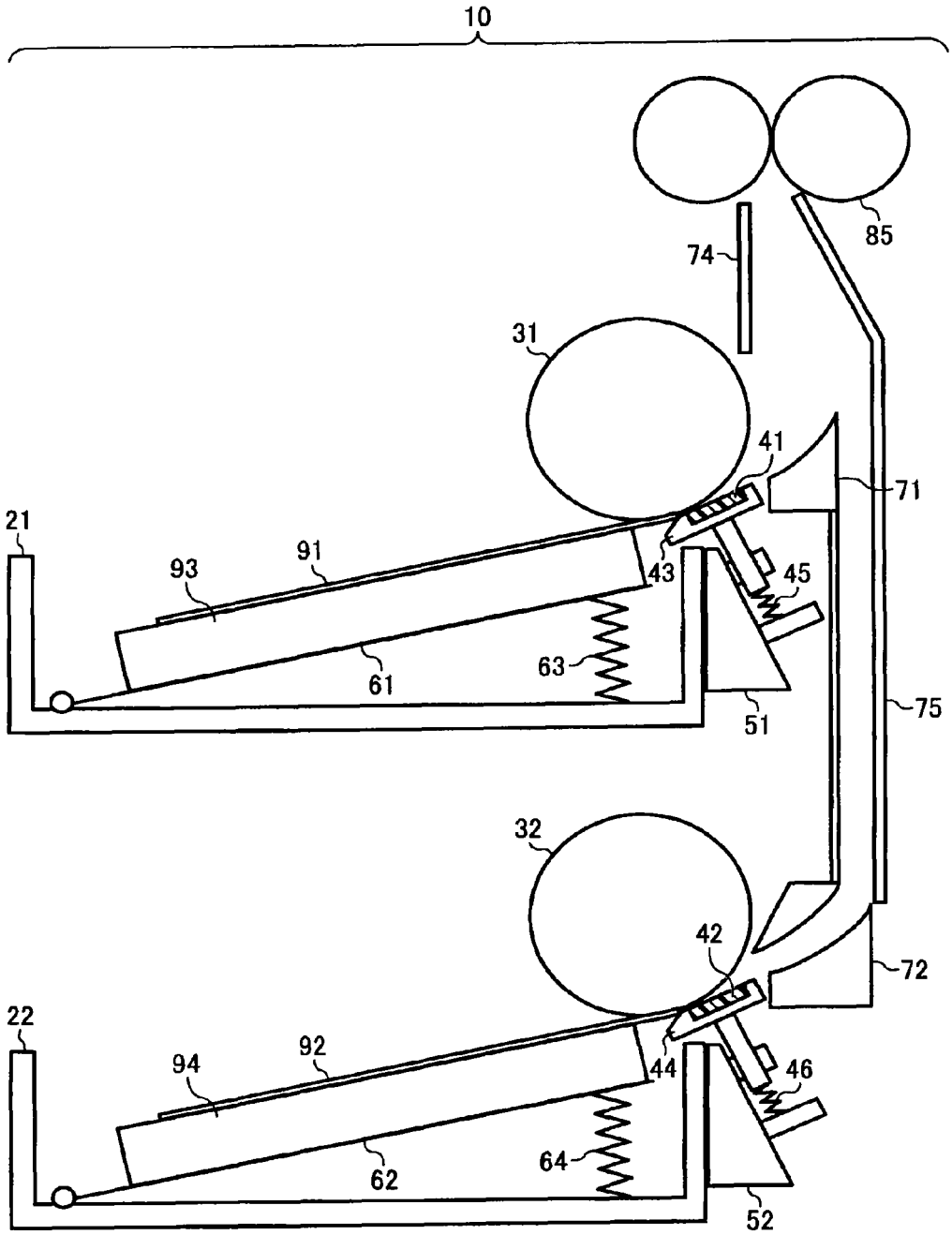
FIG. 49 BACKGROUND ART
FIG. 49 is a longitudinal cross-sectional view illustrating a sheet feeder contained in a typical image forming apparatus.
Figure 50:
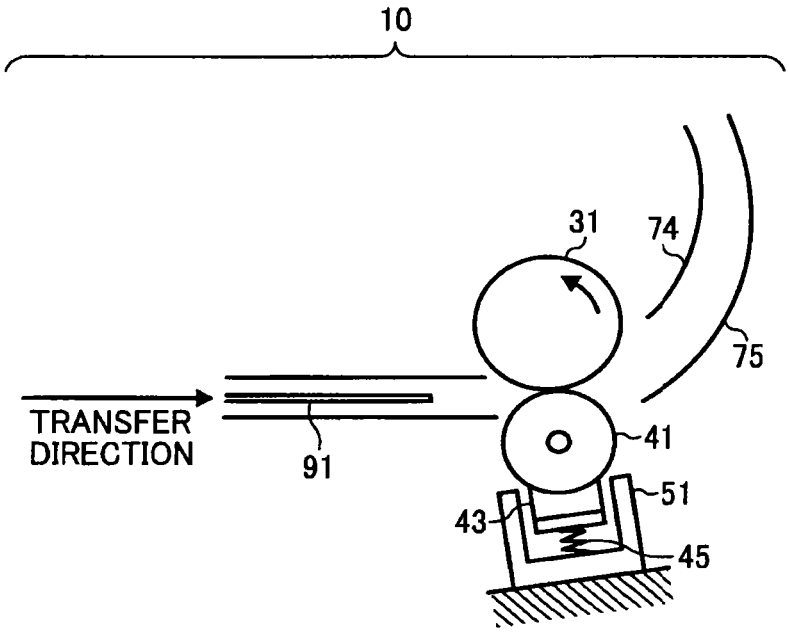
FIG. 50 BACKGROUND ART
FIG. 50 is a longitudinal cross-sectional view illustrating a sheet feeder contained in a typical image forming apparatus.

Next, the twenty fifth embodiment (embodiment 25) of the sheet feeder is described in detail with reference to FIG. 48. FIG. 48 is a cross-sectional view illustrating an example of the sheet feeder of the image forming apparatus of the embodiment 25. The embodiment 25 is an example of the combination of the sheet feeder of the image forming apparatus in the embodiment 9 illustrated in FIG. 18 and the sheet feeder of the image forming apparatus in the embodiment 15 illustrated in FIG. 31. A symbol "a" is put in the end of the numbers in FIG. 48 with regard to the same portions as in the embodiment 9 and a symbol "b" is put in the end of the numbers in FIG. 48 with regard to the same portions as in the embodiment 15 to separate from each other.

With regard to the sheet feeder 2*a* and the movement thereof, the description of the same portions as those described in the ninth embodiment is omitted. With regard to the sheet feeder 2*a*, property information about the sheet such as the kind, thickness, or elasticity (bending rigidity) is input or selected from the input device 203*a*. The input information about the sheet is sequentially stored in a storage device 204*a*. The CPU 205*a* controls the property information in the storage device 204*a*.

The CPU 205*a* transmits the property information about the next sheet 91 to the guide controller unit 201*a*. Based on the transmitted information about the sheet 91, the guide controller unit 201*a* determines the movement of the movable guide 80*a* and the guide driving unit 202*a* moves the movable guide 80*a*. As a result, the movable guide 80*a* rotates clockwise, narrowing the contact angle between the leading end of the sheet 91 and the movable guide 80*a*. The sheet feeder 2*a* is operated in the same manner as in the embodiment 9 and the sheets 91 and 92 are fed to the sheet feeder 2*b* after passing through the pair of rollers 85.

With regard to the sheet feeder 2*b* and the movement thereof, the description of the same portions as those described in the embodiment 15 is omitted. The CPU 205*a* transmits the property information about the sheets 91 and 92 fed next to the roller guide controller unit 401*b*. In addition, the sheet feeder 2*a* of the image forming apparatus sends information to the roller guide controller unit 401*b* about the transfer timing on which the sheets 91 and 92 are transferred. The information about the transfer timing is obtained by, for example, sending the starting signal to the roller guide controller unit 401*b* when the feeding roller of the sheet feeder starts rotating. Alternatively, the information can be obtained by providing the sheet passing detector 300 as described in the embodiment 16 (FIG. 33).

In the embodiments 23 to 25, an image forming portion (unit) that forms images on the sheets is provided downstream from the sheet transfer path formed of the sheet transfer guides 74*b* and 75*b* relative to the sheet transfer direction. The image forming portion (unit) and the sheet feeder form an image forming apparatus such as a photocopier.

As described above, the roller guide controller unit having a device to measure the elapse time of the sheet transfer or the sheet passing detector 300 that detects the state of the sheet transfer is provided in the middle of the sheet transfer path to detect the elapse time of the sheet transfer or the position of the sheet. In the specification, the device to measure the elapse time of the sheet transfer and the sheet passing detector are referred to as a sheet detector.

Based on the transmitted information of the sheets 91 and 92 and the transfer timing, the roller guide controller unit 401*b* determines the movement of the roller base support 51 and the roller guide driving unit 402*b* moves the roller base support 51*b*. Then, the roller base support 51*b* rotates counterclockwise together with the roller base 43*b*, narrowing the contact angle between the leading end of the sheets 91 and 92 and the sheet feeding guide 75*b*. The sheet feeder 2*b* is operated in the same manner as in the embodiment 15 and the sheets 91 and 92 are fed to the image forming apparatus.

As described in the embodiments 9 and 15, according to the embodiment 25, a sheet feeder that stably feeds sheets without jamming or halting can be provided.

In addition, although an example of the combination of the embodiment 9 and the embodiment 15 is described in the embodiment 25, for example, any one of the embodiment 3 (FIGS. 6 and 7), the embodiment 6 (FIGS. 12 and 13), the embodiment 11 (FIGS. 22 and 23), and the embodiment 19 (FIG. 39) can be used instead of the embodiment 9.

In the embodiment 25, the guide controller unit 201*a* and the roller guide controller unit 401*b* are independent from each other but can be combined to be a single device. Also, in the embodiment 25, the guide driving unit 202*a* and the roller guide driving unit 402*b* are independent from each other but can be combined to be a single device. In addition, the portion corresponding to the embodiment 15 is arranged immediately after the pair of rollers 85 in the embodiment 25 but the pair of rollers 85 is not necessarily required and the portions corresponding to the pair of rollers 85 can be present at multiple places. Furthermore, any number of the portions corresponding portion to the embodiment 15 can be present in the sheet transfer path.

What is claimed is:

1. A sheet feeder comprising:

a sheet container on which sheets are placed;

a transfer roller;

an opposing roller facing the transfer roller to transfer a sheet that has advanced between the transfer roller and the opposing roller;

a sheet thickness detector to measure a thickness of the sheet; and a roller guide driver to tilt the opposing roller based on the thickness of the sheet detected by the sheet thickness detector, wherein the opposing roller tilts at an angle, using the roller guide driver, to a surface of the transfer roller determined by the thickness of the sheet, using the sheet thickness detector, that has advanced between the transfer roller and the opposing roller.

2. An image forming apparatus comprising:

the sheet feeder of claim 1.

3. A sheet feeder comprising:

a sheet container on which sheets are placed;

a transfer roller;

an opposing roller facing the transfer roller to transfer a sheet that has advanced between the transfer roller and the opposing roller;

a memory device to store property information about the sheets placed in the sheet container;

a reading device to read the property information about the sheets placed in the sheet container from the memory device; and a roller guide driver to tilt the opposing roller based on the property information stored in the memory device.

4. An image forming apparatus comprising:

the sheet feeder of claim 3.

5. A sheet feeder comprising:

a sheet container on which sheets are placed;

a transfer roller;

an opposing roller facing the transfer roller to transfer a sheet that has advanced between the transfer roller and the opposing roller;

a roller guide driver to tilt the opposing roller; and a sheet detector to detect a timing with which the sheet is transferred by the transfer roller and passes through the transfer roller and the opposing roller, wherein the roller guide driver tilts the opposing roller based on the timing detected by the sheet detector.

6. An image forming apparatus comprising:

the sheet feeder of claim 5.

* * * * *